US012570490B2

(12) United States Patent
Perini et al.

(10) Patent No.: US 12,570,490 B2
(45) Date of Patent: Mar. 10, 2026

(54) PLANT AND METHOD FOR THE MOVEMENT OF CARDBOARD CORES

(71) Applicant: FUTURA S.P.A., Capannori (IT)

(72) Inventors: Fabio Perini, Viareggio (IT); Andrea Catalini, Porcari (IT)

(73) Assignee: FUTURA S.P.A., Capannori (IT)

( * ) Notice: Subject to any disclaimer, the term of this patent is extended or adjusted under 35 U.S.C. 154(b) by 38 days.

(21) Appl. No.: 18/038,479

(22) PCT Filed: Dec. 9, 2021

(86) PCT No.: PCT/IT2021/050398
§ 371 (c)(1),
(2) Date: May 24, 2023

(87) PCT Pub. No.: WO2022/130428
PCT Pub. Date: Jun. 23, 2022

(65) Prior Publication Data

US 2024/0140749 A1 May 2, 2024

(30) Foreign Application Priority Data

Dec. 14, 2020 (IT) ..... 102020000030656

(51) Int. Cl.
*B65H 19/12* (2006.01)
*B65H 19/18* (2006.01)

(52) U.S. Cl.
CPC ..... *B65H 19/18* (2013.01); *B65H 19/12* (2013.01); *B65H 2301/46414* (2013.01)

(58) Field of Classification Search
CPC ..... B65H 19/12; B65H 19/18; B65H 19/123; B65H 67/065; B65H 67/067
See application file for complete search history.

(56) References Cited

U.S. PATENT DOCUMENTS

| | | | | |
|---|---|---|---|---|
| 4,744,711 | A * | 5/1988 | Heitmann | B65H 75/08 414/796.9 |
| 5,601,252 | A * | 2/1997 | Draghetti | B65H 19/123 242/559.3 |
| 2020/0156813 | A1* | 5/2020 | Wipf | B25J 15/0047 |
| 2024/0101382 | A1* | 3/2024 | Perini | B65H 19/12 |
| 2024/0101383 | A1* | 3/2024 | Perini | B65H 19/123 |

* cited by examiner

*Primary Examiner* — Sang K Kim
(74) *Attorney, Agent, or Firm* — Rivka Friedman

(57) ABSTRACT

System for handling cardboard reels to feed machines that produce cardboard tubes, comprising a station (P) for picking up the reels configured to receive a stack (2) of overlapping cardboard reels (1), a station (U) for unwinding of the reels comprising at least one unwinding unit (UU), and handling means (D) for moving the reels (1) along a predetermined path between the reel pick-up station (P) and the unwinding station (U). The reel handling means are provided with an additional reversible device for hooking the reels to the handling means themselves.

18 Claims, 67 Drawing Sheets

PLANT AND METHOD FOR THE MOVEMENT OF CARDBOARD CORES

The present invention relates to a plant and a process for handling cardboard reels.

More particularly, the present invention relates to the handling of cardboard reels to feed machines that produce cardboard tubes, especially for making paper rolls with an internal tubular core.

It is known that the production of logs of paper material, from which rolls of toilet paper or kitchen paper rolls are obtained, involves feeding a web of paper, formed by one or more overlapping plies, along a predetermined path along which various operations are carried out before proceeding with the formation of the logs, including a transversal pre-incision of the web to form pre-cutting lines that divide it into tear-off sheets. The formation of the logs normally involves the use of cardboard tubes, commonly called "cores" on the surface of which a predetermined quantity of glue is distributed to allow the gluing of the paper web on the cores gradually introduced into the machine that produces the logs. commonly known as "rewinder".

Upon reaching the predetermined number of sheets wound on the core, the last sheet of the log being completed is separated from the first sheet of the subsequent log, for example by means of a jet of compressed air directed towards a corresponding pre-incision line. At this point, the log is unloaded from the rewinder. Patent EP1700805 describes a rewinding machine which works according to the above indicated operating scheme. The logs thus produced are then conveyed to a storage unit which supplies one or more cutting-off machines by means of which the transversal cutting of the logs is carried out in order to obtain the rolls in the desired format.

The tubular cores are produced by means of machines commonly known as "tube-forming machines" configured to wind one or more cardboard webs around a mandrel creating a helical winding. Examples of tube mills configured in this way are provided in EP3099481 and EP3212391B.

The reels from which the cardboard webs are unwound are loaded, with the aid of lifting devices controlled by an operator, onto special unwinding units that support the reels themselves during the production of the tubes. For this purpose, these reels are arranged, stacked on a pallet, in a parking station from which they must be picked up one at a time to be conveyed to the unwinding units of the tube-forming machines. There is still a strong need to automate as many operations as possible related to the handling of cardboard reels for feeding tube-forming machines.

The main object of the present invention is to meet the above requirement.

This result has been achieved, in accordance with the present invention, by adopting the idea of creating a plant and implementing a process having the characteristics indicated in the independent claims. Other characteristics of the present invention are the subject of the dependent claims.

Thanks to the present invention, it is possible to automate most of the operations connected to the handling of the cardboard reels used to feed the tube mills, with both economic and technical advantages. From an economic point of view, the main advantages derive from a more efficient management of the personnel assigned to handling the cardboard reels and from the greater efficiency of the production process. From a technical point of view, the main advantages derive not only from automation, but also from greater operational precision and greater safety in the handling phases of the cardboard reels, avoiding risky manual interventions by the operators.

These and further advantages and characteristics of the present invention will be better understood by every person skilled in the art thanks to the following description and the attached drawings, provided by way of example but not to be considered in a limiting sense, in which:

FIGS. 4A-11A are schematic side views of a plant according to the present invention in a succession of operating phases in which some parts are not represented to better highlight others;

FIGS. 4B-11B are schematic plan views of a plant in accordance with the present invention in a succession corresponding, in order, to FIGS. 4A-11A, where some parts are not represented to better highlight others;

Figure 46:
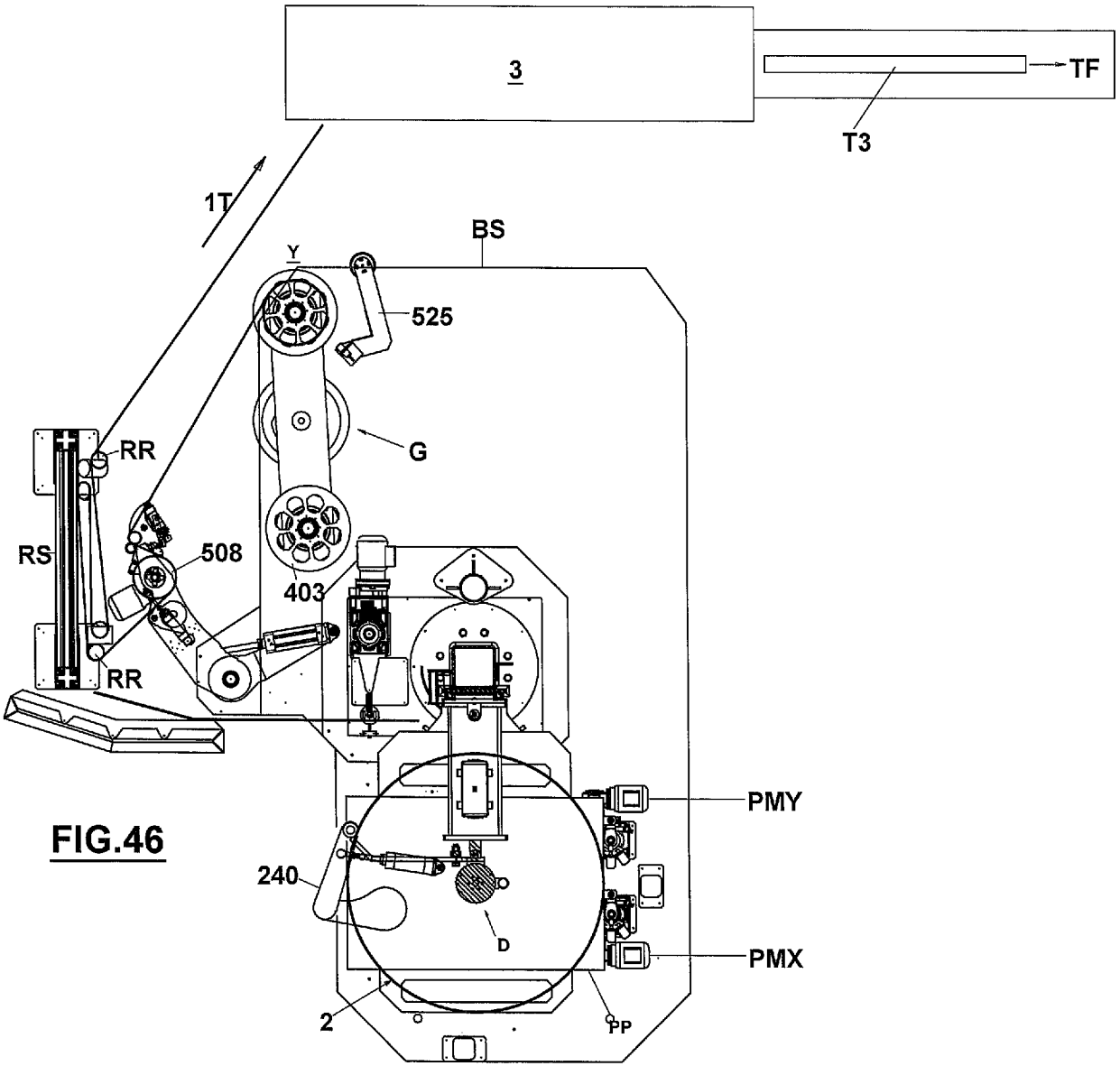
Figure 47:
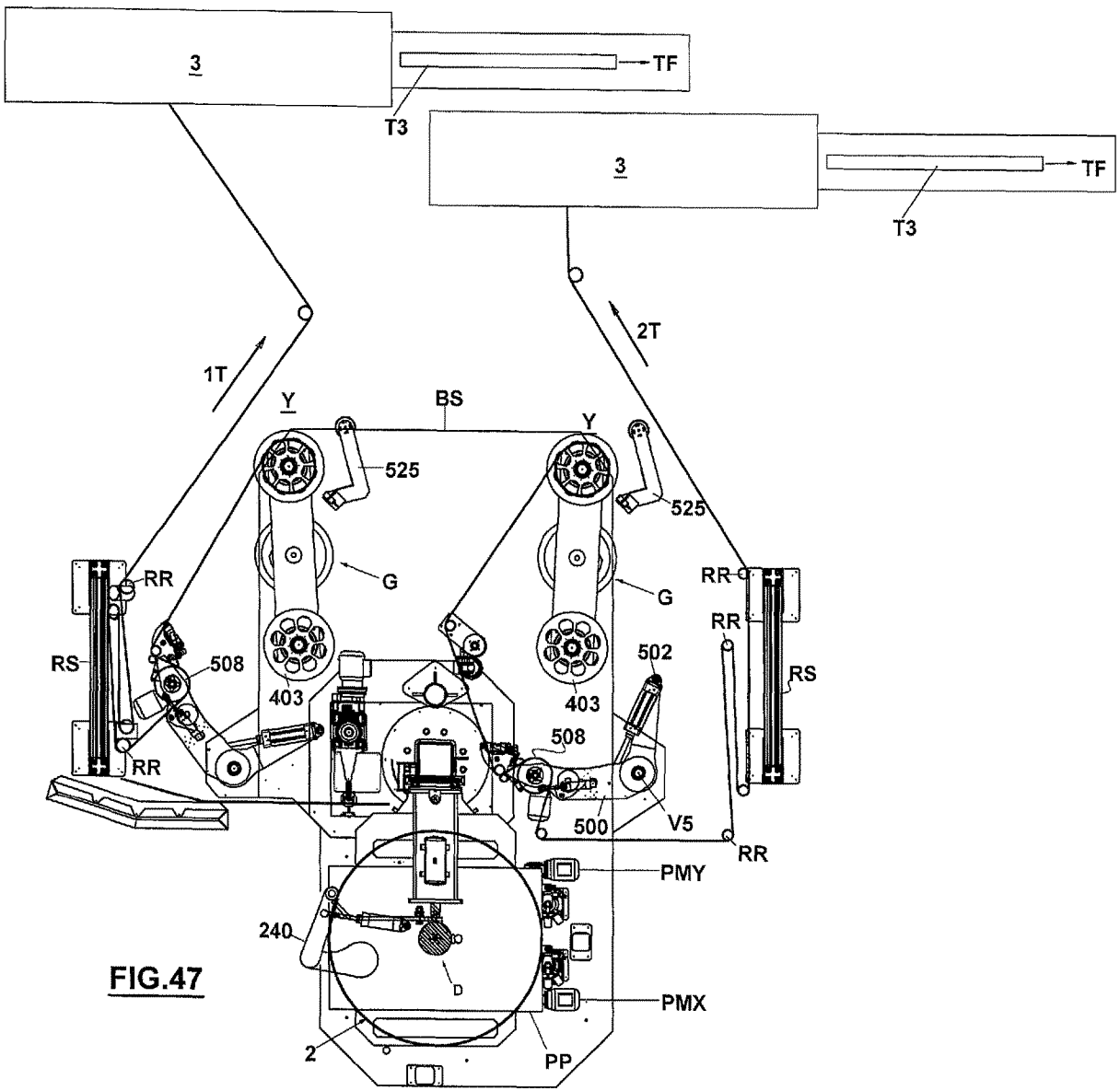
Figure 48:
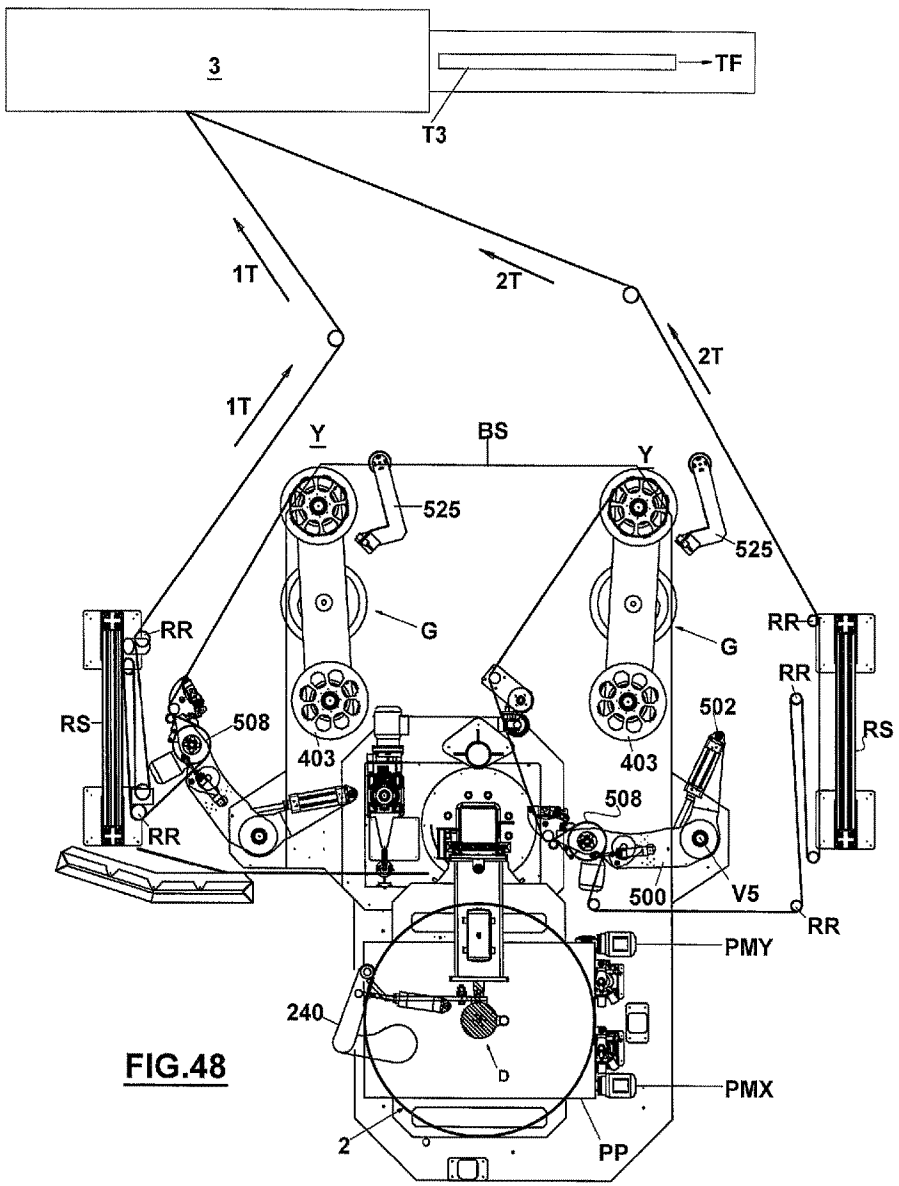

FIG. 46 schematically illustrates a tube-forming machine served by a plant in accordance with the present invention FIG. 47 schematically illustrates two tube-forming machine served by a plant according to the present invention;

FIG. 48 schematically illustrates a tube maker served by two unwinding units of a plant according to the present invention.

Reduced to its essential structure and with reference to the figures of the attached drawings, a plant according to the present invention comprises:

- a loading station (P) in which a platform (PP) is arranged to support a plurality of cardboard web reels (1) superimposed to form a stack (2) and intended to feed at least one tube-forming machine (3);
- an unwinding station (U) comprising means for controlling the unwinding of each reel (1);
- a handling device (D) comprising a manipulator arm (200) arranged and acting between the loading station (P) and the unwinding station (U), the manipulator arm (200) being linked to a guide mechanism (MG) configured to guide the same manipulator arm (200) along a predetermined path which develops between the loading station (P) and the unwinding station (U).

In FIG. 46 an arrangement is exemplified which provides for a single tube-forming machine (3) served by a plant in accordance with the present invention, while in FIG. 47 an arrangement is exemplified that provides two tube-forming machines (3) served by a plant in accordance with the present invention. In FIG. 46 and FIG. 47 a cardboard tube (T3) produced by each tube-forming machine (3) is also schematically illustrated and the arrow "TF" indicates the exit of the tubes (T3) from the respective tube-forming machine (3). In FIG. 48 an arrangement is exemplified which provides a tube-forming machine (3) which receives the cardboard strips fed by two unwinding units to produce tubes formed by the superimposition of two strips rather than by a single cardboard strip.

The reels (1) are formed by a predetermined amount of cardboard web wrapped around a central tubular core (1C). The stack (2) is formed by a predetermined number of superimposed reels (1).

The tube-forming machines (3) are machines known per se, for example of the type described in the previously cited documents.

The handling device (D) is configured to operate on the single reels (1) of the stack (2) set up in the loading station (P) to feed one or more tube-forming machines (3) which use the reels (1) to produce cardboard tubes.

The handling device (D) is preferably configured and structured to facilitate the detachment of each reel (1) of the stack (2) from the underlying reel. With reference to the example shown in FIGS. 17-27 of the attached drawings, a device according to the present invention comprises two coaxial ducts (4, 5) with an upper side and a lower side, connected to respective inlets (40, 50) for the introduction of compressed air which are arranged on a distributor (6) positioned on the upper side of the same ducts (40, 50). Each of said inputs (40, 50) is controlled by a respective solenoid valve (41, 51) which, in turn, is operated by means of a programmable control unit (7) as further described below.

In the exemplary drawings of FIGS. 17-27, the duct (4) is inside the duct (5). The distributor (6) is mounted on the upper side of the external duct (5) by means of a bolt (65) which screws into the upper side of this duct. The inlets (40, 50) are radially oriented in the distributor (6) with respect to the coaxial ducts (4, 5) and are spaced apart by a predetermined value (h) thus forming an upper inlet (40) and a lower inlet (50) for compressed air. The upper inlet (40) is in communication with the internal duct (4), while the lower inlet (50) is in communication with the external duct (5).

Figure 3:
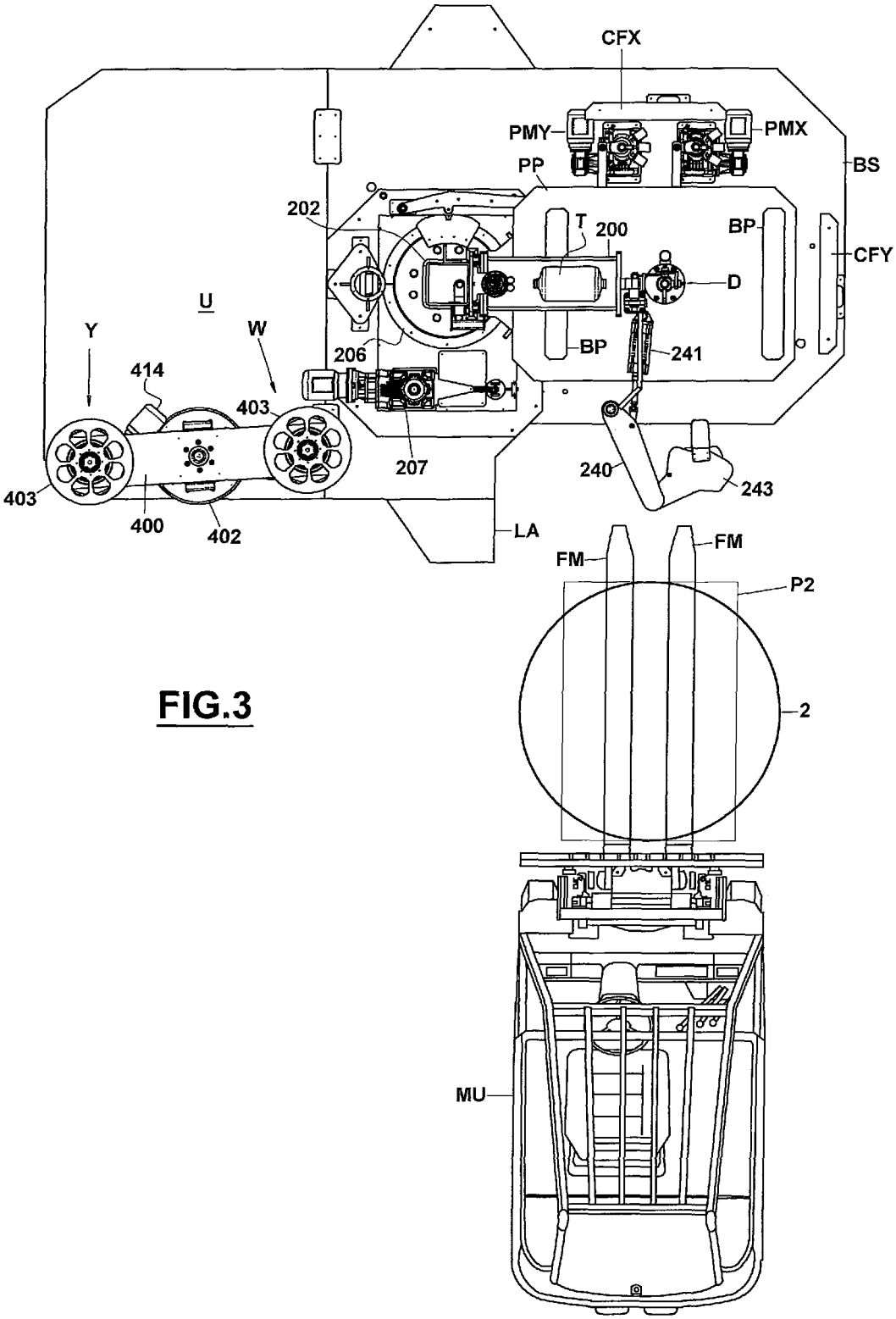
FIG. 3 is a schematic plan view of a plant according to the present invention in which a forklift used to load the cardboard reels on the platform (PP) of the reel parking station is represented.

The lower base (60) of the distributor (6) is integral with the upper base (80) of a box-like body (8) which is crossed by the tubular ducts (4, 5) and has a lower base in the form of a flange (81). The box-shaped body (8) is integral with a maneuvering portion (800) which can be moved to and from the stack (2) by means of a movement arm (200) as further described below. In the example shown in FIGS. 3-5, said operating portion (800) is formed by a plurality of vertical rods (801) which connect an upper flange (802) to the lower flanged base (81) of said body (8), so as to contain the latter and the distributor (6) inside it.

On the lower side of the rod (45) formed by the coaxial ducts (4, 5) two plates (91, 92) are mounted, placed at a predetermined distance from each other, forming an upper plate (91) and a lower plate (92). The upper plate (91) includes a fixed upper flange (911) keyed on the rod (45), a movable lower flange (912) able to slide on the rod itself (45), and an elastic gasket (913) positioned between the fixed upper flange (911) and the lower movable flange (912) coaxially to the rod (45). Similarly, the lower plate (92) comprises a fixed lower flange (921) integral with the lower end of the rod (45), a movable upper flange (922) able to slide on the rod (45), and an elastic gasket (923) positioned between the fixed lower flange (921) and the movable upper flange (922) coaxially to the rod (45). For example, the fixed lower flange (921) is blocked on the lower end of the rod (45) by means of a bolt (95). The outlet (42) of the internal duct (4) is between the movable flanges (912, 922) of the plates (91, 92). The drawings also show two ducts (420) that pneumatically connect the movable flanges (912, 922) with the outlet (42) of the duct (4). In practice, by introducing compressed air through the inlet (40), the movable flanges (912, 922) move in the direction of the respective fixed flanges (911, 921), each compressing the corresponding elastic gasket (913, 923) which, consequently, is forced to expand radially outwards.

For example, the gaskets (913, 923) are made of silicone rubber or para rubber, which is rubber with a hardness between 20 Shore A and 40 Shore A. Preferably, the fixed lower flange (920) has a lower conical surface (924) which favors its insertion into the cores (1C) of the stacked reels (1). Preferably, said conical surface is a perimeter surface that delimits an internal concave cavity (925) whose function is described below.

In practice, the plates (91, 92) have an elastically expandable portion in the radial direction (the portion that in the example described above consists of the respective gaskets) when compressed air is introduced into the internal duct (4).

The outlet (52) of the external duct (5) is in correspondence with a space (S) present between the movable flanges (912, 922) of the plates (91, 92). In practice, the external duct (5) is used to pressurize a space (S) between the plates (91, 92).

The device (D) shown by way of example in FIGS. 17-27 also comprises a mechanism suitable for engaging the internal surface of the cores (1C) of the reels (1). For example, this mechanism comprises a plurality of jaws (100) consisting of levers in the shape of an inverted "L" with a toothed front side (101), a rear side (102) constrained to a bushing (104) able to slide on the surface external duct (5), and an intermediate part pivoted on a pin (103) oriented perpendicular to the surface of a casing (880) developed under the flanged part (81). Said casing has suitable openings (881) to allow the jaws (100) to come out. Therefore, by sliding the bushing (104) along the duct (5) the rotation of the levers (100) on the pins (103) is determined; said rotation causes the toothed sides (101) to move away from the bushing (104) when the latter is pushed upwards and, vice versa, determines the approach of the toothed sides (101) to the bushing (104) when the latter is pushed down. In other words, said rotation determines the radial movement of the jaws (100) from and towards the longitudinal axis (A9) of the device. The upper part of the bushing (104) has a flange (105) which, in cooperation with a cup-shaped lower appendix (82) of the lower base (81) of the box-shaped body (8), defines a housing for an elastic element (106) invested coaxially on the bushing (104). The flange (105) arranged on the upper part of the bushing (104) is integral with a piston (107) arranged between the same flange (105) and the upper base (80) of the box-like body (8). In addition, the upper base (80) of the box-like body (8) has an inlet (83) for the introduction of compressed air into it. Therefore, by introducing compressed air into the box-shaped body (8) through the inlet (83), the piston (107) is lowered, overcoming the resistance of the elastic element (106) and causing the lowering of the bushing (104), meaning the approach of the toothed sides of the levers (100) to the bushing (104). On the other hand, when the introduction of compressed air through the inlet (83) of the box-like body (8) is interrupted, the bushing (104) is pushed upwards by the elastic element (106), which determines the removal of the toothed sides of the levers (100) from the bushing (104). The inlet (83) is also controlled by a solenoid valve (830) operated by the control unit (7). The drawings also show two ducts (420) that pneumatically connect the movable flanges (912, 922) with the outlet (42) of the duct (4). In the following, the whole part of the device (D) underneath the flanged part (81) will also be called the "engagement part" (ED) of the device (D).

Figure 4A:
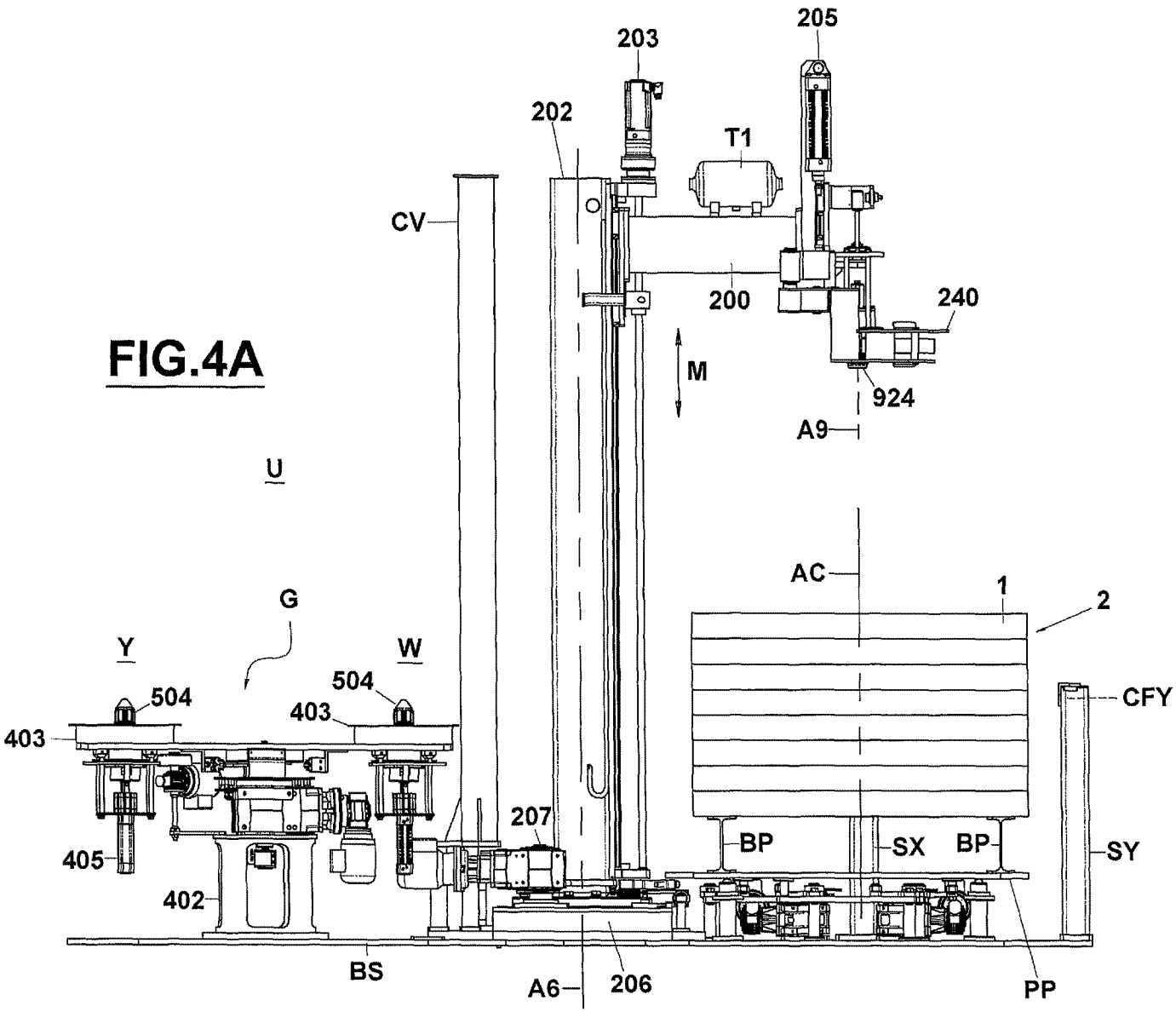
Figure 5A:
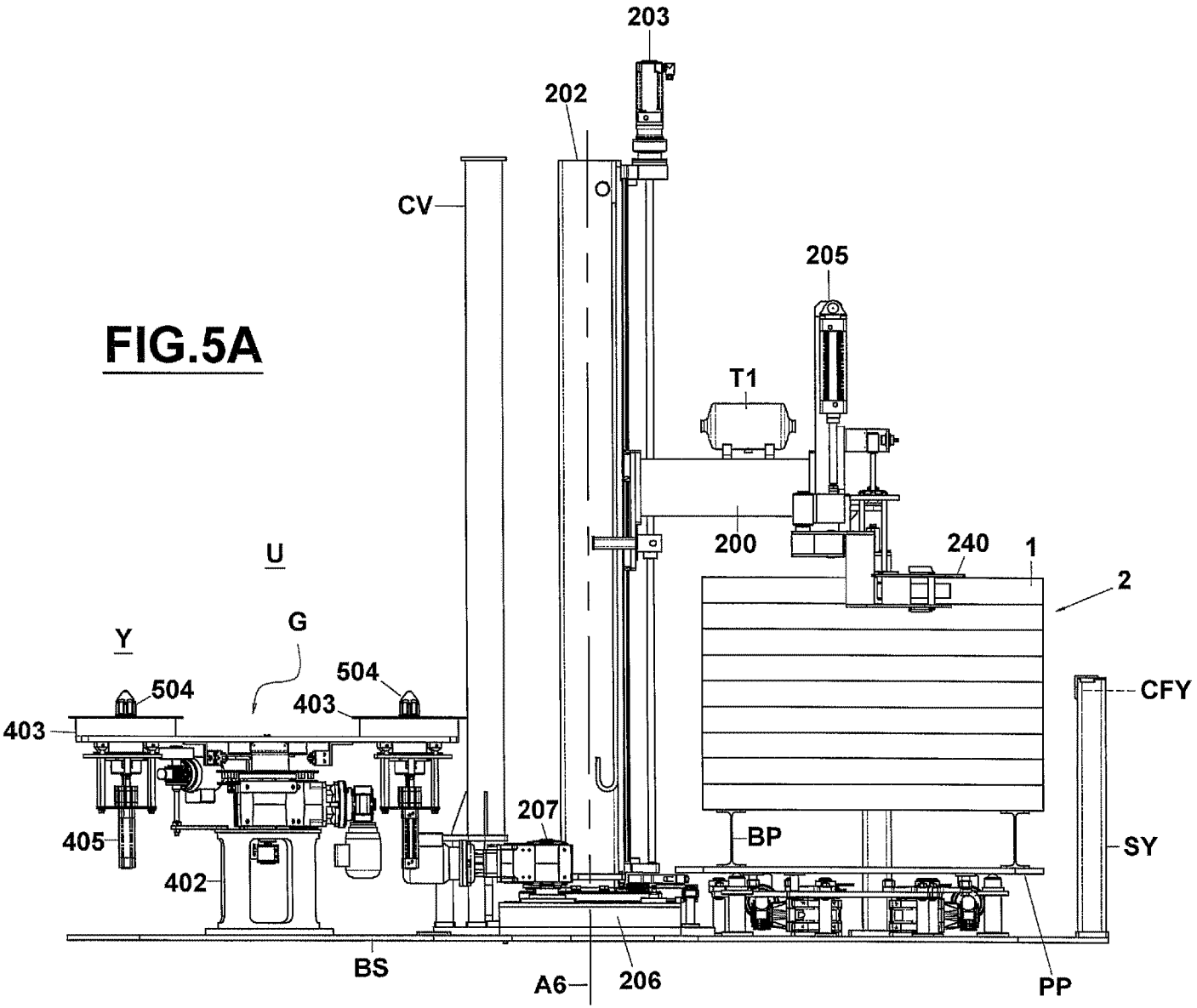
Figure 5B:
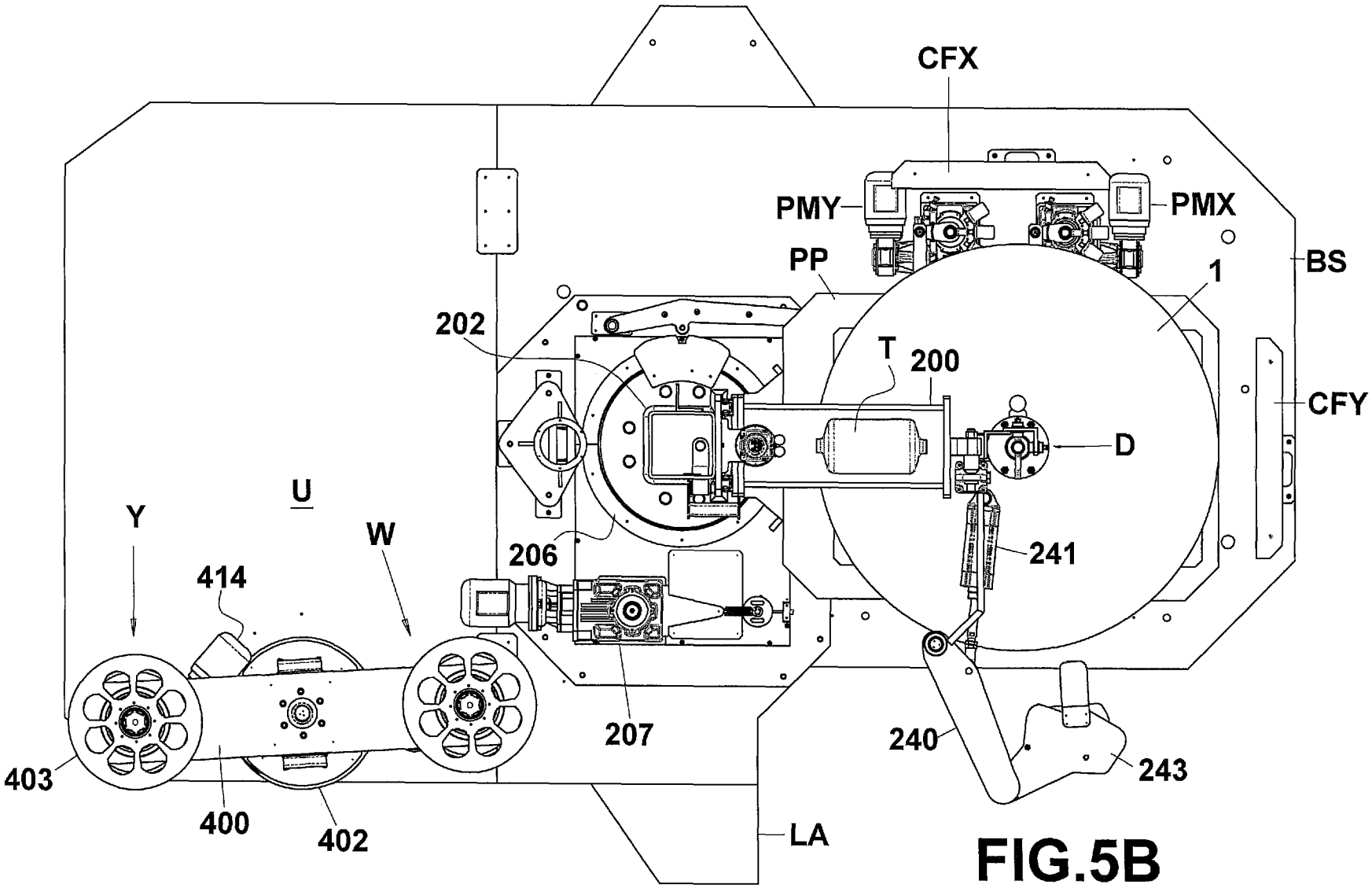
Figure 6A:
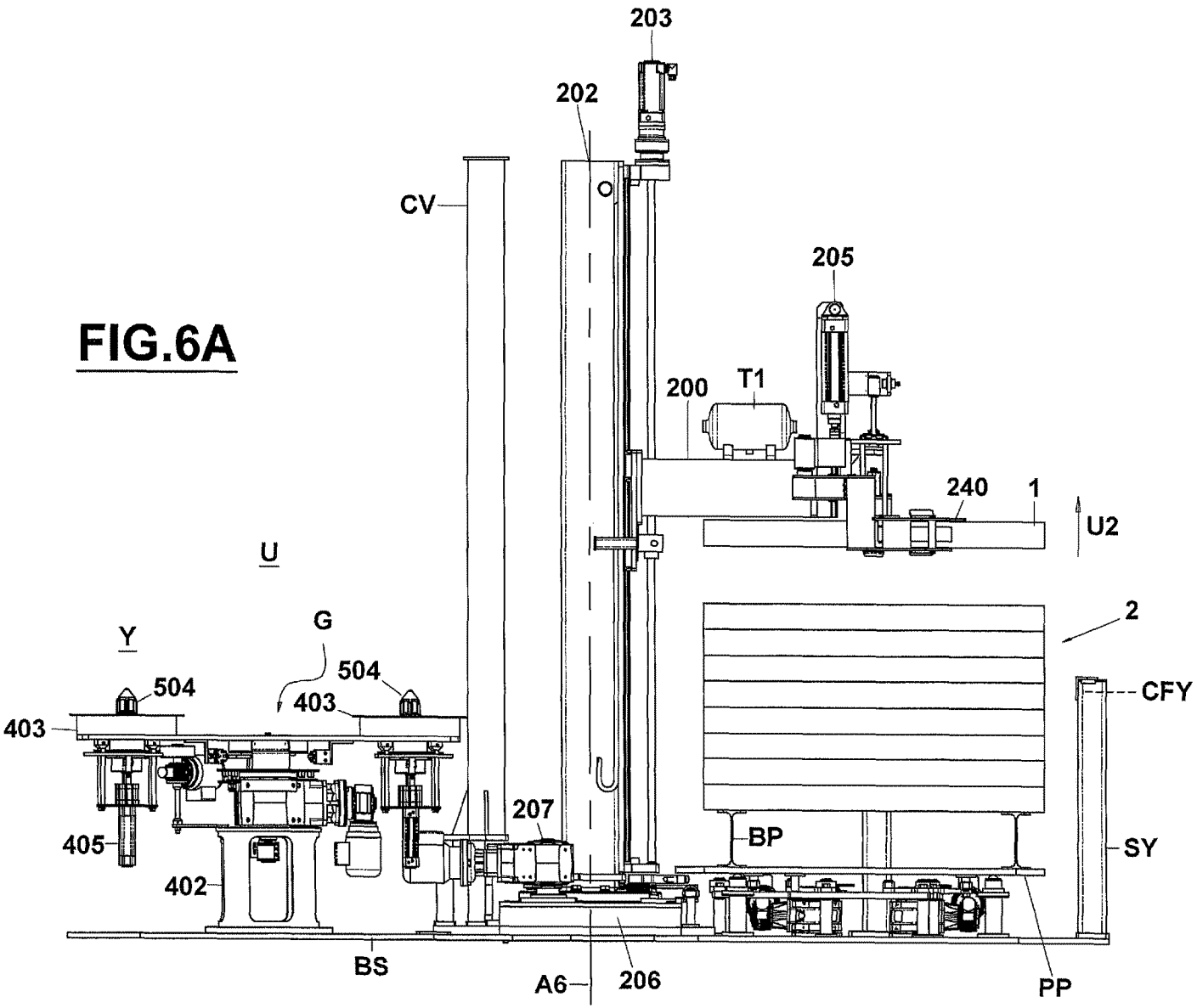
Figure 6B:
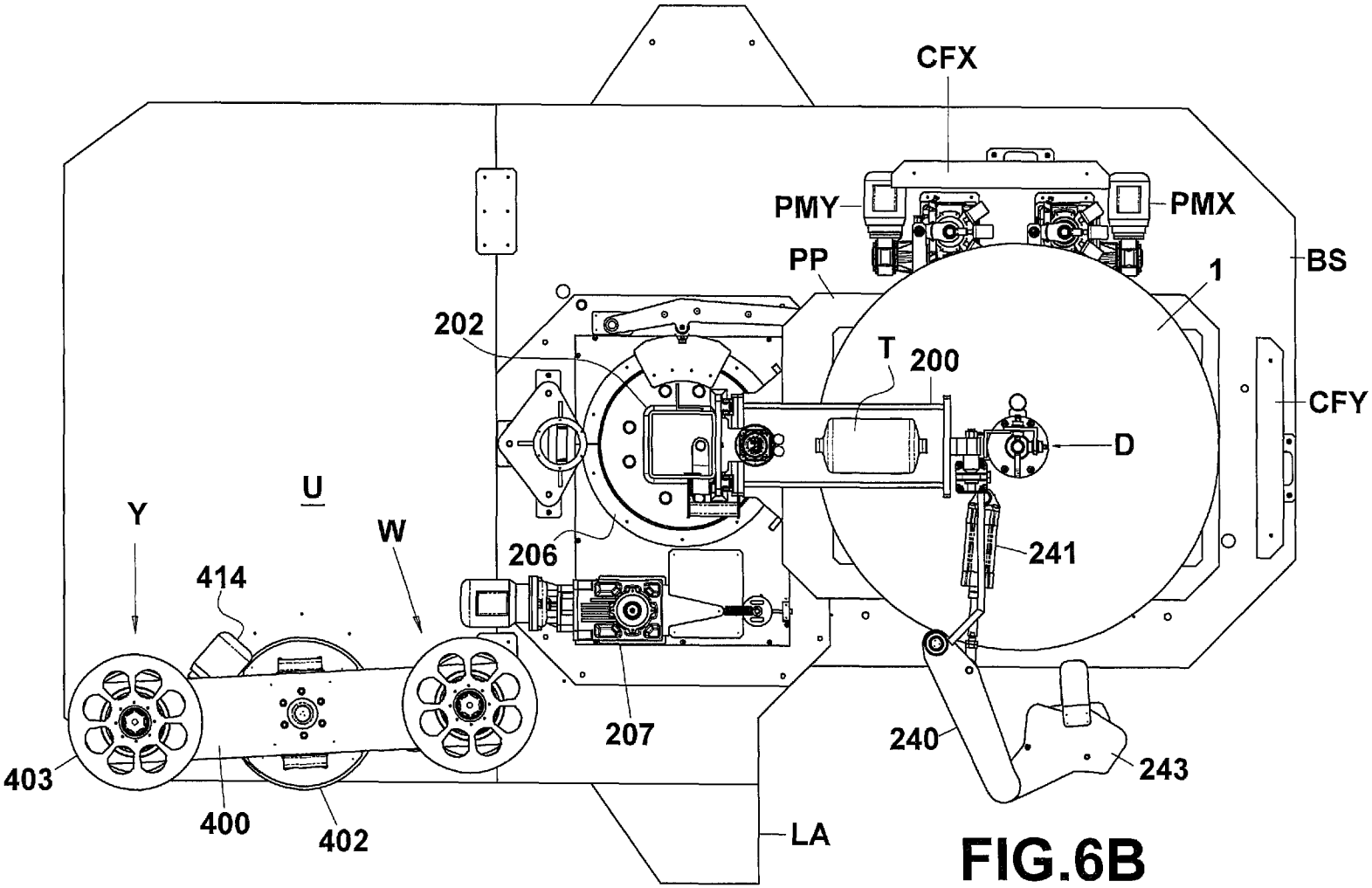
Figure 7A:
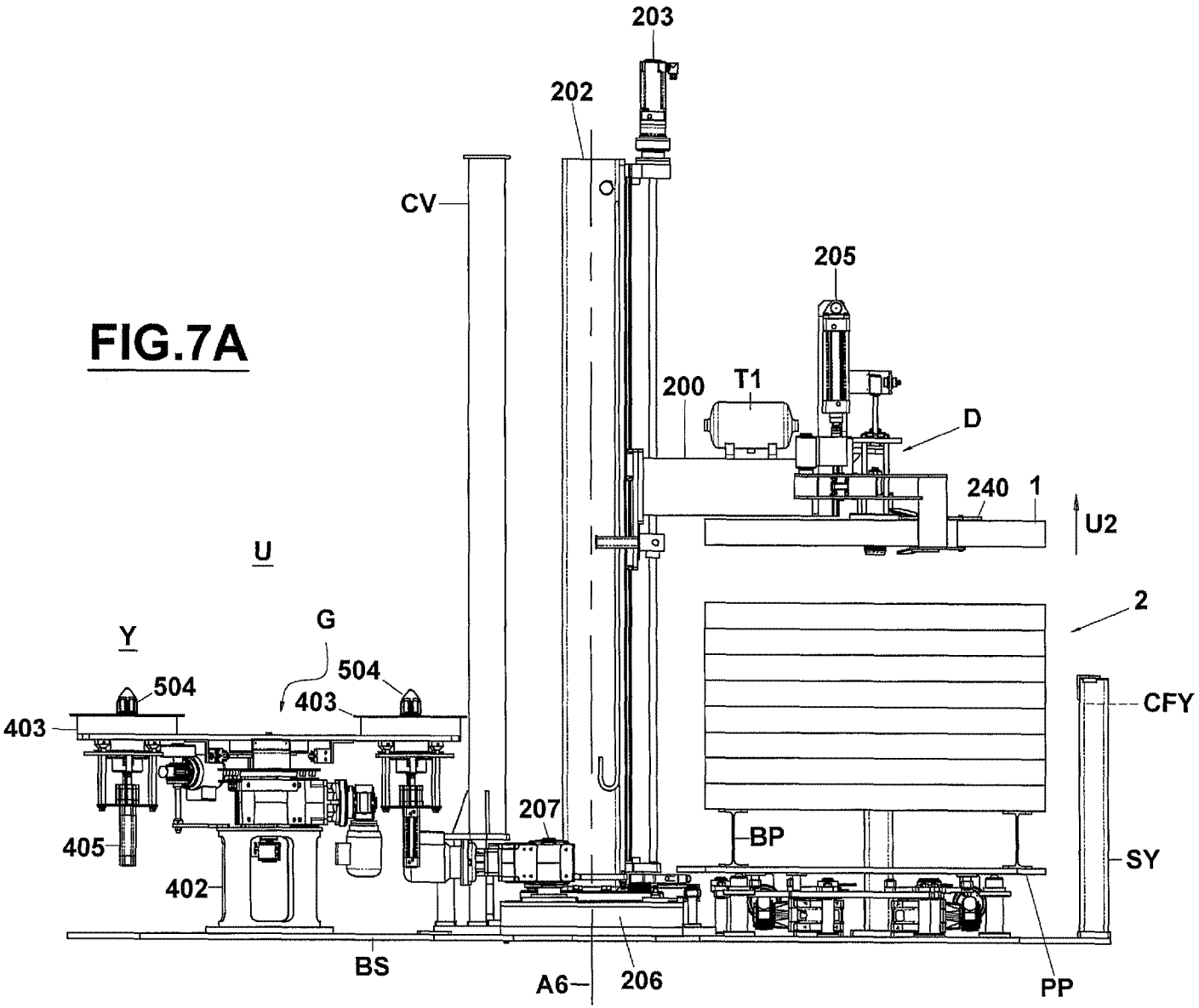
Figure 7B:
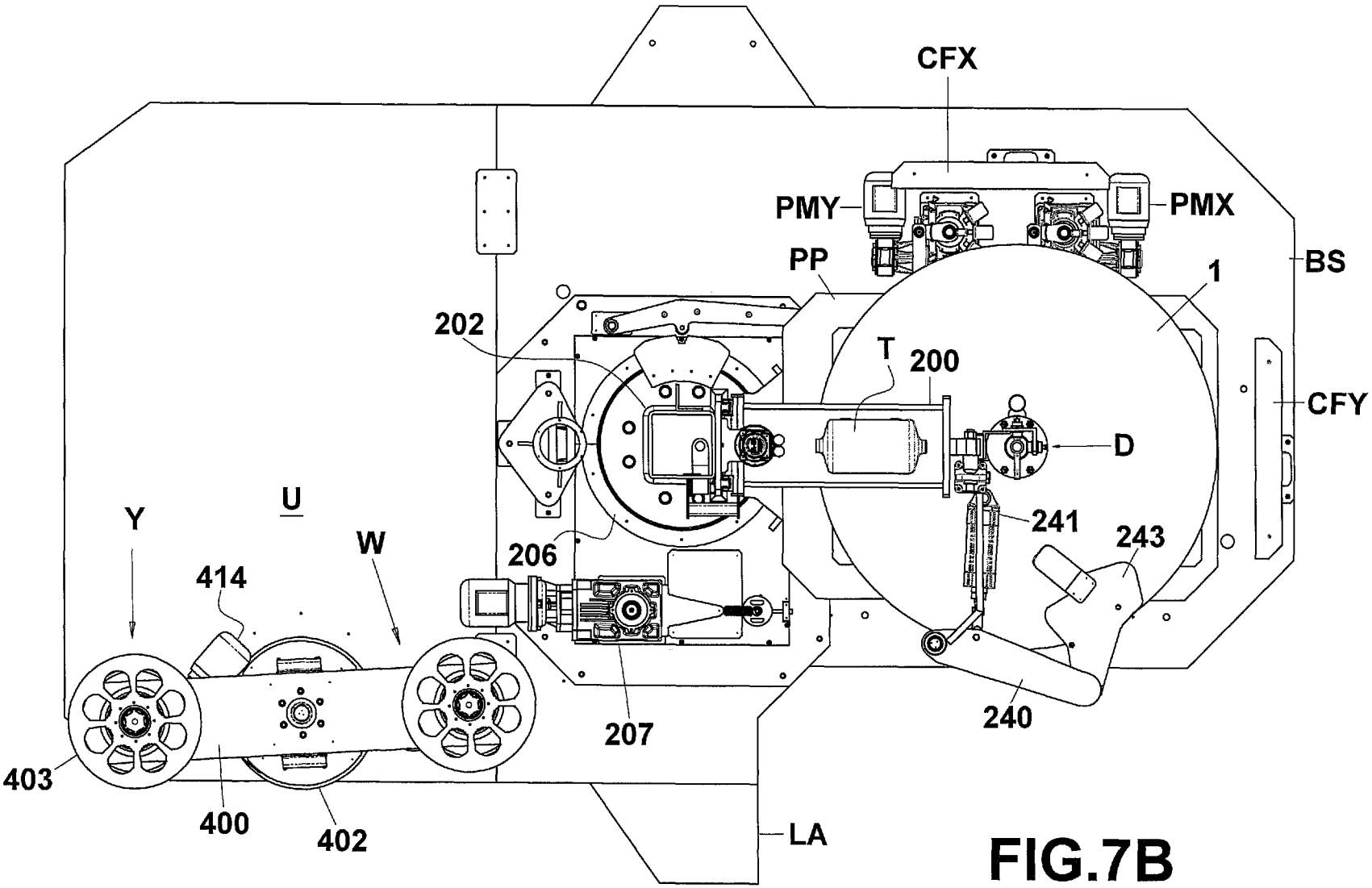
Figure 8A:
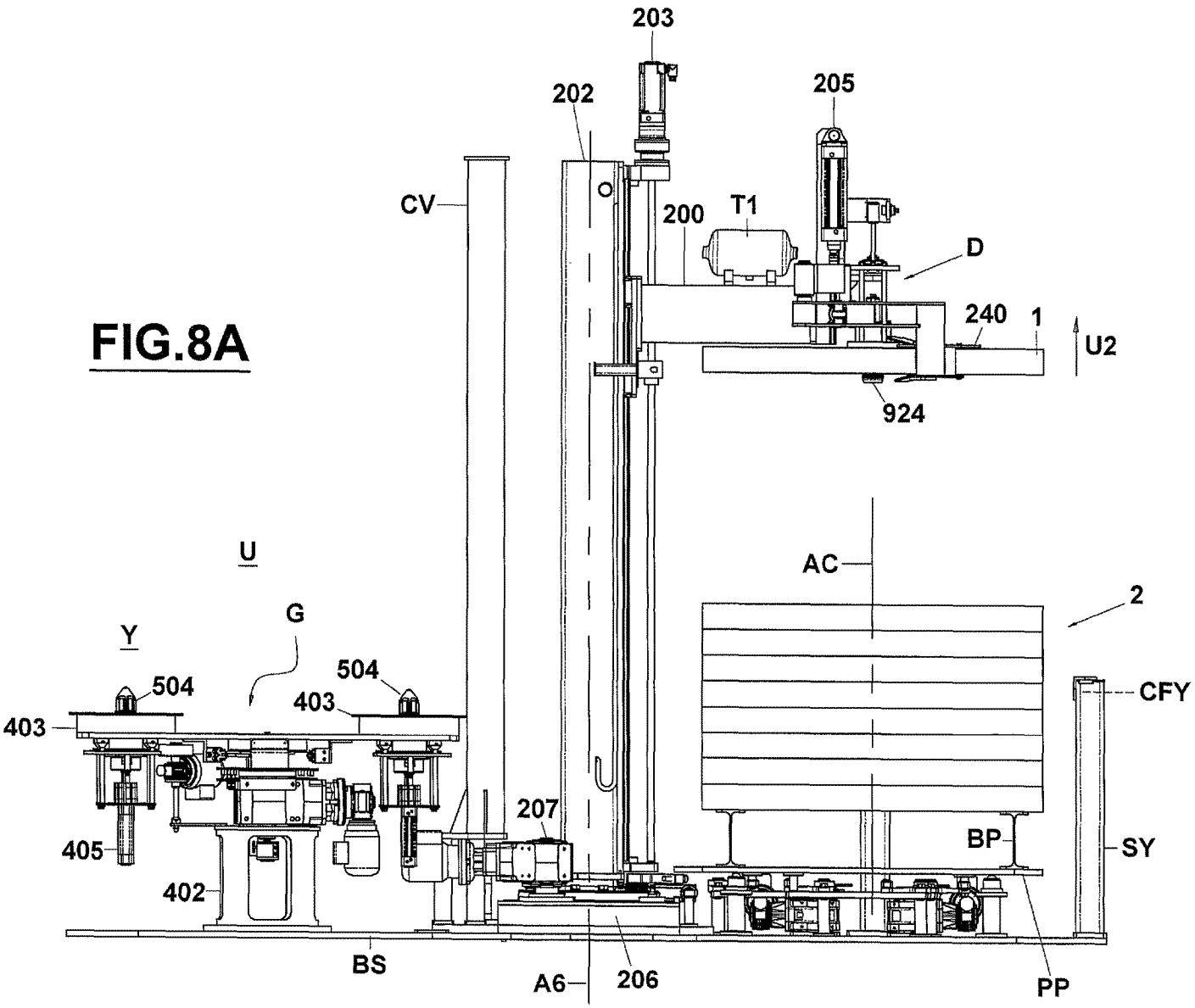
Figure 8B:
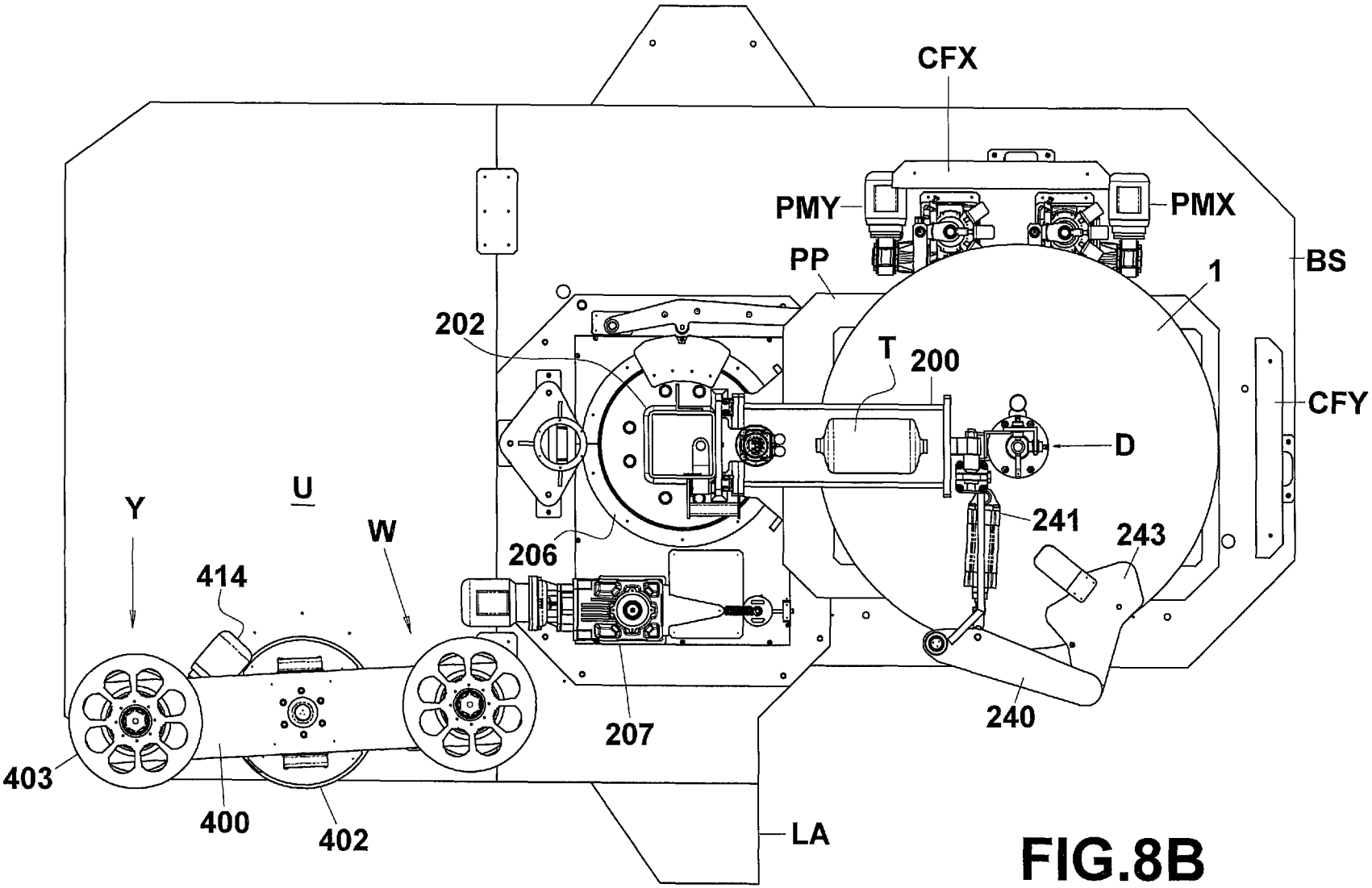
Figure 9A:
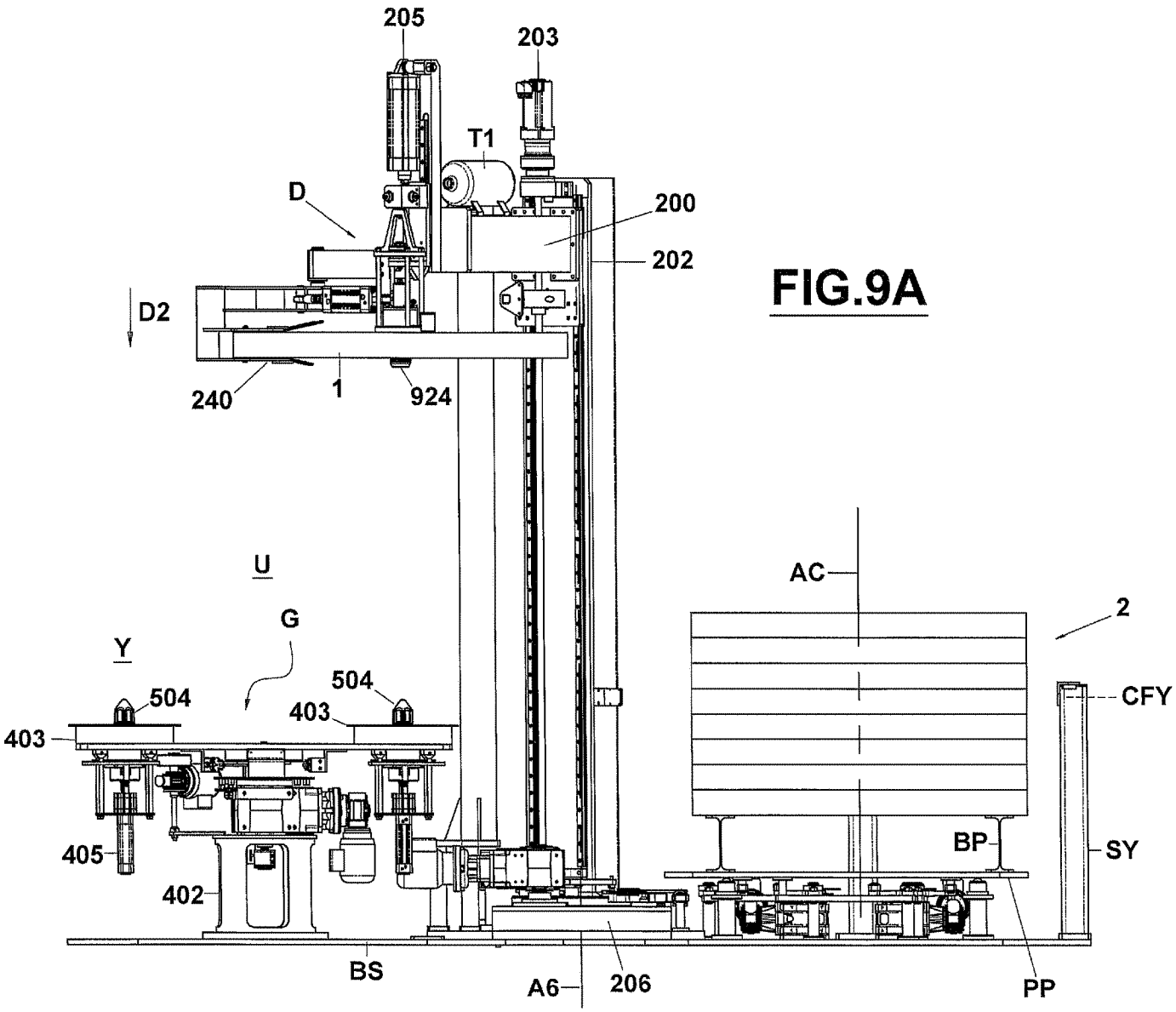
Figure 9B:
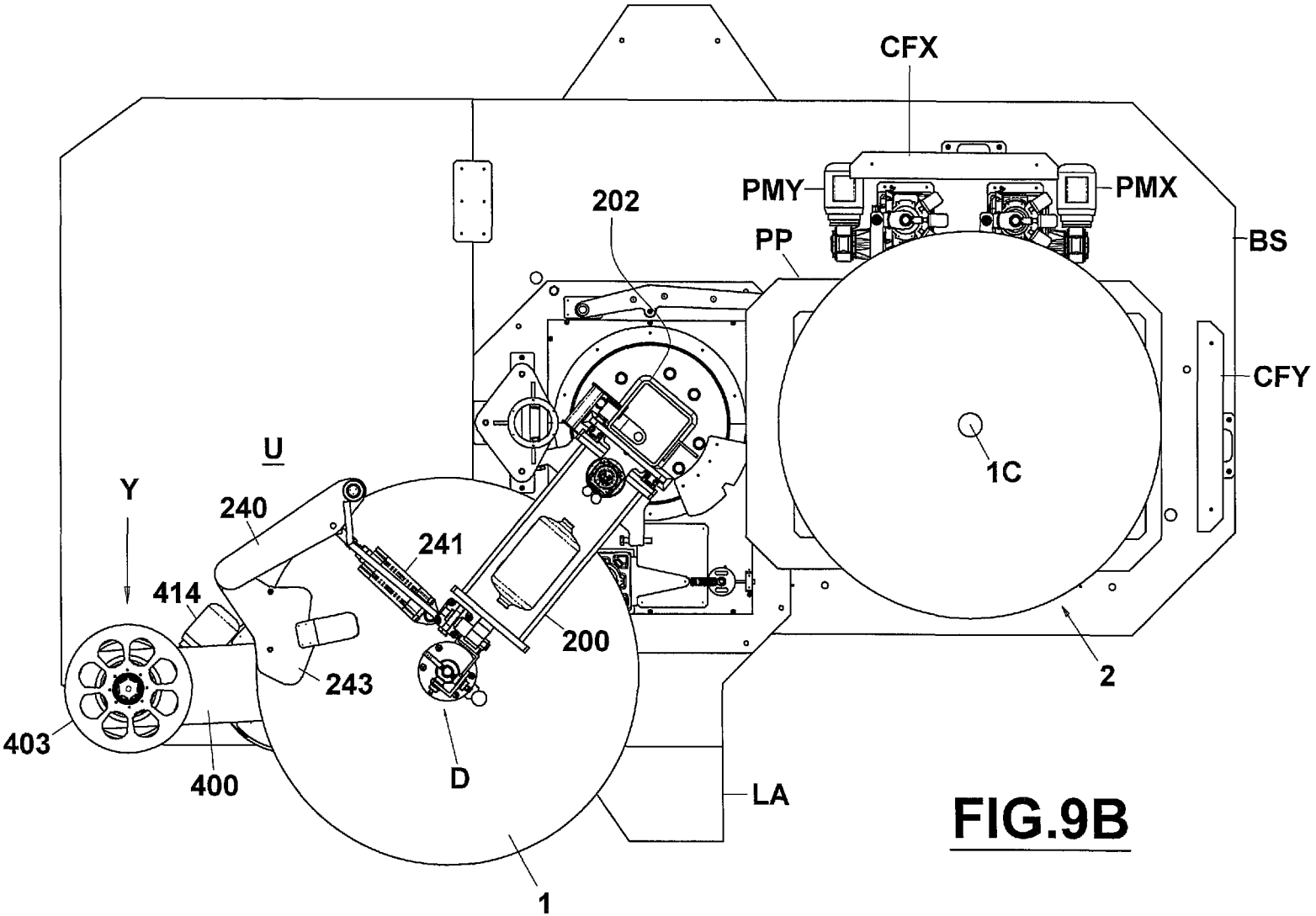
Figure 10A:
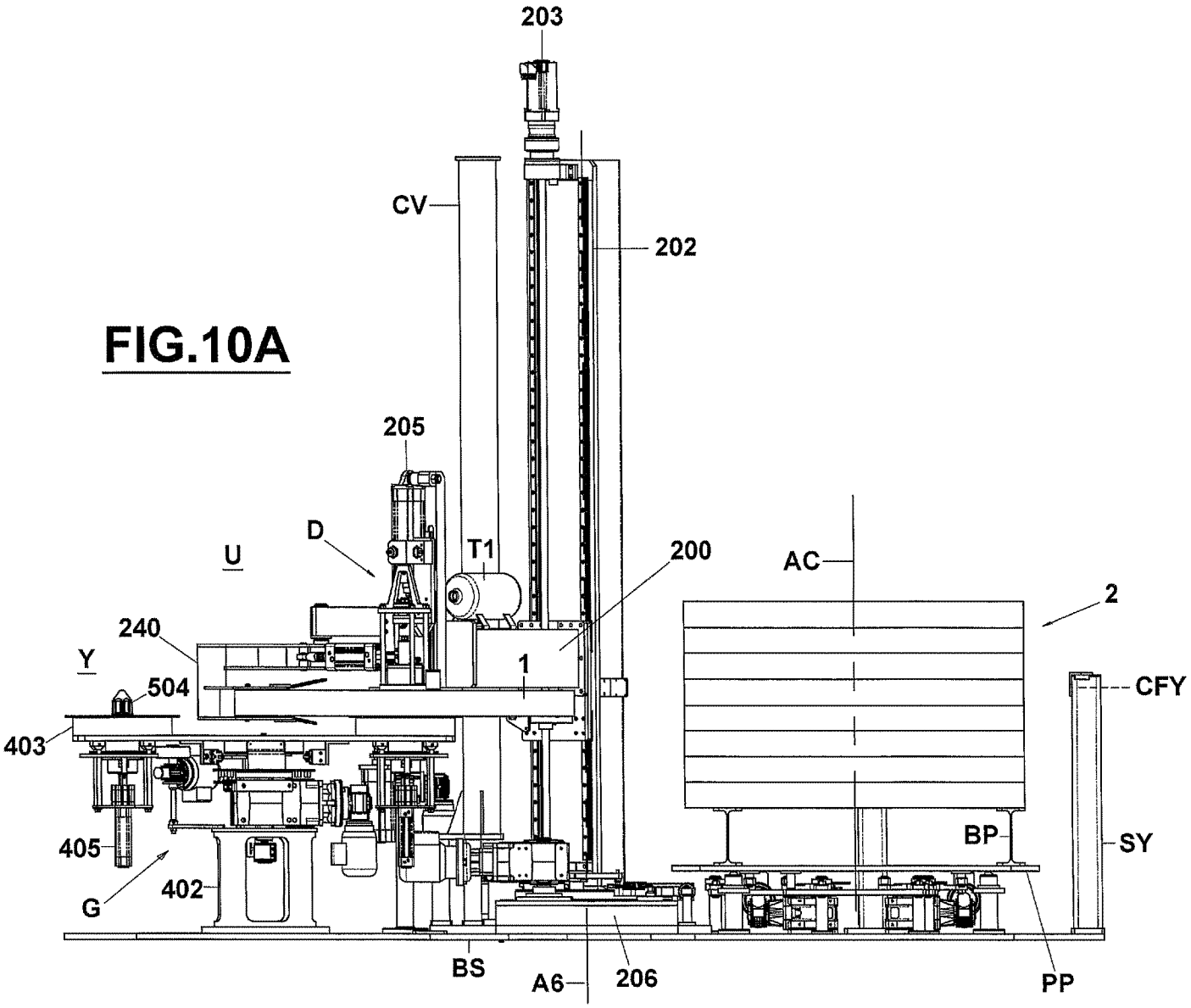
Figure 10B:
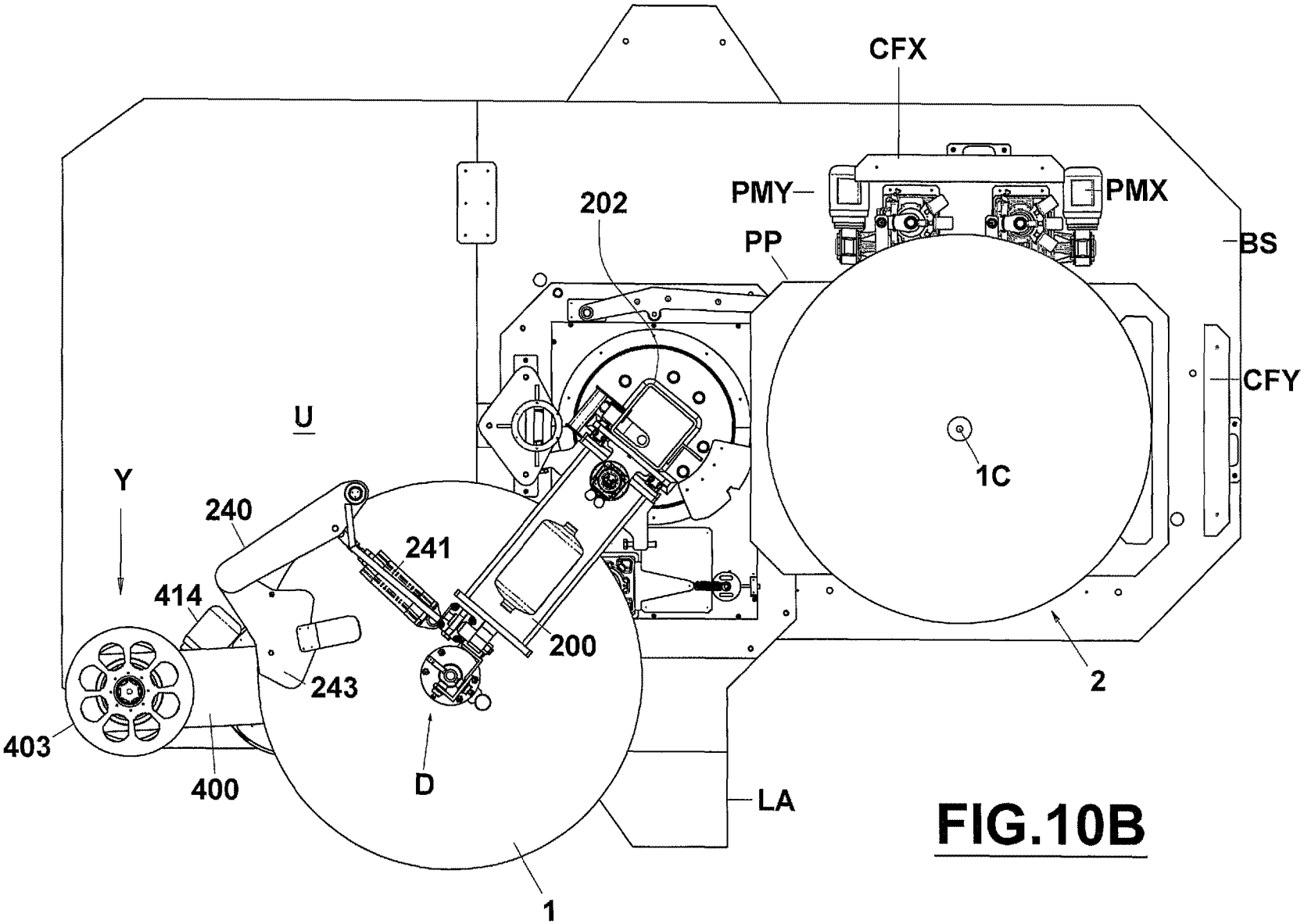
Figure 11A:
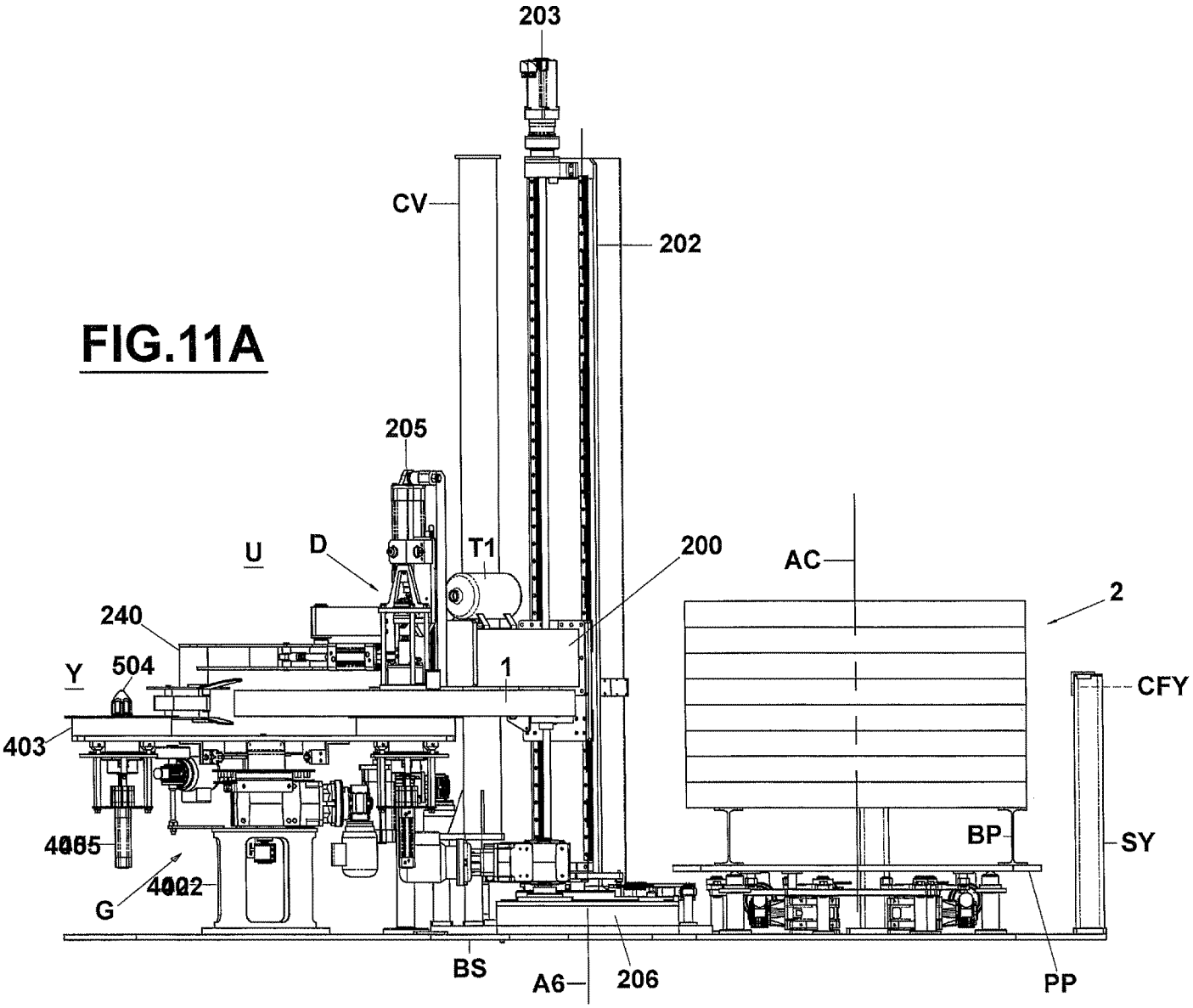
Figure 11B:
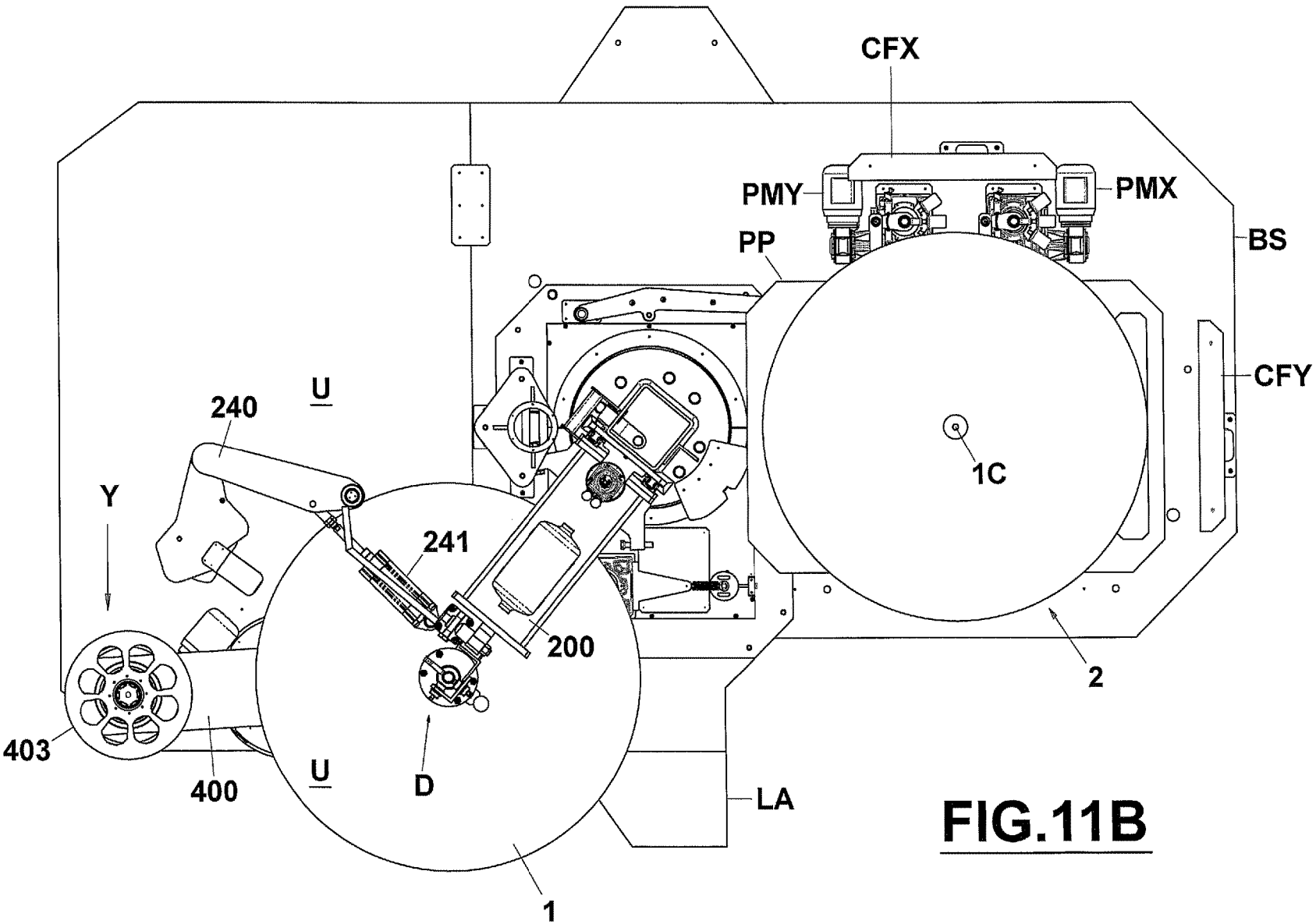

The device (D) described above can be mounted on a handling arm (200) which allows it to be moved to and from the stack (2) set up in the reel loading station (P) (1) as indicated by the double arrow "M" in FIG. 4A. The reference "AC" indicates the axis of the reels (1). The arm (200) is provided with a carriage (201) sliding on a column (202). The carriage (201) is connected to an electric motor (203), arranged on the column (202), by means of a screw-nut screw connection (W). The electric motor (203) controls the movement of the arm (200) to and from the stack (2). The length of the arm (200) is selected in such a way that the device (D) is moved to and from the stack (2) along the aforementioned axis (AC). The column (202) is mounted on a revolving base (206) whose rotation is controlled by a corresponding electric motor (207). The rotation axis of the swivel base (206) is indicated by the reference "A6". Therefore, the arm (200) can be moved along the direction indicated by the double arrow "M", parallel to the column (202), and can be rotated around the axis (A6) of the rotating base (206). By coordinating these movements, the arm (200) can therefore travel along a predetermined trajectory, in particular a transport trajectory of the reels from the loading point (P) to the unwinding station (U).

Preferably, the arm (200) carries, on its side opposite to the side attached to the carriage (201), a vertical guide (G2) on which a secondary carriage (204) slides, operated by a corresponding pneumatic actuator (205) which, in turn, is bound to said guide (G2). In this embodiment, the device (D) for moving the cores is supported by the secondary carriage (204): the first carriage (201) moves the arm (200) towards the stack (2) for a section of predetermined length and subsequently the second carriage (204) operated by the actuator (205) intervenes and moves the device (D) until it comes into contact with the highest reel of the stack (2). The contact of the device (D) with the highest reel of the stack (2) is detected by a proximity sensor (SD) mounted on the bottom of the device (D). Preferably, a tank (T1) is mounted on the arm (200) in which compressed air is stored to feed the pneumatic actuator (205) and always make the compressed air readily available that can be used to pressurize the space (S) previously mentioned. Furthermore, preferably, the device (D) for moving the reels is connected to the secondary carriage (204) by means of a bracket (S8) connected to the flange (802) of the device (D) by means of a spherical joint (J1). In this way, the device (D) is connected to the secondary carriage (204) and to the first carriage (201), so it can be moved vertically according to the direction indicated by the double arrow "M", but is free to swing around the joint (J1). Said oscillation can occur if the reels of the underlying stack are not correctly centered in relation to the device (D)—so when lowering the latter towards the stack (2) the lower part of the same device (D) does not immediately enter the core (1C) of the upper reel of the stack and can be detected by a suitable oscillation detection mechanism. For example, the device oscillation detection mechanism (D) can consist of a pin (PD) projecting centrally from the upper flange (802) of the same device (D) and two photocells (FX, FY) oriented with the respective optical axes orthogonal to each other and supported by a bracket (BD) fixed to the secondary carriage at a predetermined distance from the flange (802). The pin (PD) is connected to the flange (802) by means of two stems (GP) fixed on the upper side of the same flange (802). The optical axes of the photocells (FX, FY) intercept the pin (PD). In practice, if the device (D) is perfectly vertical, the photocells (FX, FY) each detect a predetermined reference distance from the pin (PD), while if the device (D) is inclined the said photocells detect a variation with respect to the reference distance. Said variation is assumed to be indicative of the inclination of the device (D) with respect to the vertical. The detections of the photocells (FX, FY), i.e. the detections of the mechanism for detecting the inclination of the device (D) with respect to the vertical, can be used to control the position of the platform (PP) as further described below.

The core surface engagement mechanism (1C) can be omitted.

Figure 27:
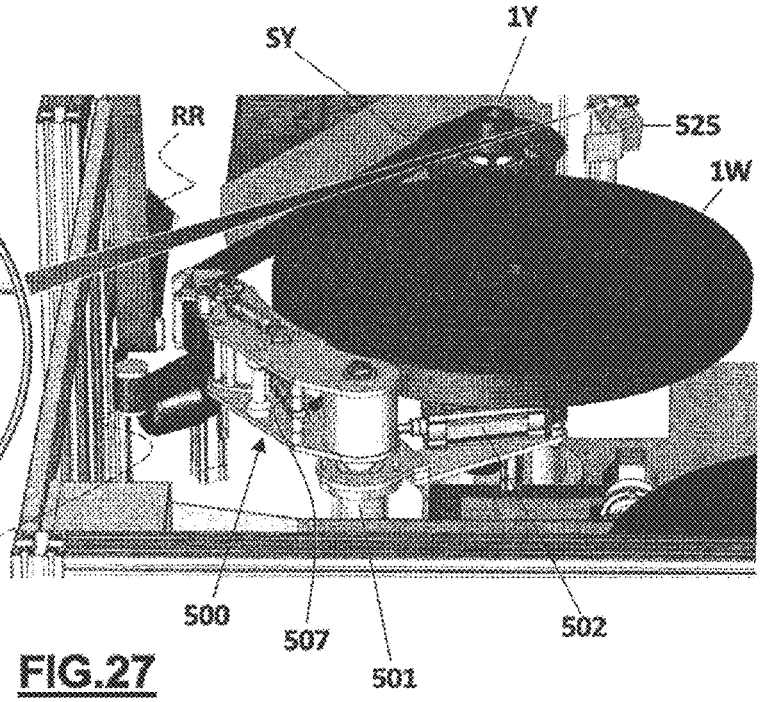
Figure 28:
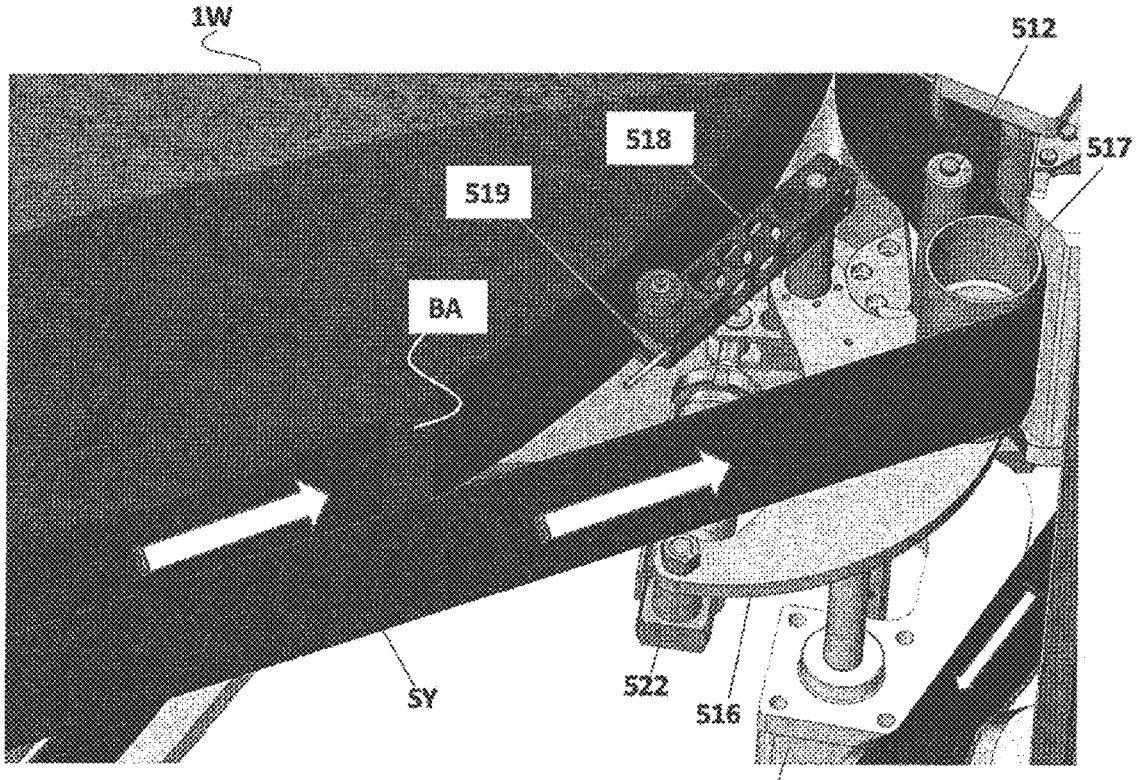
Figure 29:
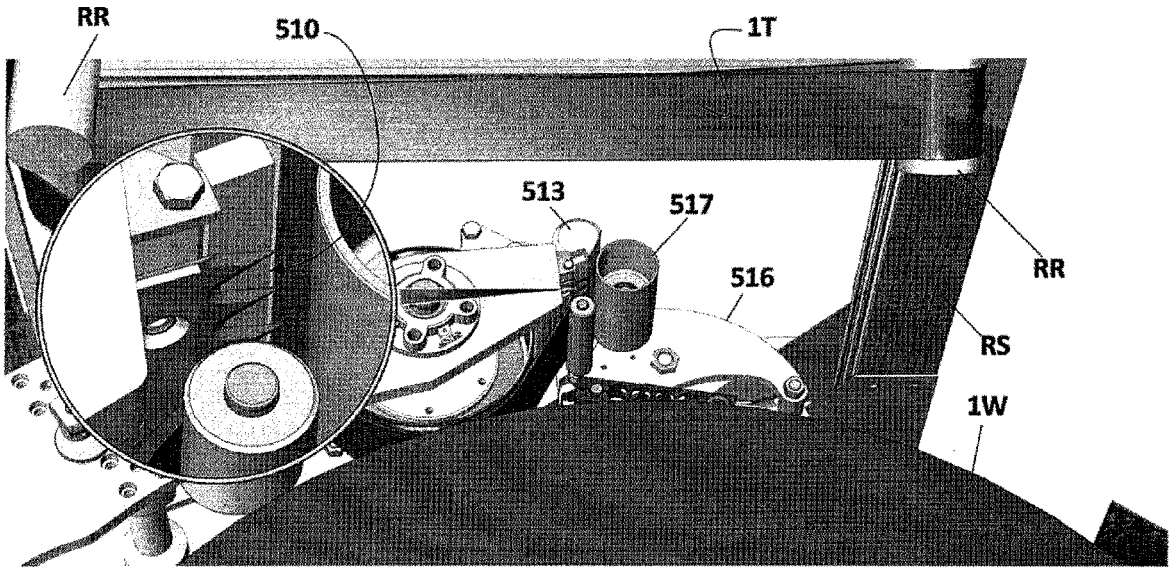
Figure 30:
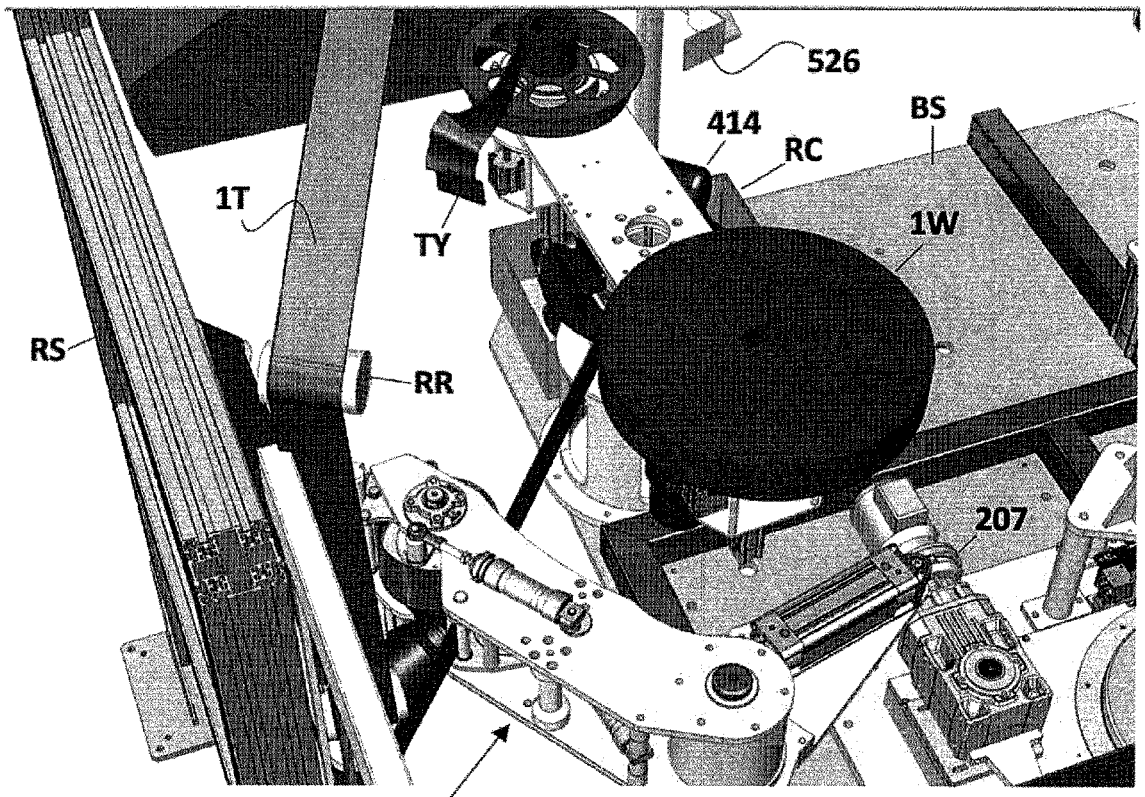
Figure 31:
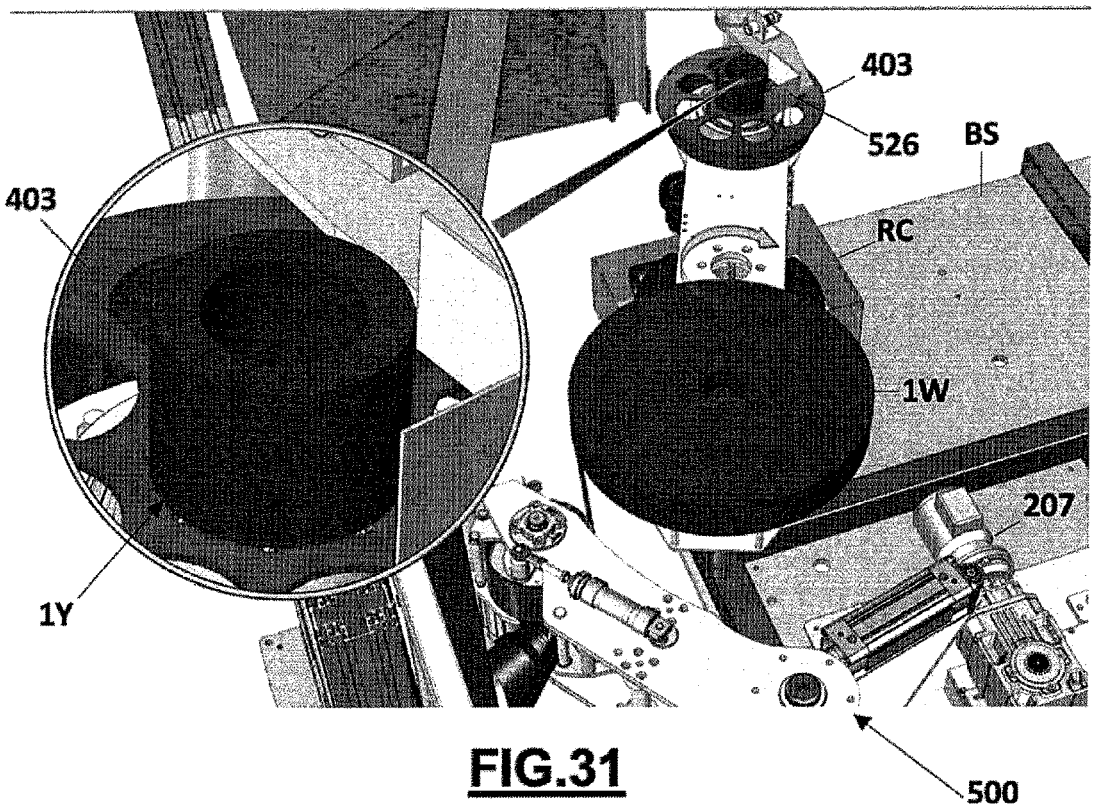
Figure 32:
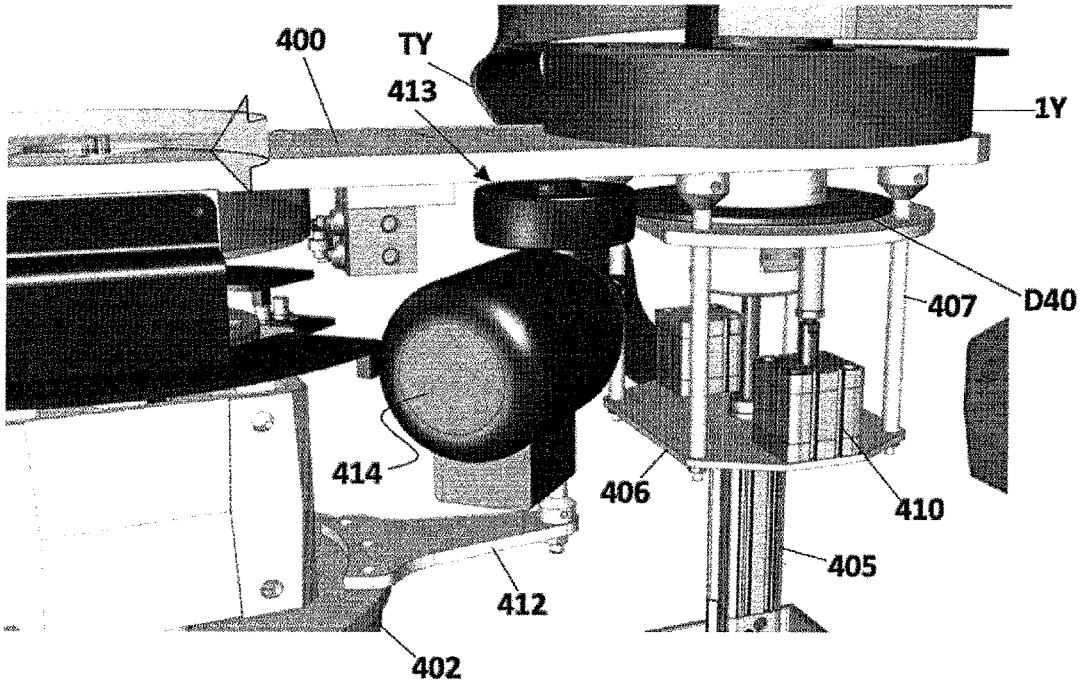

FIG. 27 shows a further embodiment of the invention, in which the device (D) is equipped with a suction cup (300) to engage the upper face (10) of the upper reel of the stack (2) instead of engaging its core (1C) as in the example previously described. The suction cup (300) is formed by a discoidal extension of the body (8) equipped with sealing gaskets (301) formed on the lower side of the same extension. An aspirator (302) is mounted on the upper side of the suction cup (300) to produce a vacuum in the space that forms between the reel (1) and the suction cup (300).

The device described above, if it also includes the core engagement mechanism (1C), can be used as follows.

By means of the arm (200) the box-like body (8) with its lower base (81) is placed in contact with the upper base of the reel (1) which is higher than the stack (2). In this condition, the upper plate (91) is inside the core (1C) of the reel (1) with which said base (81) is in contact, while the plate (92) is inside the core (1C) of the underlying reel. In fact, the distance (k) between the plates (91, 92) is such that, once the base (81) is placed against the upper face of the reel (1) higher than the stack (2), the plates (91, 92) are one inside this reel and the other inside the underlying reel. In this phase, compressed air is introduced through the inlet (83), for which the levers (100) are set back, means closer to the bushing (104). At this point, compressed air is blown through the internal duct (4). This determines the movement of the movable lower flange (912) of the plate (91) towards the respective fixed flange (911) and, at the same time, the movement of the upper movable flange (922) of the plate (92) towards the respective fixed flange (921). Consequently, the gaskets (913, 923) are compressed and expand adhering to the internal surface of the cores (1C) of the highest reel of the stack (2) and of the reel below it. In this way, a space (S) substantially impermeable to air is formed between the plates (91, 92). Then, compressed air is introduced through the external duct (5) which flows into the aforementioned space (S) and escapes at the interface between the lower base of the reel in which the plate (91) is inserted and the upper base of the reel in which the plate (92) is inserted. Therefore, a pressure is produced in the space (S) between the plates (91) and (92) which determines the detachment of the upper reel from the lower reel. Subsequently, the injection of compressed air into the internal duct (4), into the external duct (5) and through the inlet (83) is interrupted. With the interruption of the compressed air in the duct (4) the movable flanges of the plates (91, 92) return to their initial positions and the gaskets (913, 923) also return to their initial condition of non-contact with the cores (1C). In this phase, the supply of compressed air to the duct (5) is no longer necessary because the reels have already been detached due to the pressurization of the space (S) previously operated. The interruption of the compressed air supply through the inlet (83) arranged on the box-like body (8) causes the lifting of the bushing (104), pushed upwards by the elastic member (106), and therefore the rotation of the levers (100) on the pins (103), whereby the toothed sectors (101) of the same levers (100) move away from the bushing (104) and engage the inner surface of the core (1C) of the upper reel of the stack (2). In this condition, the top reel (1) of the stack (2) is engaged by the arm (800) through the engagement mechanism which, in the example described above, is the mechanism comprising the levers (100). The arm (200) can then be led to an unwinder (30) with the reel (1) hooked to it. The release of the reel will be determined by a new introduction of compressed air through the inlet (83) which will cause the levers (100) to approach the bushing (104) and therefore the disengagement of the toothed sector of the same levers from the internal surface of the relative core (1C).

With reference to the example of the embodiment shown in FIG. 27, in which the mechanism for engaging the cores (1C) is not provided, but the suction cup (300) is arranged, the pressurization phase of the aforementioned space (S) and detachment of the top reel of the stack from the underlying reel is done as described above. In this case, the picking up of the upper reel, that is its removal from the stack (2), takes place due to the effect of the suction cup (300) which binds the reel itself to the device (D), and therefore to the arm (200), acting on the upper side of the reel instead of acting on the respective core (1C) as in the previous example.

In the drawings, the lifting of the arm (200) is indicated by the arrow "U2" while the lowering of the same arm is indicated by the arrow "D2".

In accordance with a preferential embodiment of the present invention, the platform (PP) is a horizontal platform configured to be moved parallel to itself, that is along two mutually orthogonal directions (x, y) in the plane of the same platform, and is connected to respective handling means (PMX, PMY) which allow to move it along said directions (x, y) in order to center the reels (1) with respect to the manipulator arm (200). The means (PMX, PMY) for moving the platform (PP) consist, for example, of two gearmotors. These gearmotors can be connected to the lower surface of the platform (PP) by means of corresponding lever mechanism (LX, LY) fixed to the lower surface of the platform (PP) through respective connection flanges (CX, CY). The platform (PP) preferably rests on four columns (CP) that keep it at a distance from the base (BS) of the system. Between each column (CP) and the platform (PP) there is a sphere (SF) which favors the movement of the platform on the columns (CP) along the aforementioned directions (x, y).

Preferably, two beams (BP) are mounted on the upper face of the platform (PP) on which the stack (2) is placed, so that between the stack itself and the upper face of the platform (PP) there is a space of predetermined height. Preferably, said beams (BP) are arranged parallel to each other.

If the stack (2) arranged on the platform (PP) is not centered with respect to the reel handling device (D), for example following the detection of an inclination of the device (D) that exceeds a predetermined limit value, the platform (PP) can be moved along the direction (x) and/or along the direction (y) until the stack (2) is correctly centered with respect to the device (D). For this purpose, the gearmotors (PMX, PMY) are preferably controlled by a programmable control unit (CU) which receives signals from the aforementioned photocells (FX, FY) and operates the same gearmotors according to the signals emitted by the photocells, thereby controlling the movement of the platform (PP) in the plane defined by the directions (x, y) as previously mentioned, that is, by adjusting the position of the platform (PP) in such a way as to determine the correct centering of the stack (2) with respect to the device (D).

Preferably, on the secondary carriage (204) is mounted a movable arm (240) controlled by a corresponding pneumatic actuator (241) constrained to the same carriage (204). Said arm (240) is connected to one side of the secondary carriage (204) by means of a vertical axis hinge (242) and has, on the opposite side, a fork (243) formed by two horizontal plates spaced apart by a corresponding value at the height of the individual reels (1). The actuator (241) controls the rotation of the arm (240) around the axis of the hinge (242). Once a reel (1) has been engaged by the movement device (D) and detached from the underlying reel as described above, the arm (240) is made to rotate, starting from a spaced position, towards the reel engaged by the movement control device (D) in such a way that the plates of the fork (243) are one below and one above the same reel. In this way, the risk of falling of the reel (1) moved by the handling device (D) is reduced. In other words, the arm (240) constitutes a safety device that holds the reel (1) while the latter is being moved. After positioning the reel (1) in the unwinding station (U), the arm (240) is brought back to its initial position distanced from the device (D) by disengaging the reel (1). Preferably, an elastic appendix (244) is mounted on a front part of each plate of the fork (243) which forms an invitation to the entry of the reel (1) between the same plates when the arm (240) is approached to the device (D).

Preferably, the aforementioned gearmotors (PMX, PMY) are also controllable, by means of the programmable control unit (CU), by means for controlling an initial position of the platform (PP) to ensure that the axis (AC) of the reels (1) that form the stack (2) is aligned with the central axis (A9) of the handling device (D) arranged in the position for picking up a reel.

Figure 2A:
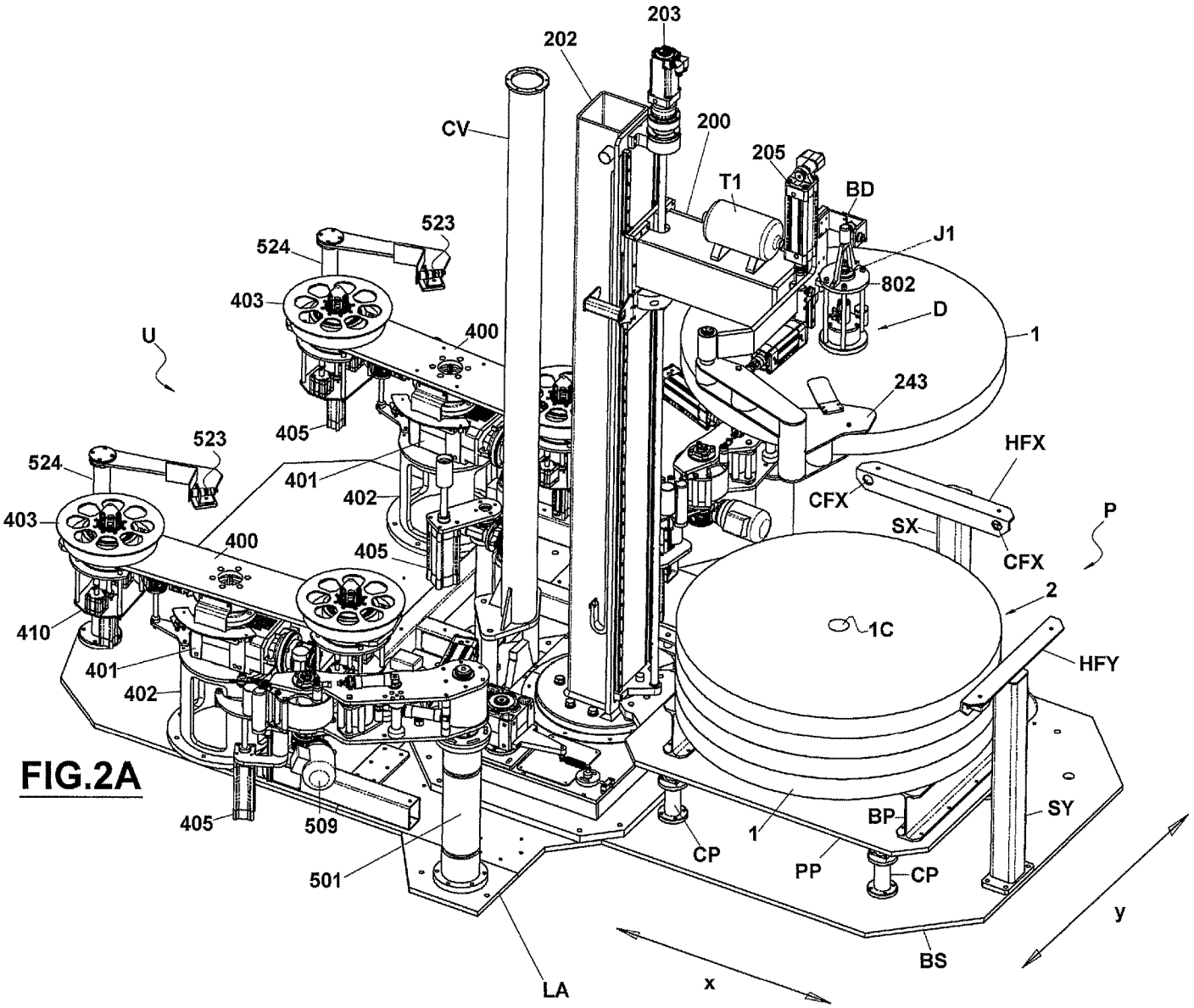
Figure 2C:
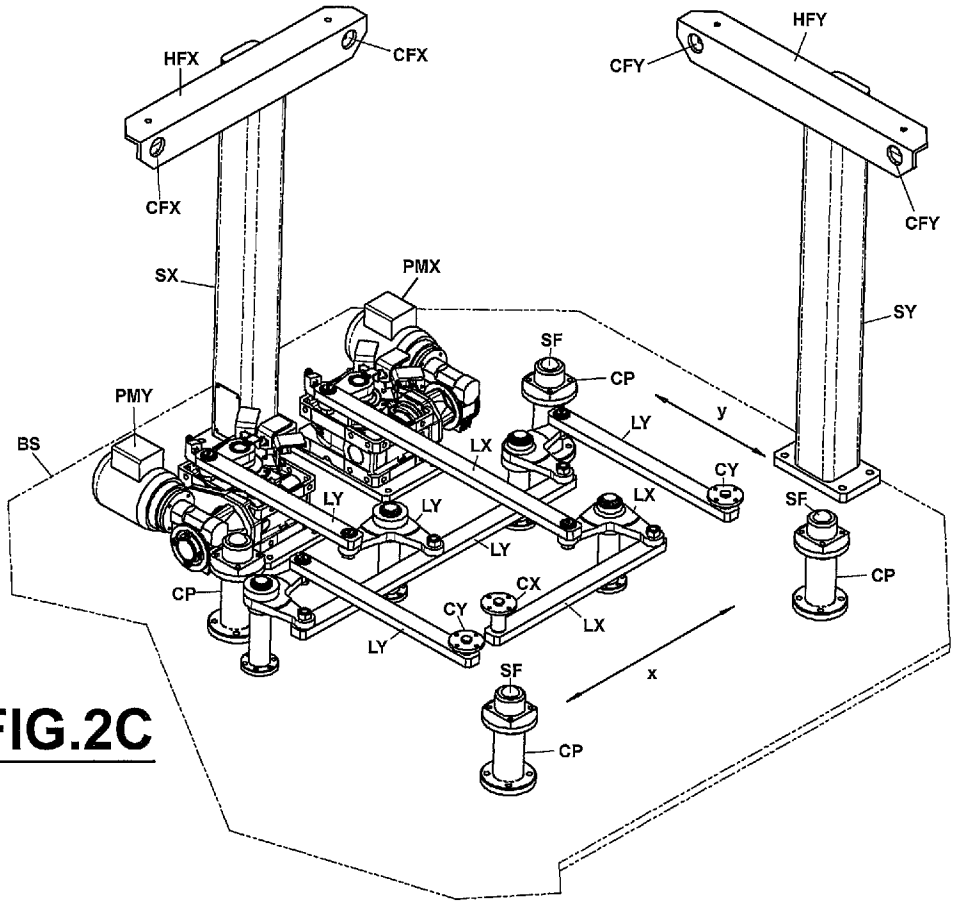
FIG. 2C is a detail of FIG. 2A with parts not shown to highlight a possible configuration of the movement system of the reel support platform.
Figure 2B:
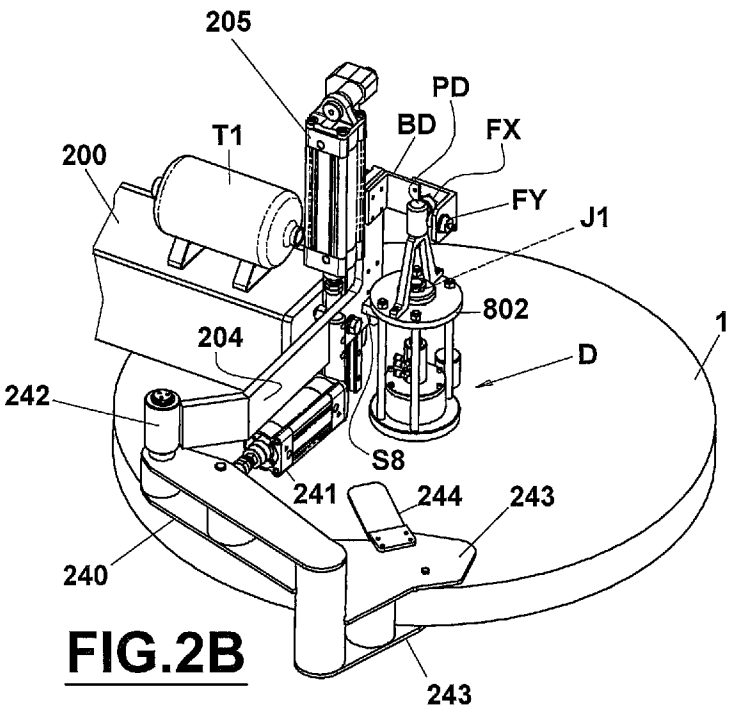
Figure 2E:
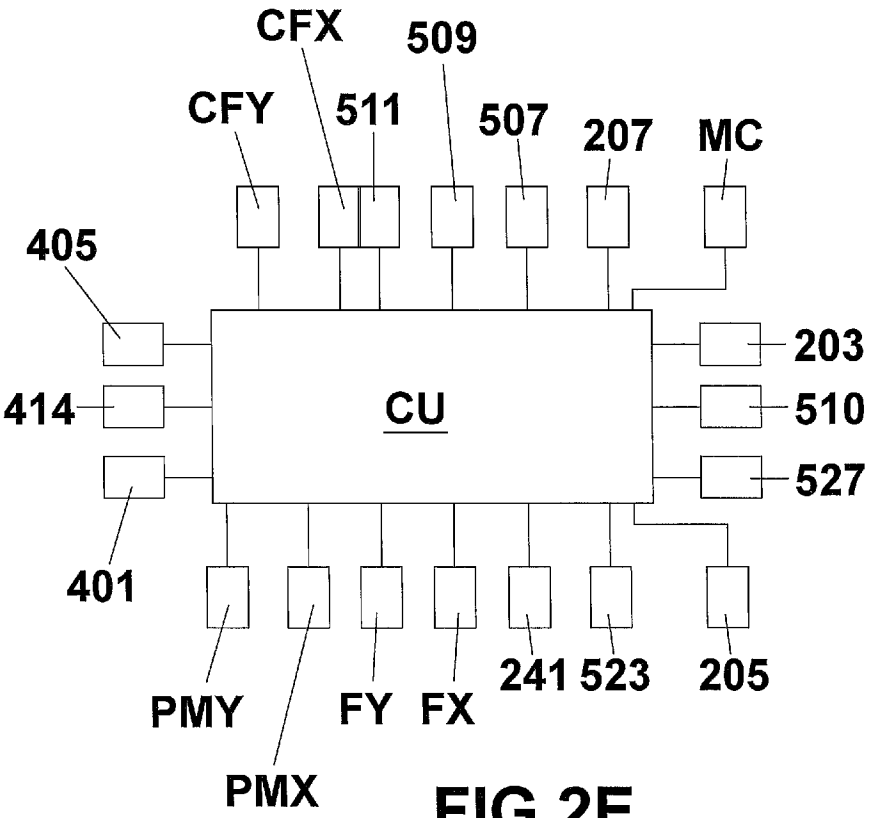
FIG. 2E is a simplified block diagram relating to a possible embodiment of a control system of a plant in accordance with the present invention.
Figure 2D:
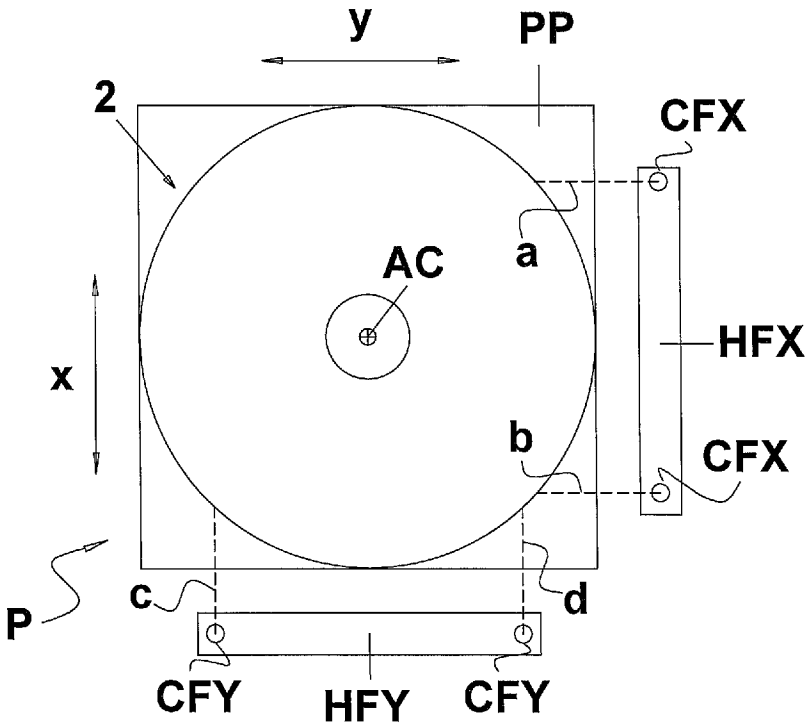
FIG. 2D is a diagram relating to a possible embodiment of a device for controlling the initial position of the support platform for the reels.
Figure 2F:
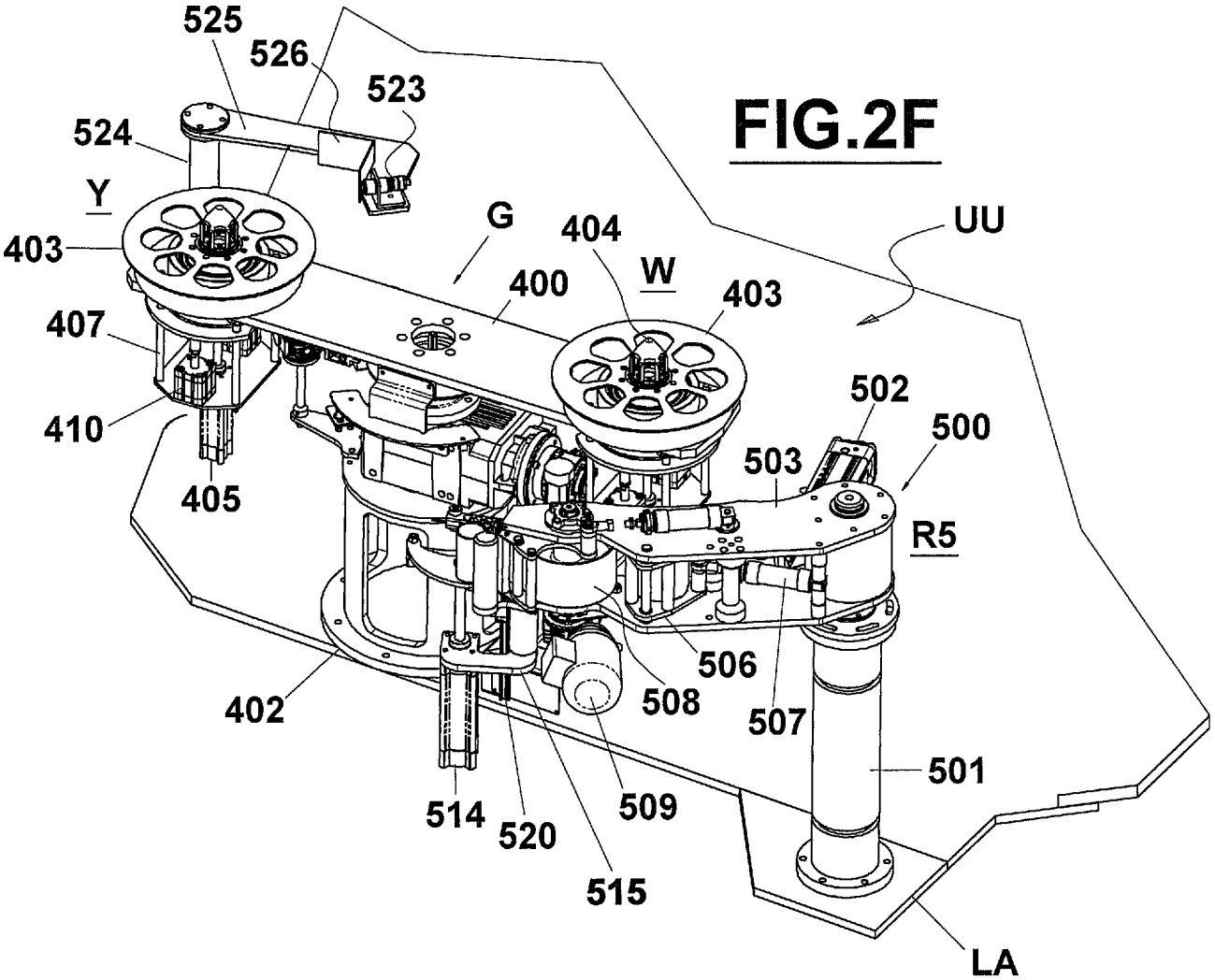
FIG. 2F is another detail of FIG. 2A with parts not shown in order to better highlight others.
Figure 2H:
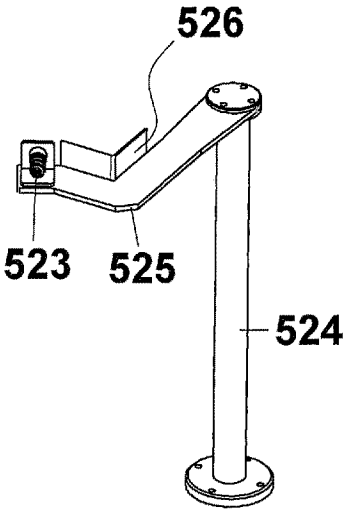
FIGS. 2G and 2H are other details of FIG. 2A with parts not shown to better highlight others.
Figure 2G:
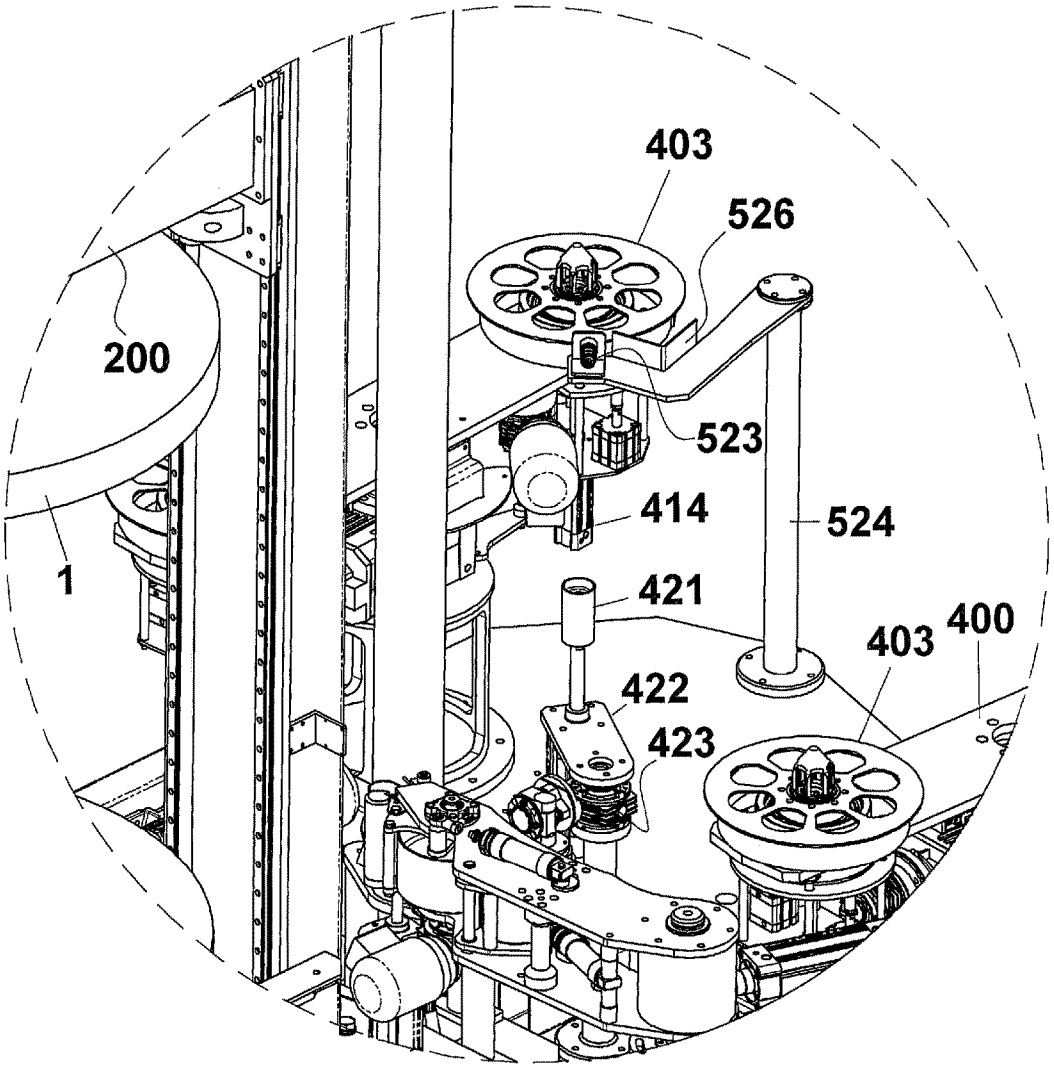

For example, with reference to the attached drawings, said means for controlling the initial position of the platform (PP) are optical control means arranged in fixed positions on two sides of the same platform. For example, these optical control means are formed by a first pair of photocells (CFX) placed on a first horizontal bar (HFX) at a predetermined height from the base (BS) of the system and a second pair of photocells (CFY) placed on a second horizontal bar (HFY) at the same height as the first pair of photocells with respect to the base (BS) of the system. The first horizontal bar (HFX) is oriented parallel to the aforesaid direction (x), while the second horizontal bar (HFY) is oriented parallel to the aforesaid direction (y), so that the photocells (CFX) of the first pair result with their respective axes optics oriented orthogonally to the optical axes of the photocells (CFY) of the second pair. The bars (HFX, HFY) are mounted on respective fixed support columns (SX, SY) each placed at a predetermined distance from the platform (PP). Preferably, the distance between the photocells (CFX) of the first pair is equal to the distance between the photocells (CFY) of the second pair. As shown in the diagram of FIG. 2D, in conditions of alignment of the axis (AC) with the axis (A9) the distances (a, b) of the photocells (CFX) from the stack (2) and the distances (c, d) of the photocells (CFY) from the same stack are equal: a=b and c=d. If, on the other hand, the axis (AC) is not in the position of alignment with the axis (A9), the spatial position of the axis (A9) being a known position, then the gearmotors (PMX, PMY) are operated until the condition of equality of the aforementioned distances (a, b) and (c, d) is fulfilled.

It is understood that the means for controlling the initial position of the platform (PP) can be configured and positioned in a different way from what is exemplified above, cooperating with the control unit (CU) to control the initial position of the platform (PP) by moving it in such a way as to align the axis (AC) with the axis (A9).

In a previous phase, the stack (2) of reels (1) is positioned on the platform (PP) by means of a forklift (MU) operated by an operator. The reels (1) are normally stacked on a pallet (P2) that can be loaded on the forks (FM) of the forklift.

When positioning the pallet on the platform (PP), the operator can be assisted by photocells (CFX, CFY). In fact, the measurements performed by these photocells can be used to send signals to a display (MC) designed to display suitable graphic indications (GM) in response to the measurements of the photocells (CFX, CFY) which guide the operator in positioning the pallet on the platform (PP).

Figure 33:
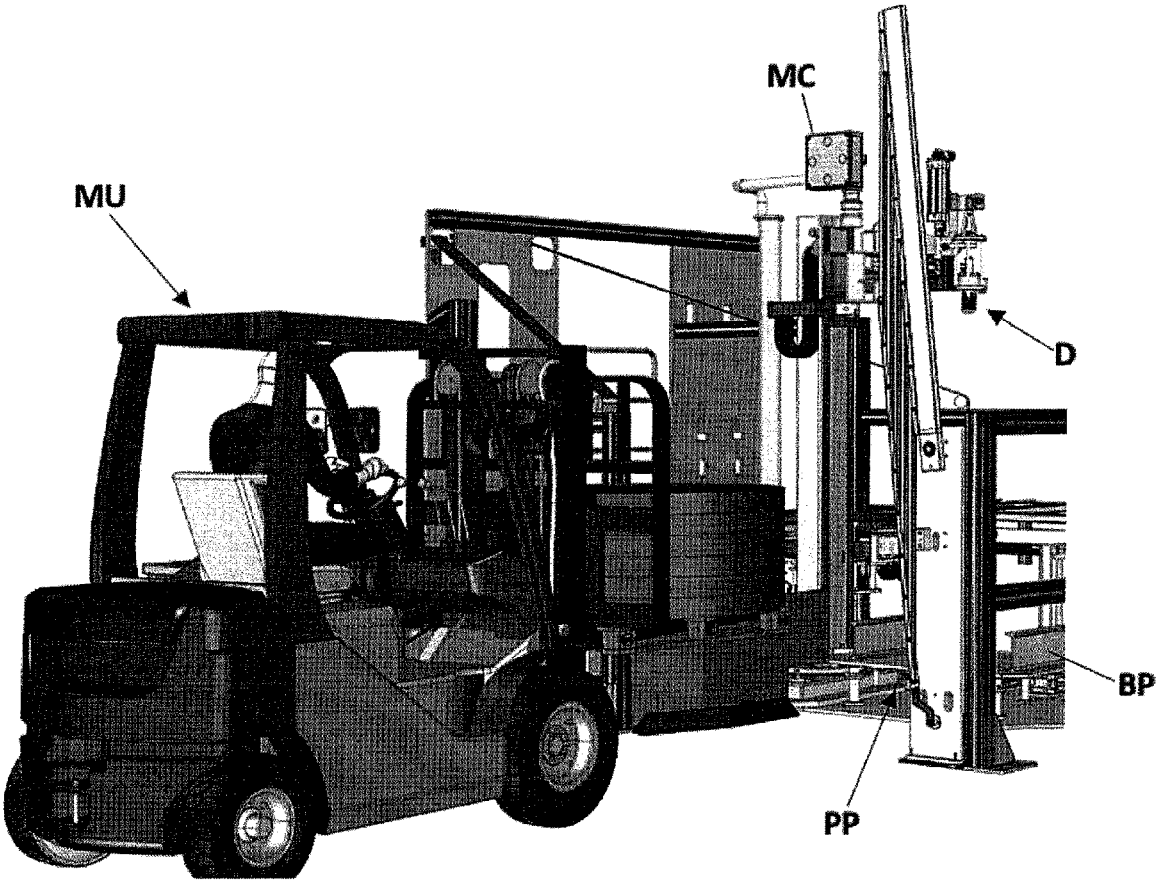
Figure 34:
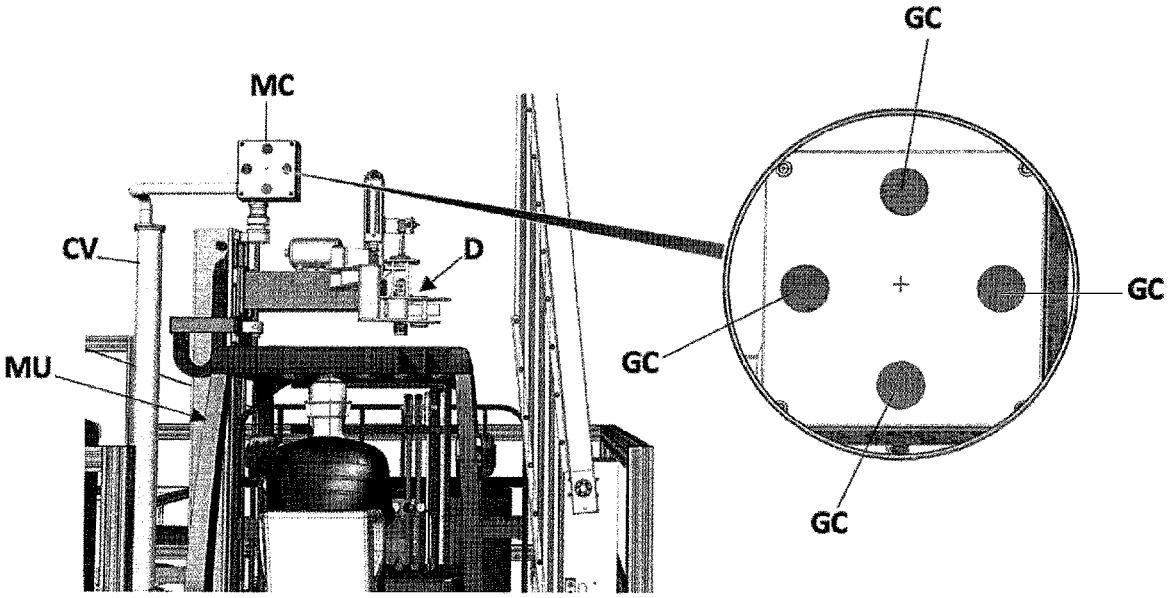

In practice, while the operator places the pallet on the platform (PP), the photocells (CFX, CFY) detect the position of the stack of reels present on the pallet with respect to the platform and send detection signals to the control unit (CU) which in turn drives the monitor (MC). Graphic indications appear on the latter (for example, red or green circles aligned according to two mutually orthogonal directions) which suggest the operator to maneuver the forklift in such a way as to center the pallet on the platform (PP), albeit not extremely precisely. In FIG. 33 and FIG. 34 the display (MC) is shown, set up at a height, with respect to the base of the system, suitable for allowing it to be viewed by the operator operating the forklift. The same figures show the graphic indications (GM) shown on the display (MC). Once the stack (2) has been placed on the beams (BP) of the platform (PP), the operator lowers the forklift forks and moves away.

Alternatively, the positioning of the stack (2) of reels on the platform (PP) can be carried out by means of a self-propelled trolley with automatic guidance of the type known per se.

At least one unwinding unit (UU) is arranged in the unwinding station (U). In accordance with the example illustrated in the attached drawings, two unwinding units (UU) are arranged side by side in the unwinding station (U), i.e. positioned at a predetermined distance from each other. In FIGS. 3 and 4B-11B only one unwinding unit (UU) is shown for simplification.

Each unwinding unit (UU) comprises a carousel structure (G) with a horizontal beam (400) enslaved to a gearmotor (401) which controls its rotation around a respective central vertical axis (AU). The gearmotor (401) is placed on a corresponding base (402) so as to keep the beam (400) at a predetermined height with respect to the base (BS) of the system. Two supports (403) are arranged on the beam (400) in diametrically opposite positions with respect to said axis (AU). For example, the supports (403) consist of horizontal plates each of which has a central through hole. Below each support (403) there is a pin with a vertical axis (404) which, being operated by a respective pneumatic actuator with a vertical axis (405) and being arranged in a central position with respect to the corresponding support (403), is free to pass through the central hole of the same support and can assume an extracted position (in which it protrudes above the support 403) and a retracted position (in which it is below the support 403). In FIGS. 12A-12E both pins (404) are extracted.

Preferably, the pin (404) has a convex upper surface to facilitate its contact with the concave surface (925) of the pick-up and handling device (D) when positioning the reels (1) on the supports (403) as further described in following. The actuator (405) of each pin (404) is constrained to the lower face of the beam (400) by means of a horizontal plate (406) which is connected to the lower face of the beam (400) through several vertical rods (407) which hold the same plate (406) at a predetermined distance from the beam (400). The ends of the rods (407) are screwed to the plate (406) on one side and to the beam (400) on the other side. The actuator (405) is constrained to the lower face of the plate (406). Above the plate (406) there is a disk (408) provided with an insert (409) of friction material. The disc (406) is provided with holes through which the aforementioned rods (407) pass. A coaxial brake disc (D40) is mounted on the hub (M40) of the support (403). On the upper face of the plate (406) are mounted two pneumatic actuators with vertical axis (410) whose stems act on the lower face of the disc (408) so that the latter can be moved, along the direction of the rods (407), from and towards the respective support (403) and then moved to and from the brake disc (D40) so that during braking the insert (409) can come into contact with the brake disc (D40). In this way, a brake is provided which acts on each support (403) as a function of the unwinding phase of the reel which is mounted thereon as further described below. In practice, each plate (406) is integral with the lower face of the beam (400), to which it is connected by means of the rods (407) which also act as guides for the movement of the disc (408) controlled by the actuators (410) mounted on the upper face of the plate (406). The supports (403) are free to rotate around their respective central axes (A4).

Figure 4B:
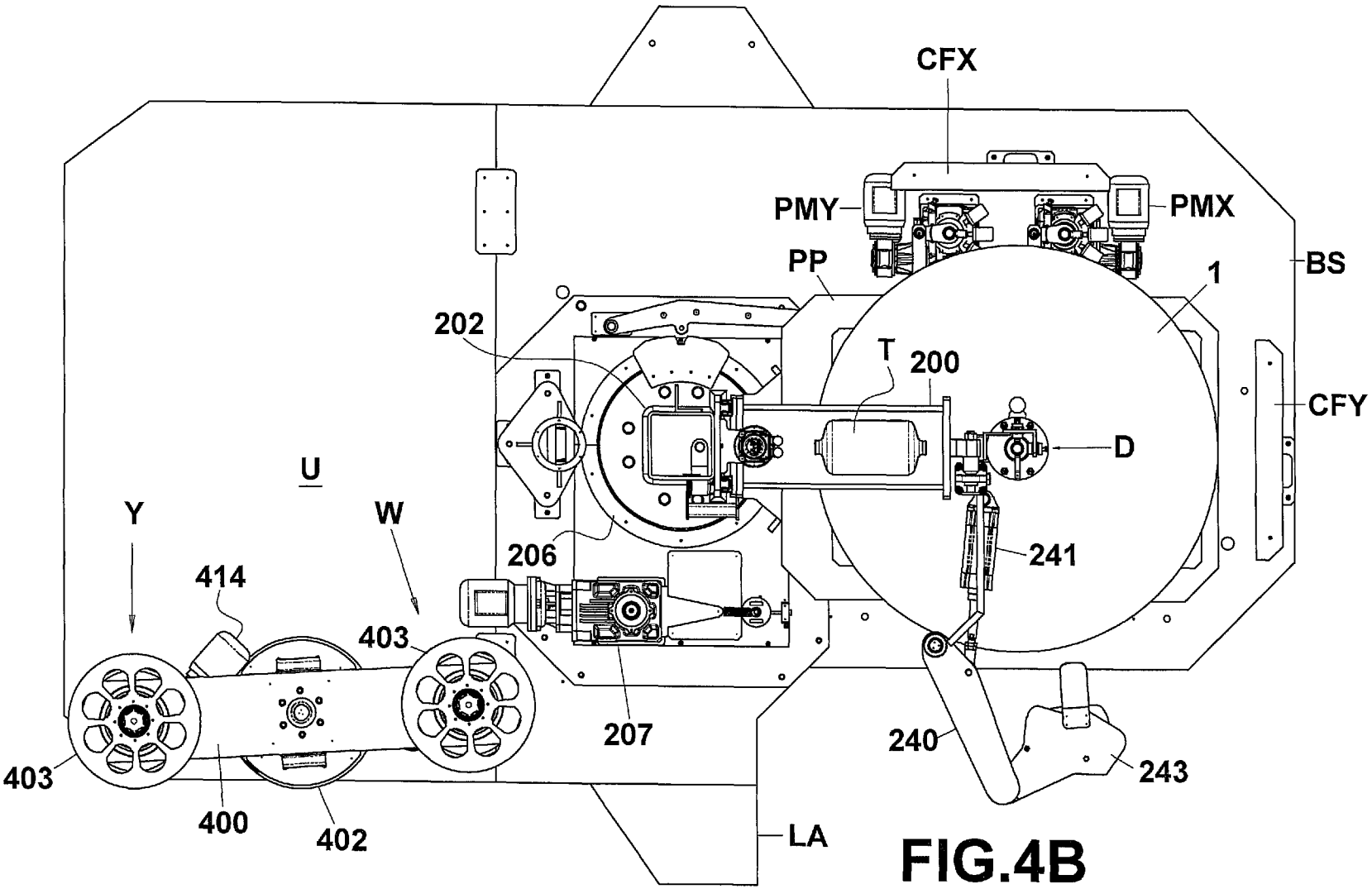
Figure 12B:
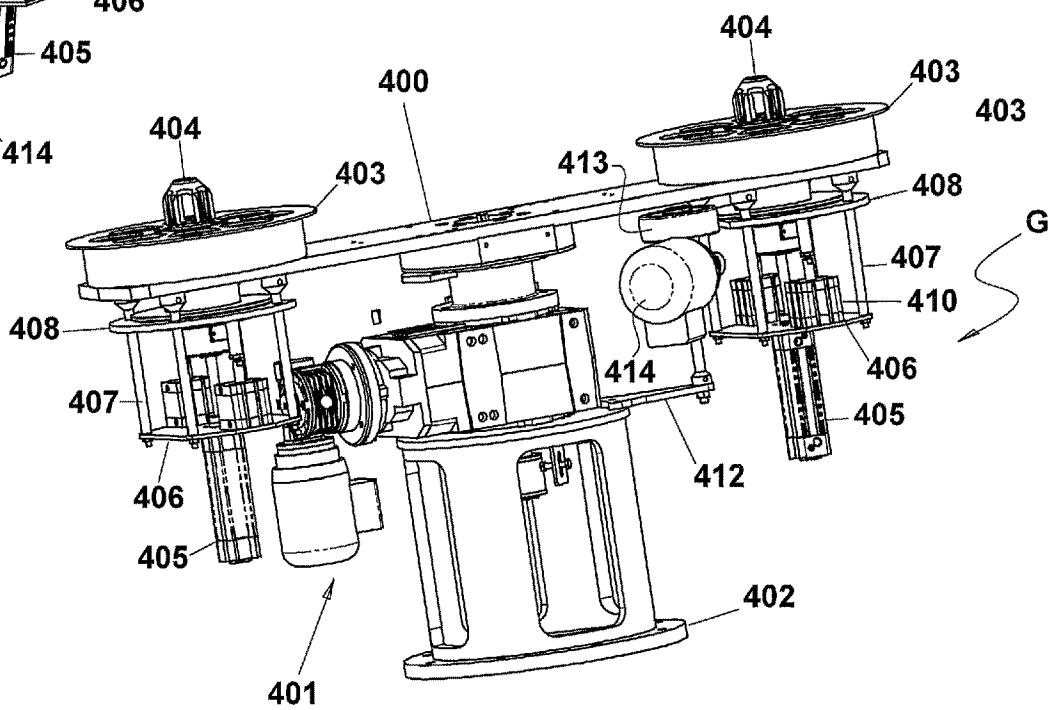
FIGS. 12A and 12B are two perspective views of a carousel of an unwinding unit.
Figure 12A:
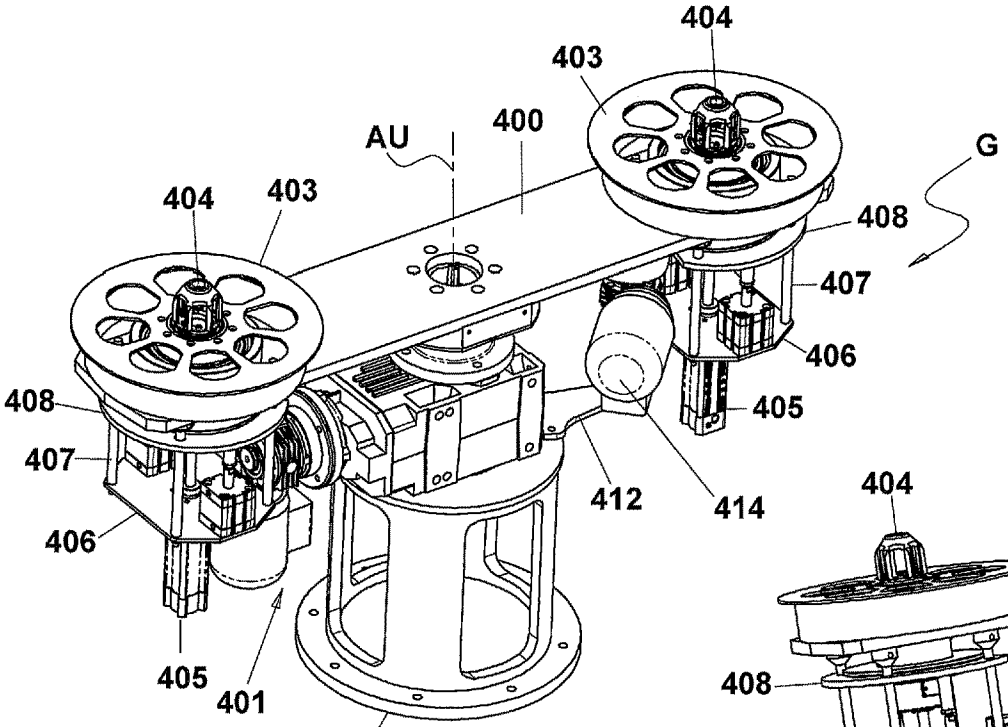
Figure 12D:
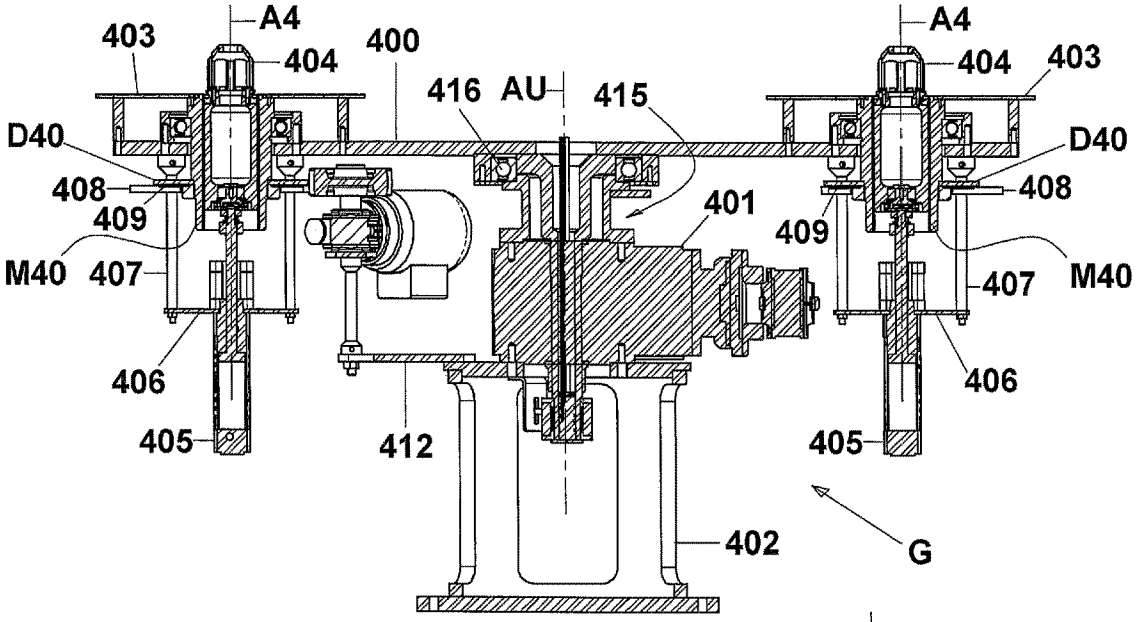
FIG. 12D is a sectional view along the line H-H of FIG. 12C.
Figure 12C:
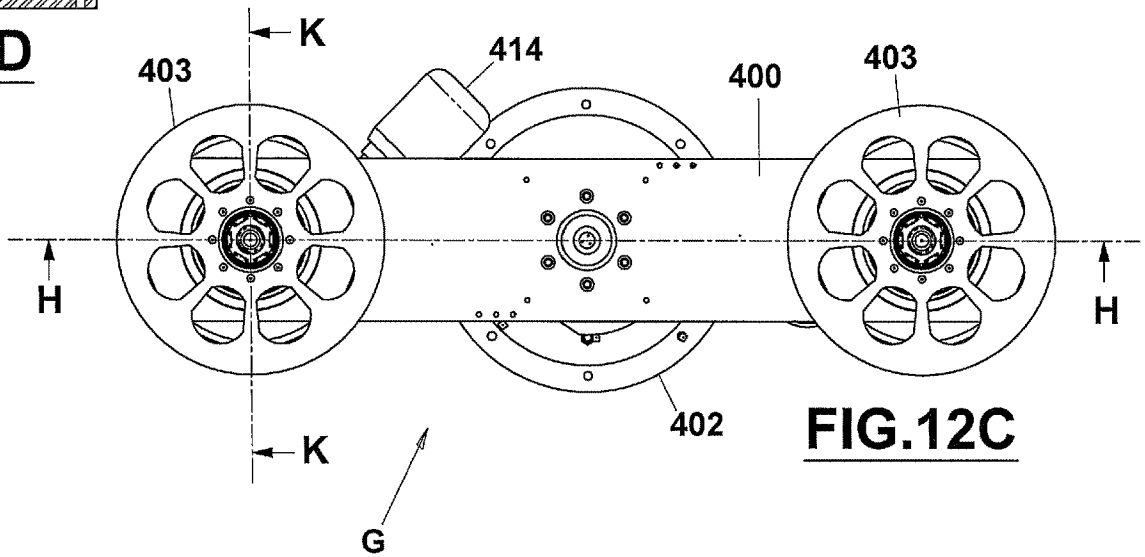
FIG. 12C is a top plan view of the carousel illustrated in FIGS. 12A and 12B.
Figure 12E:
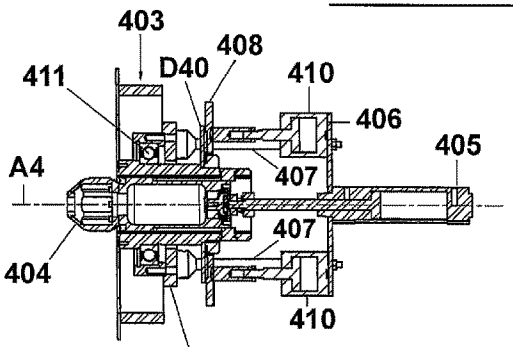
FIG. 12E is a section view along the line K-K of FIG. 12C.

FIG. 12E shows a bearing (411) coaxial to the pin (404) which allows the support (403) to rotate idly around the same pin whose longitudinal axis coincides with the central axis (A4) of the support. On an appendix (412) of the base (402) there is mounted a wheel with a vertical axis (413) operated by a respective electric actuator (414) which serves to rewind the cardboard strips after their cutting as further described below. In FIG. 12D you can see a flange (415) fixed to the body of the gearmotor (401) which supports the beam (400) with the interposition of a bearing (416). The rotation of the beam (400) around the axis (AU) allows, as further described below, to arrange the supports (403) alternatively in the unwinding position, position in which the web fed by the reel (1) arranged on a support, and in a waiting position or in a position in which the support can receive a new reel without interrupting the web unwinding from the reel present on the support arranged in the unwinding position. In other words, the rotation of the beam (400) around the axis (AU) allows the exchange of the positions of the supports (403). In FIGS. 4A and 4B the reference "W" indicates a first position of waiting and initial unwinding of a support (403) of a carousel (G), that is, the position closest to the station (P), while the reference "Y" indicates a second position for unwinding and exhaustion of the other support of the same carousel.

The arrangement of several supports (403) on the carousel (G) allows, as further described below, to ensure the continuity of the feeding process of the tube-forming machines with the strips unwound by the reels (1) even during the reel exchange phases in exhaustion with unused reels. In practice, when the reel (1) present on a support (403) in the first position (Y) is running out (condition detected through the detection mechanism 523 described later), the carousel (G) is rotated around the axis (AU) so that this support is moved away from the first position (Y) while another support (403) takes its place. In other words, the provision of several supports (403) on the carousel (G) ensures the possibility of performing an exchange of positions between the supports themselves which determines a corresponding exchange of positions of the reels (1) intended to feed the cardboard strips with which the tube-forming machines make cardboard tubes.

Figure 1A:
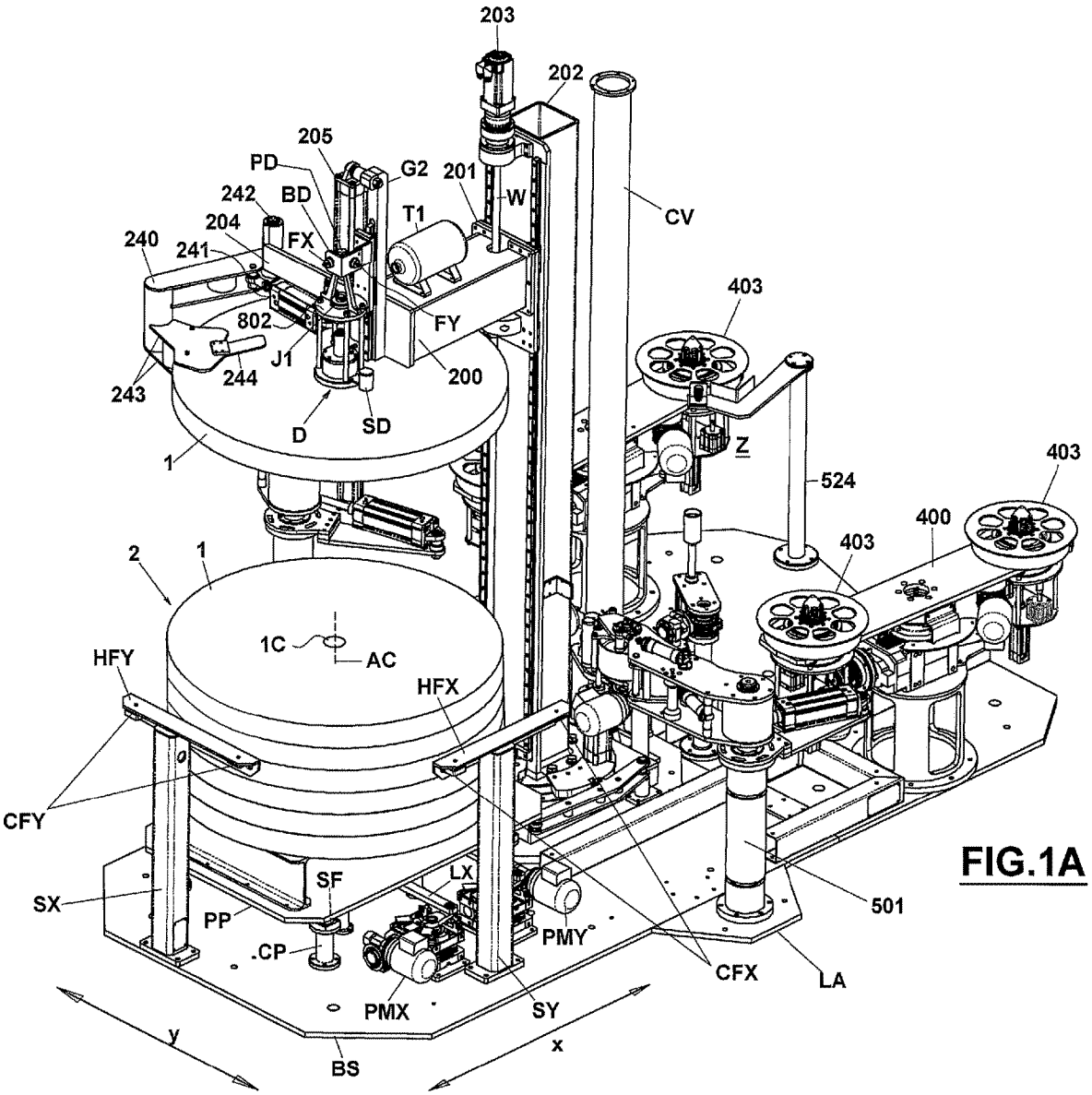
FIGS. 1A and 2A are two perspective views of a plant according to the present invention.
Figure 1B:
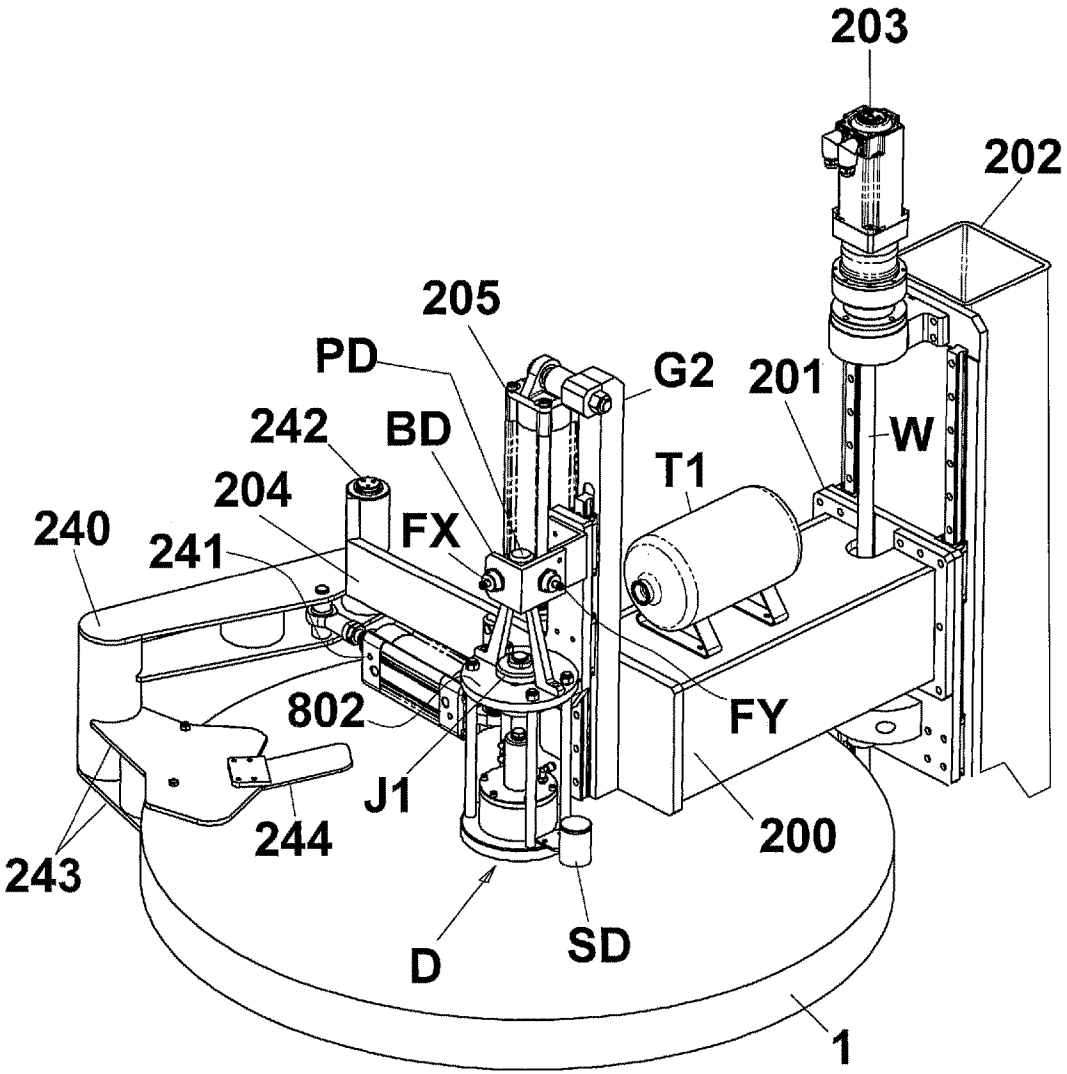
FIGS. 1B and 2B are two enlarged details of FIG. 1A and FIG. 2A respectively.

At the side of each carousel (G) there is a mechanism (DS) configured to guide the cardboard strips that unwind from the reels (1) present on the aforementioned supports (403) in order to temporarily modify their path in the phases of exchange of positions of the same supports and also configured to perform further functions as further described below. With reference to what is illustrated by way of example in FIGS. 13A-14B, said mechanism (DS) comprises an arm (500) mounted on a column (501) by means of a vertical axis hinge (V5) and enslaved to a pneumatic actuator (502) which controls its rotation around said axis (V5). The actuator (502) is fixed to the column (501). The latter is arranged at a predetermined distance from the respective carousel (G) in a rearward position with respect to the corresponding carousel (G). In FIG. 1A and FIG. 2A the columns (501) are positioned on corresponding lateral appendages (LA) of the base (B S). The arm (500) has a rear side (R5), constrained to the column (501) as previously mentioned, and a front side (F5) and is preferably made up of two horizontal plates (503, 504) spaced apart by a predetermined value to form an intermediate space (HS). In said intermediate space (HS) there are arranged, starting from the rear side of the arm (500): an idle pressure roller with vertical axis (505) mounted on a lever (506) controlled by a pneumatic actuator (507) arranged in the space (HS) in such a way that the roller (505) can be extracted from the space (HS) and made to re-enter the same space by controlling the rotation of the lever (506) by means of the actuator (507); a driving roller (508) with a vertical axis (A8) rotating idly around its own axis but connectable (for example by means of an electromagnetic clutch, not visible in the drawings) to a corresponding gearmotor (509) constrained to the lower face of the lower plate (504) of the arm (500); a vertical blade (510) controlled by a pneumatic actuator (511) mounted on the upper side of the upper plate (503) of the arm (500) so that this blade can be extracted from the front side (F5) of the arm and respectively retracted by means of the actuator (511). On the front side (F5) of the arm (500) there are also provided an idle roller with a vertical axis (512) cooperating with the blade (510) and a convex strip-guide surface (513) placed on the opposite side of the roller (512) with respect to the blade (510).

Figure 13B:
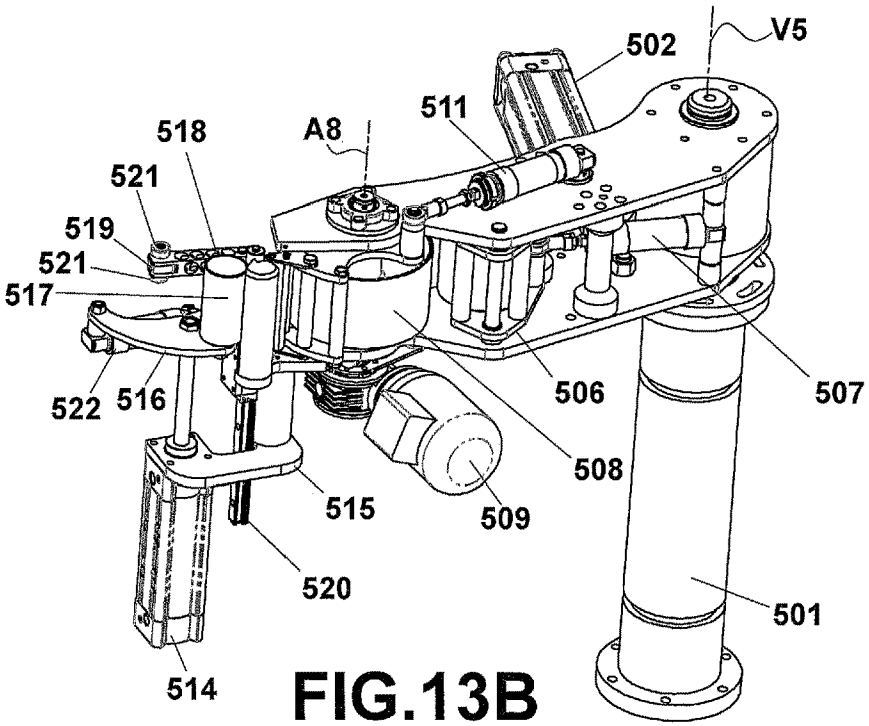
FIGS. 13A and 13B are two perspective views of a movable support, which supports means for joining the reels and further components designed to assist the exchange between a reel in the phase of exhaustion and a new reel intended to replace the one in the phase of exhaustion, in a possible operating configuration.
Figure 13A:
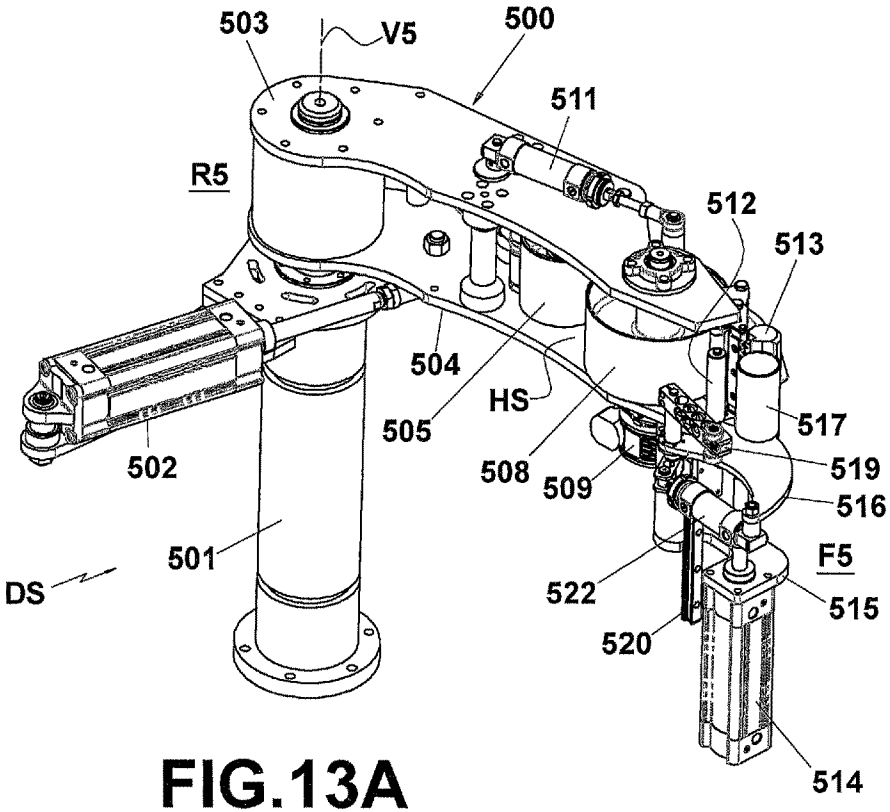
Figure 14B:
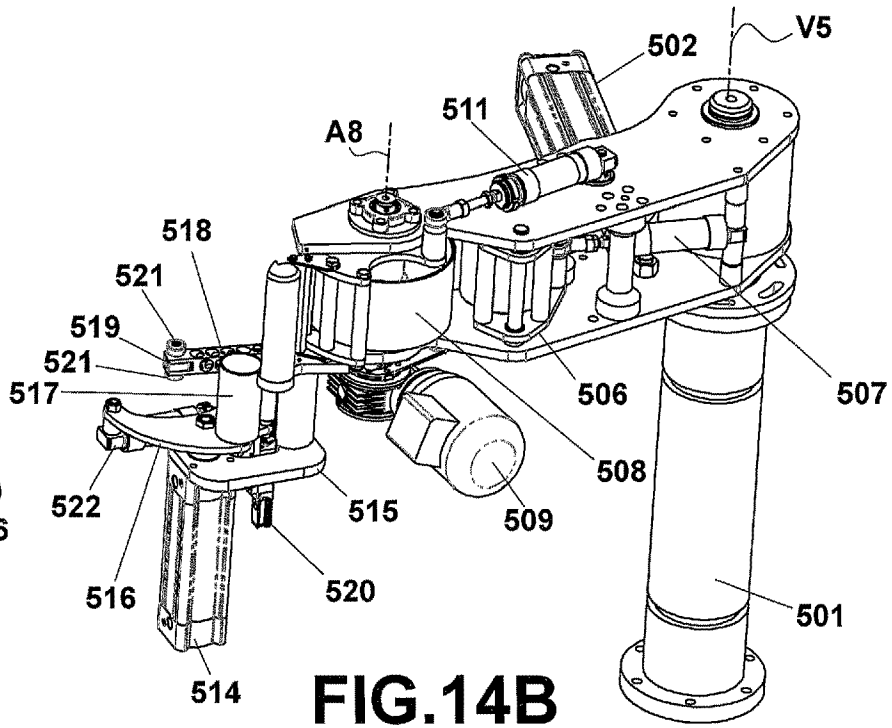
FIGS. 14A and 14B are two perspective views of the movable support of FIGS. 13A and 13B in another operational configuration.
Figure 14A:
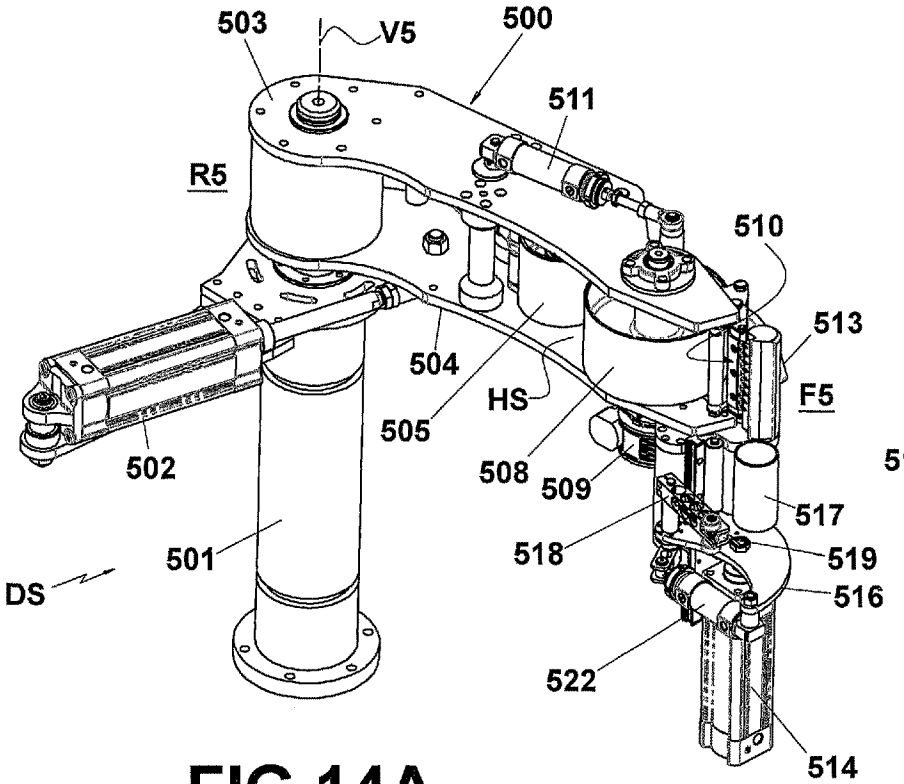
Figure 15B:
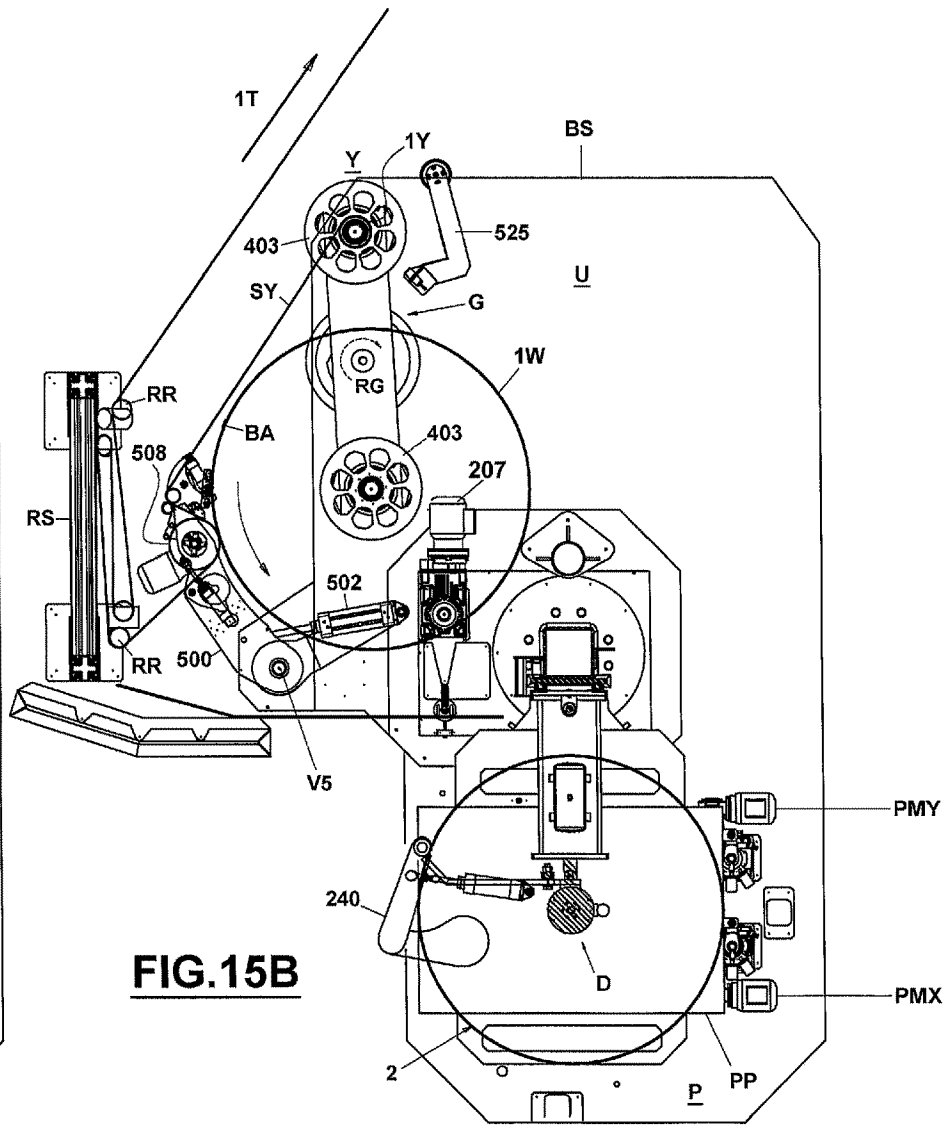
FIGS. 15A, 15B, 15C, 15D, 15E, 15F, 15G, 15H, 15I and 15L represent a sequence of steps relating to the exchange of position of the supports (403) in an unwinding station of a plant according to the present invention comprising an unwinding unit.
Figure 15A:
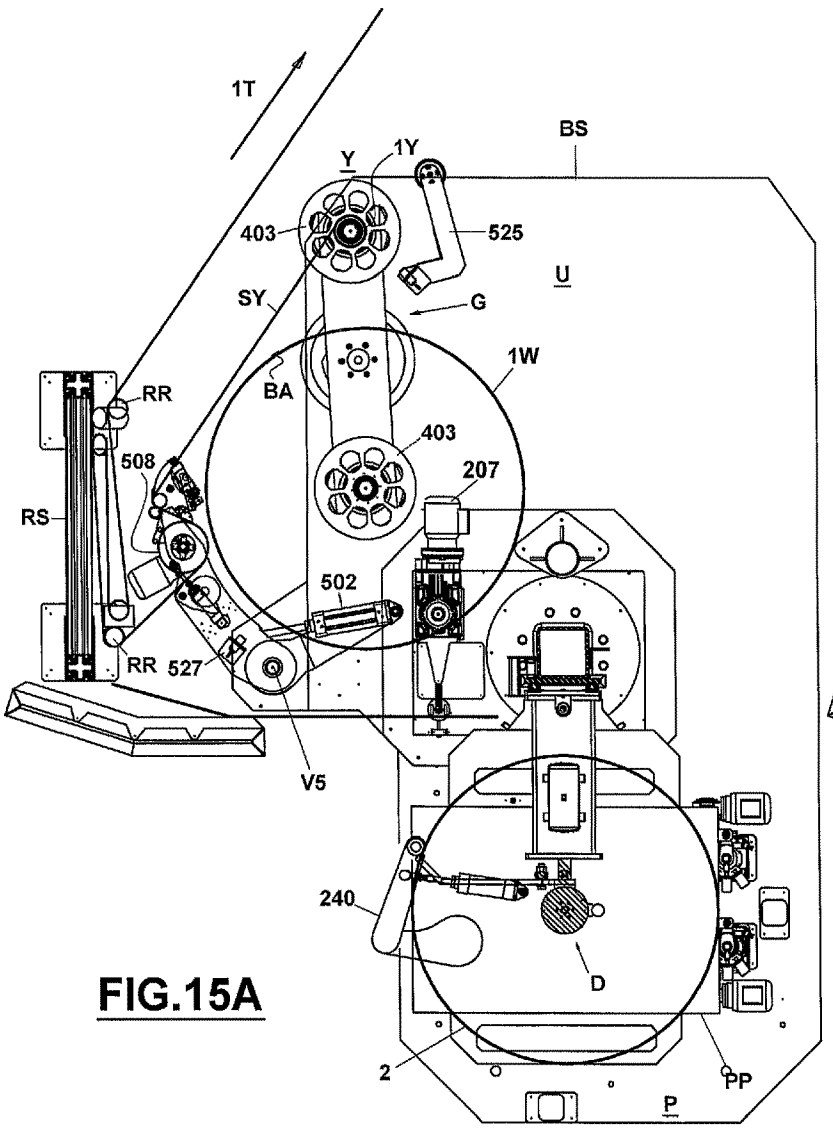
Figure 15D:
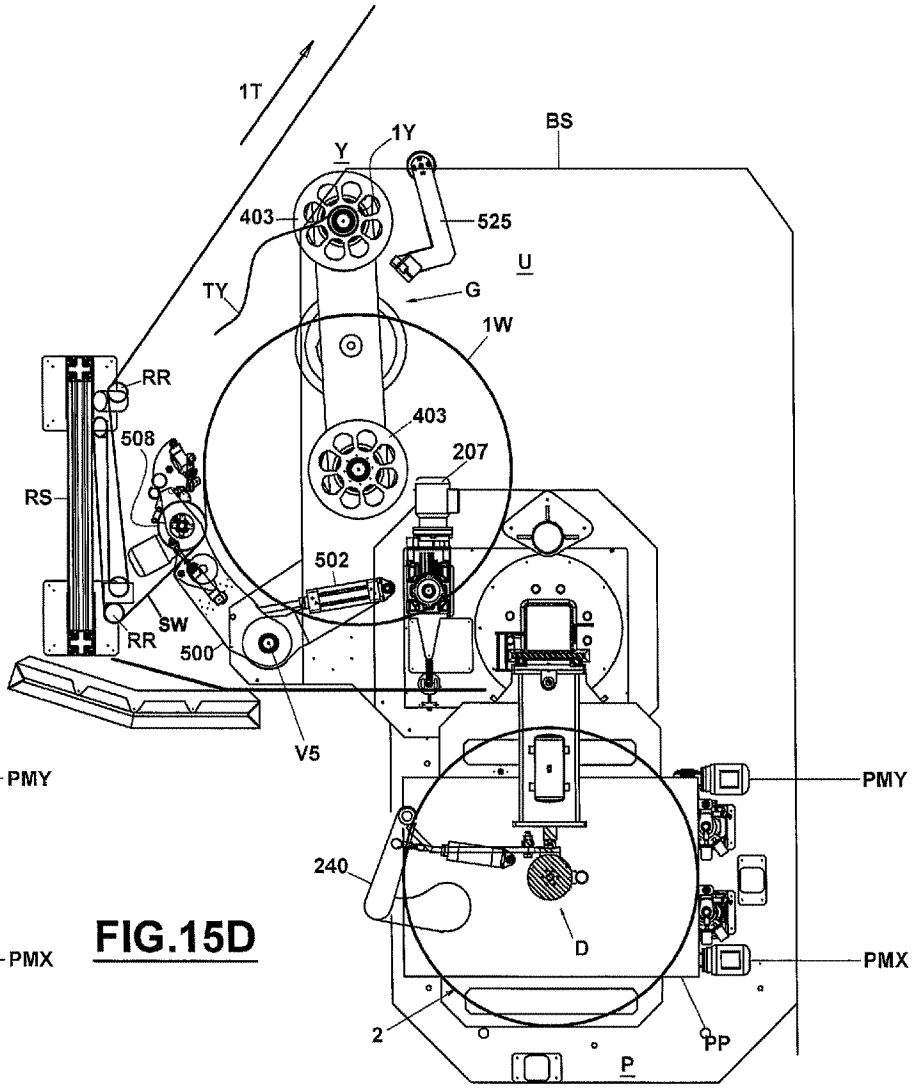
Figure 15C:
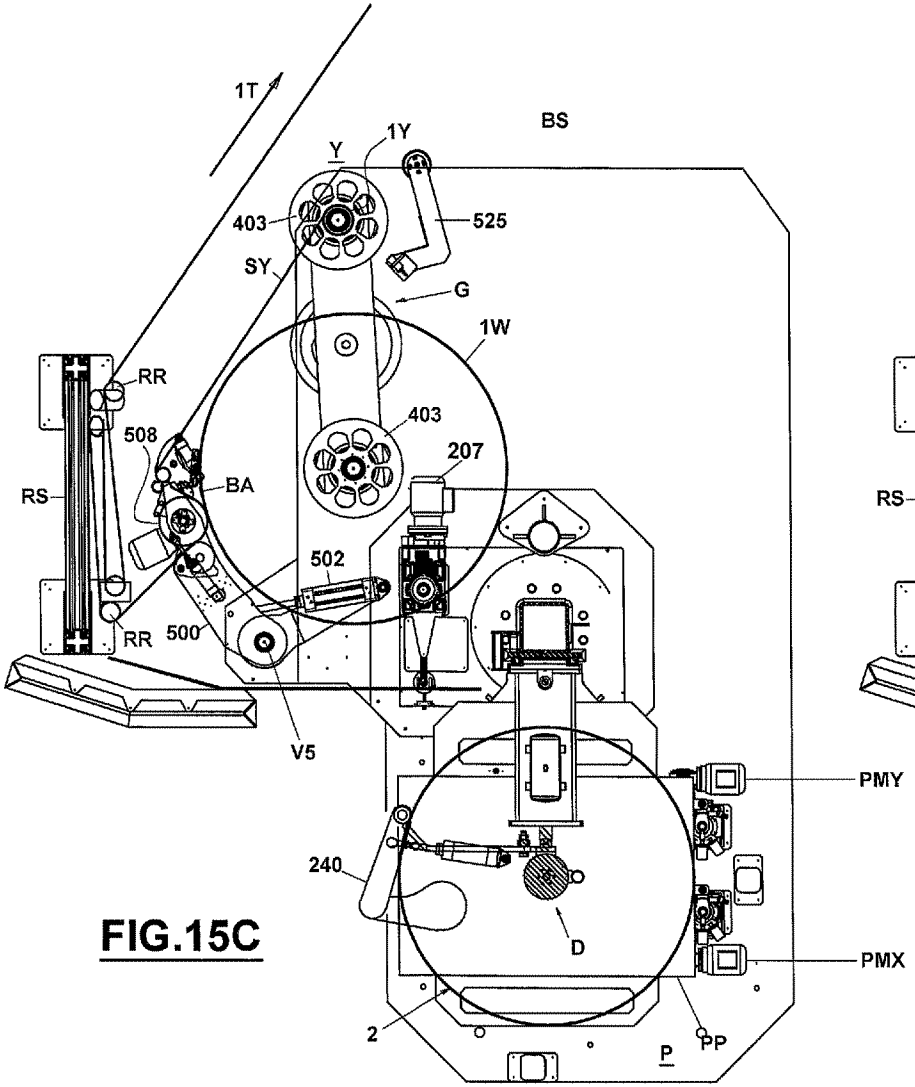
Figure 15F:
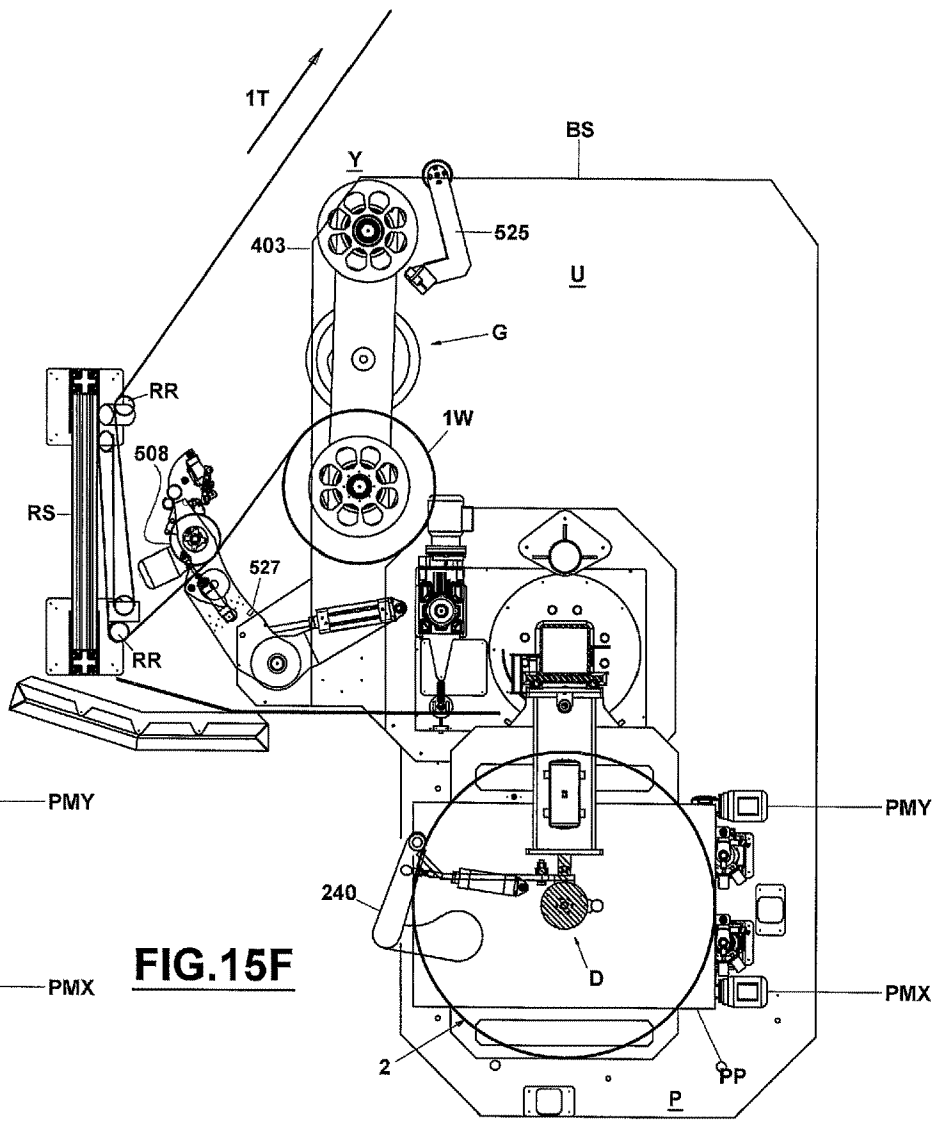
Figure 15E:
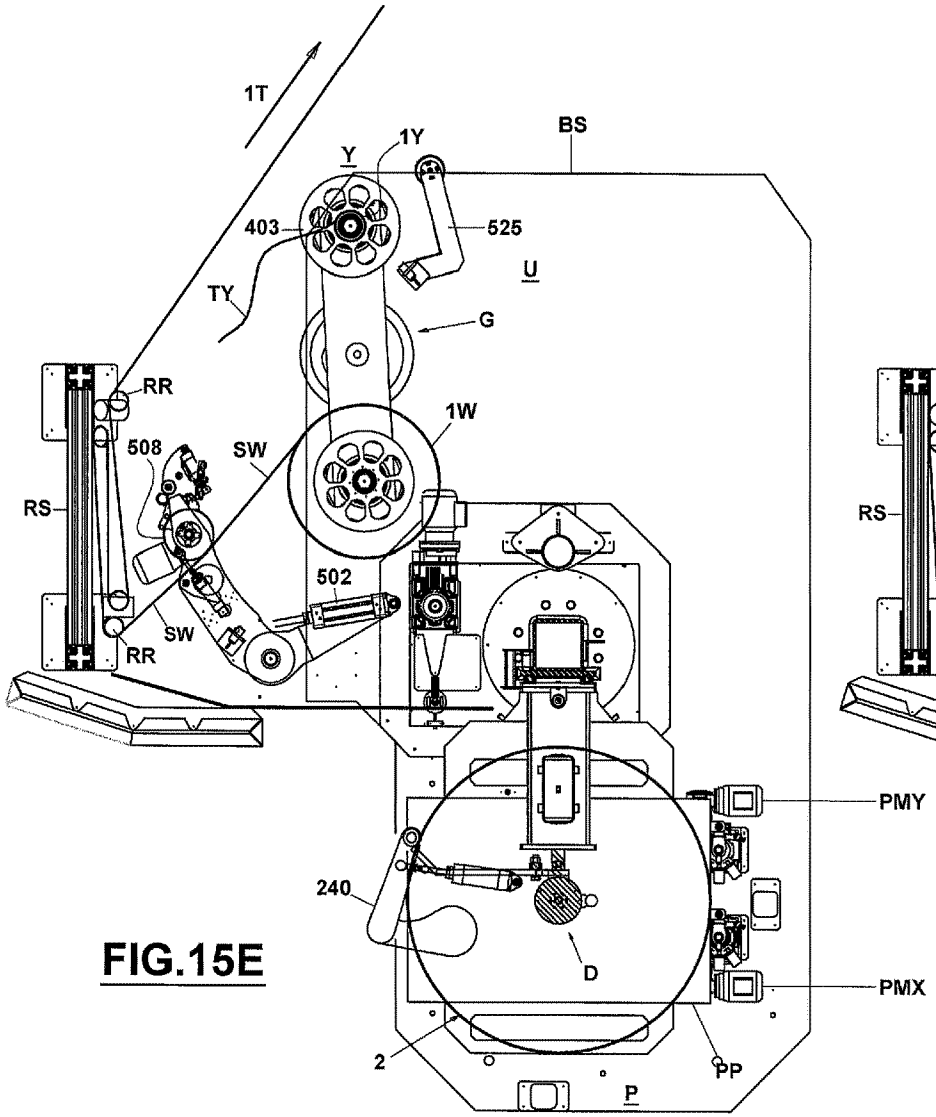
Figure 15H:
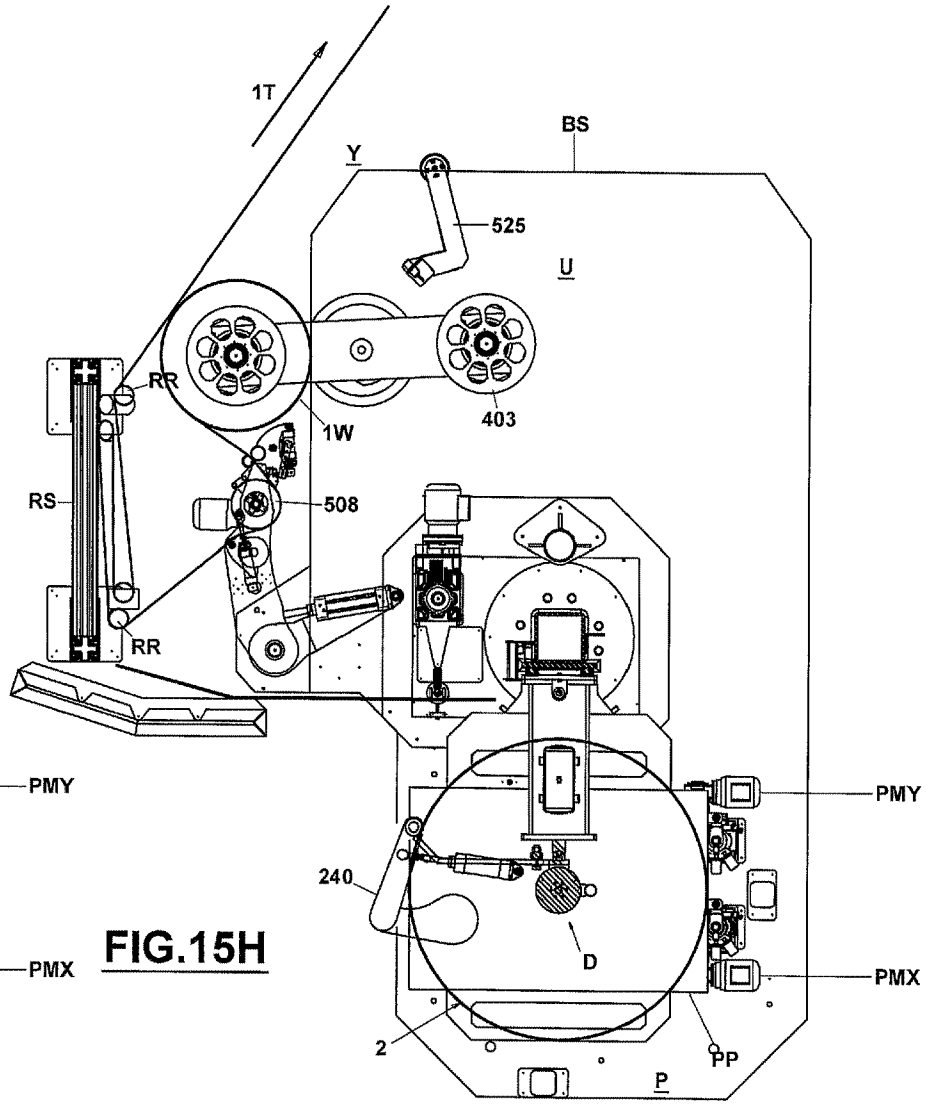
Figure 15G:
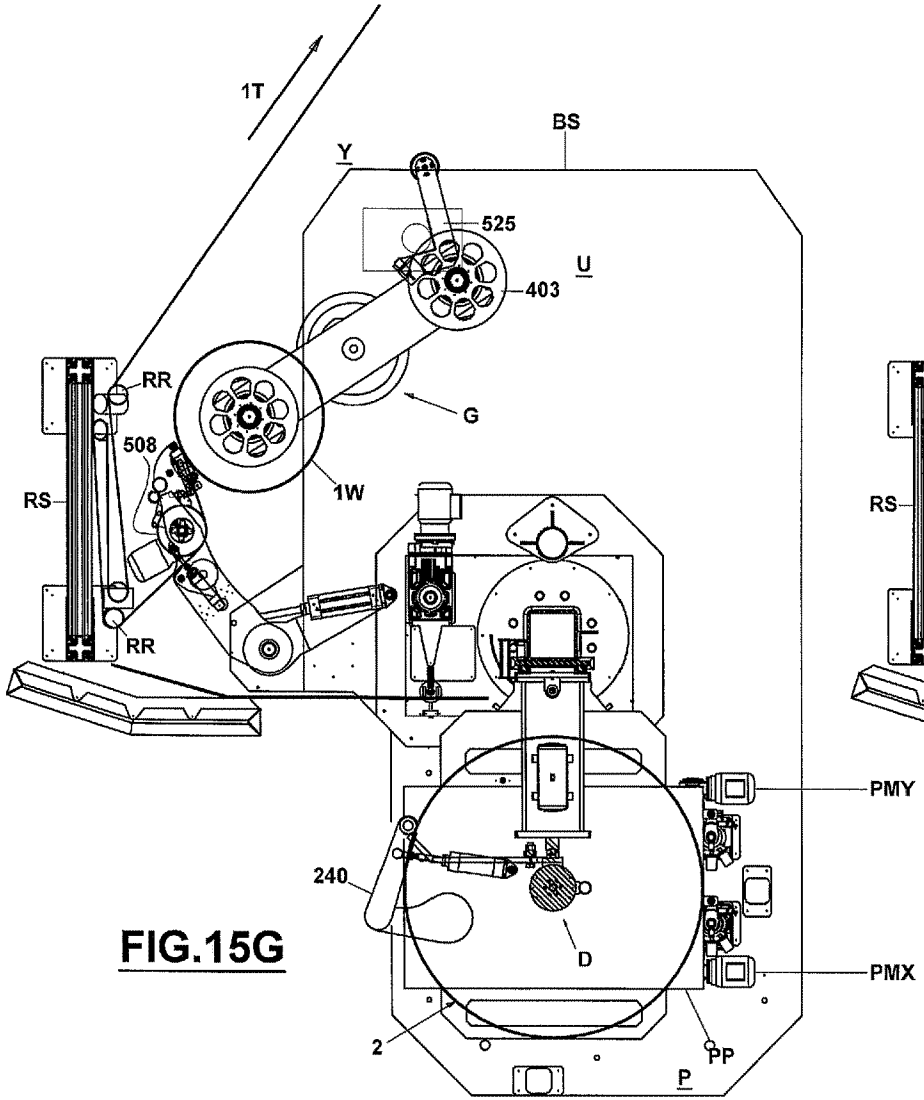
Figure 15L:
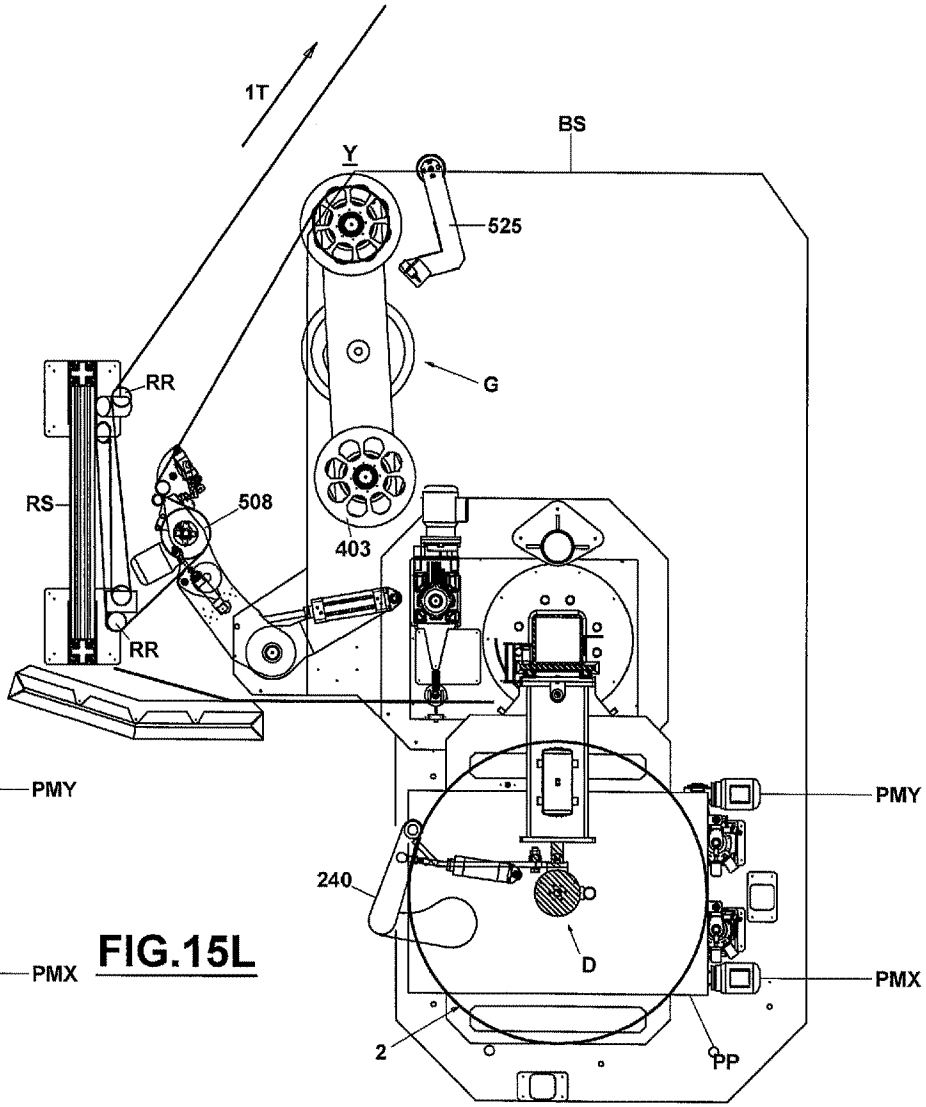
Figure 15I:
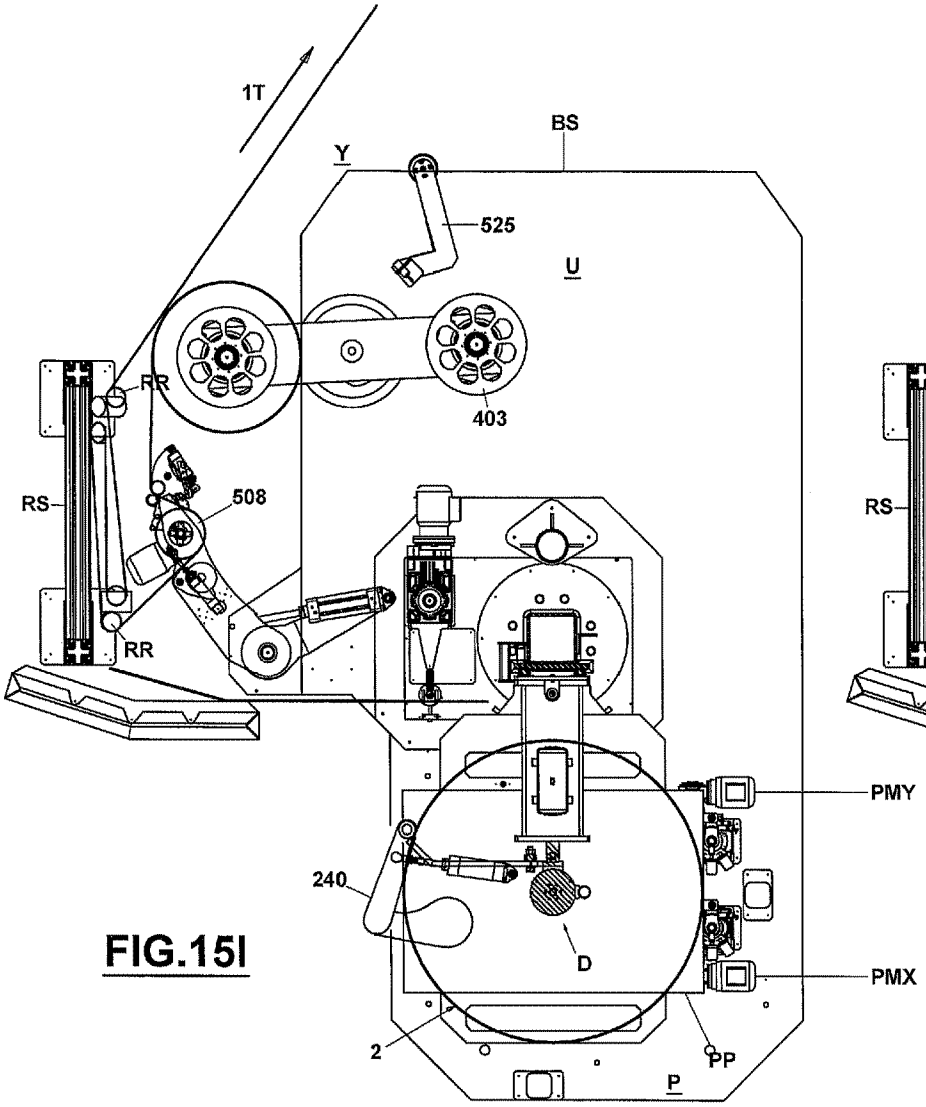
Figure 16A:
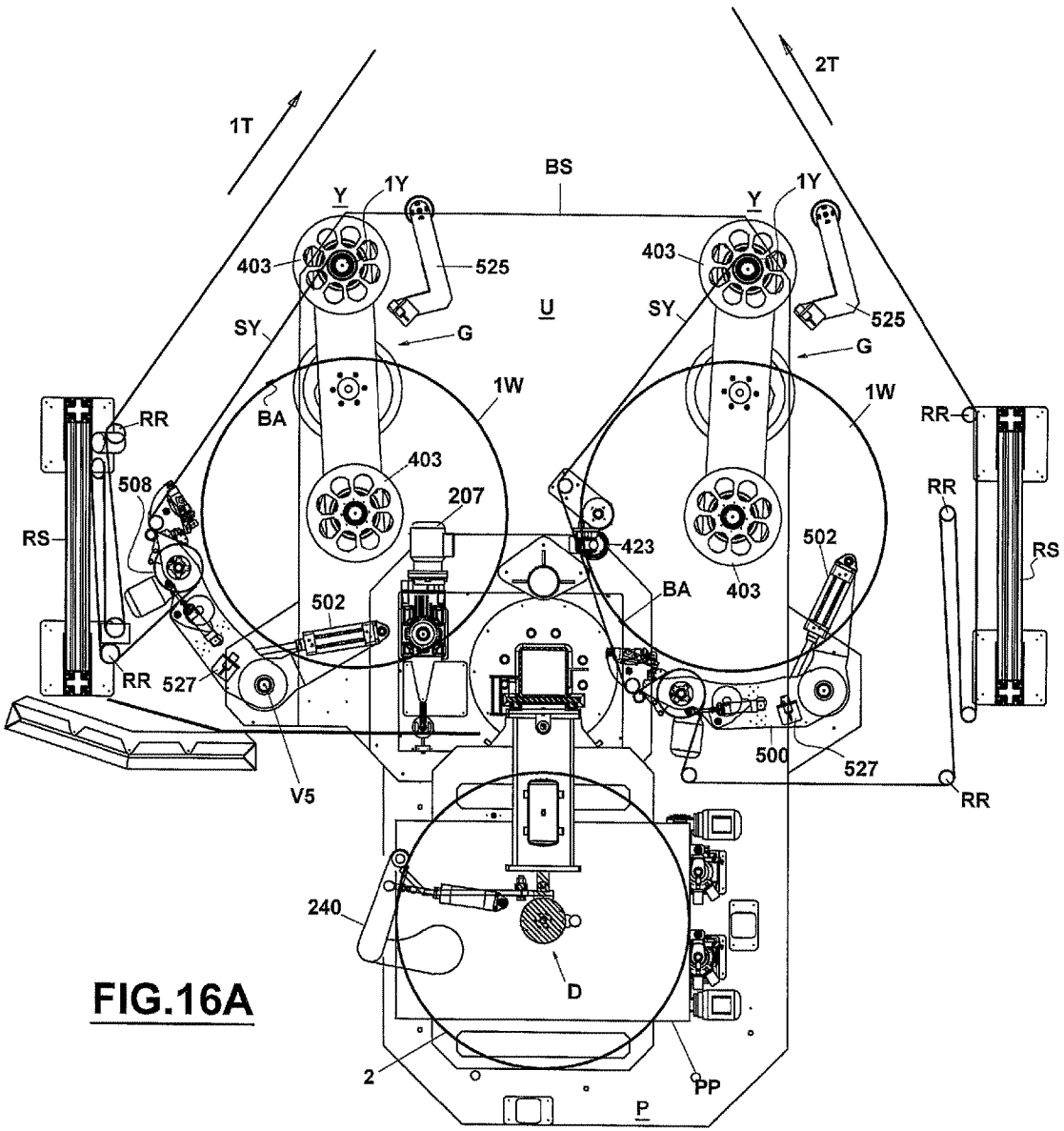
FIGS. 16A, 16B, 16C, 16D, 16E, 16F, 16G, 16H, 16I, 16L, 16M and 16N represent a sequence of steps relating to the exchange of position of the supports (403) in an unwinding station of a plant according to the present invention comprising two unwinding units.
Figure 16B:
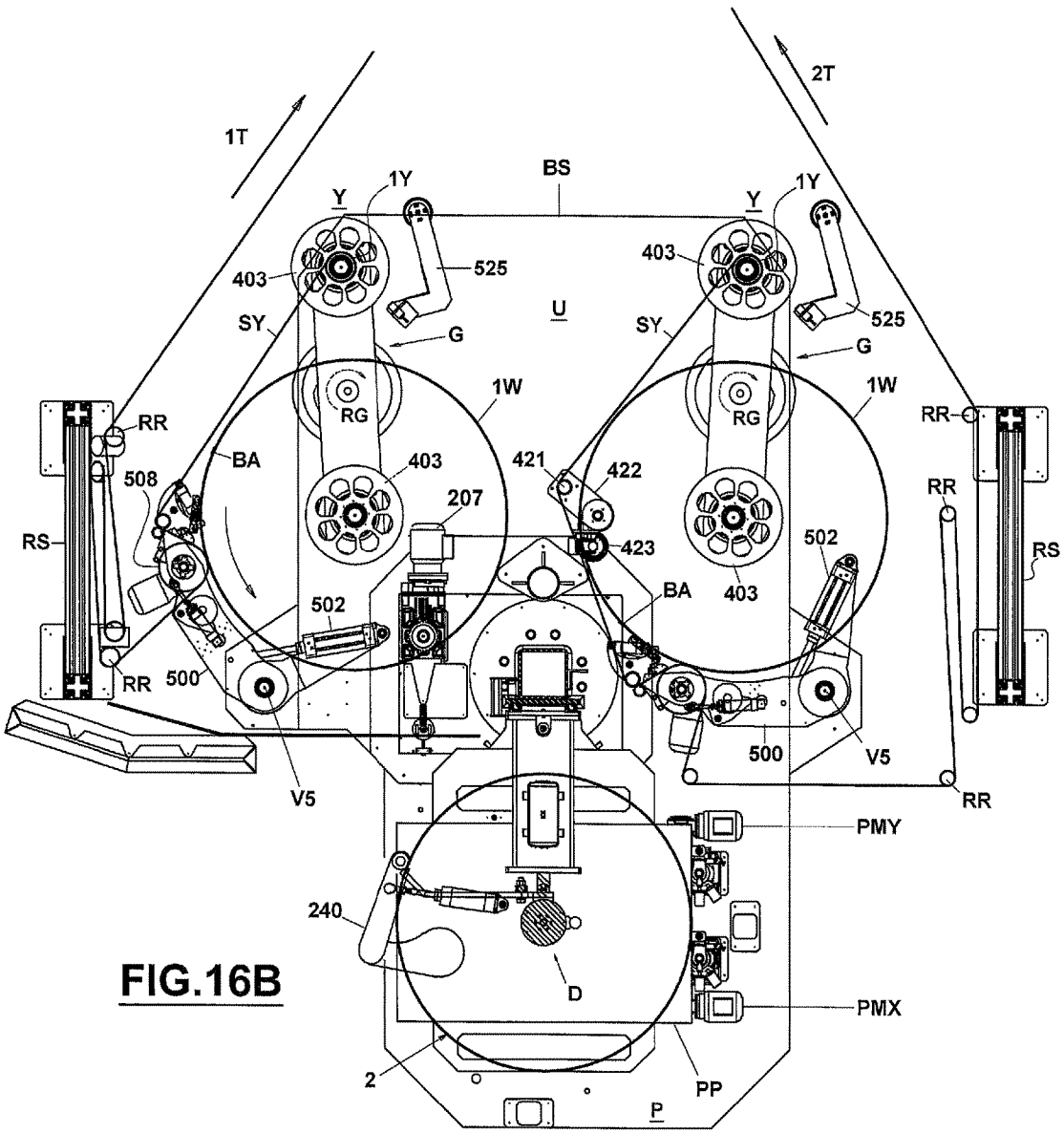
Figure 16C:
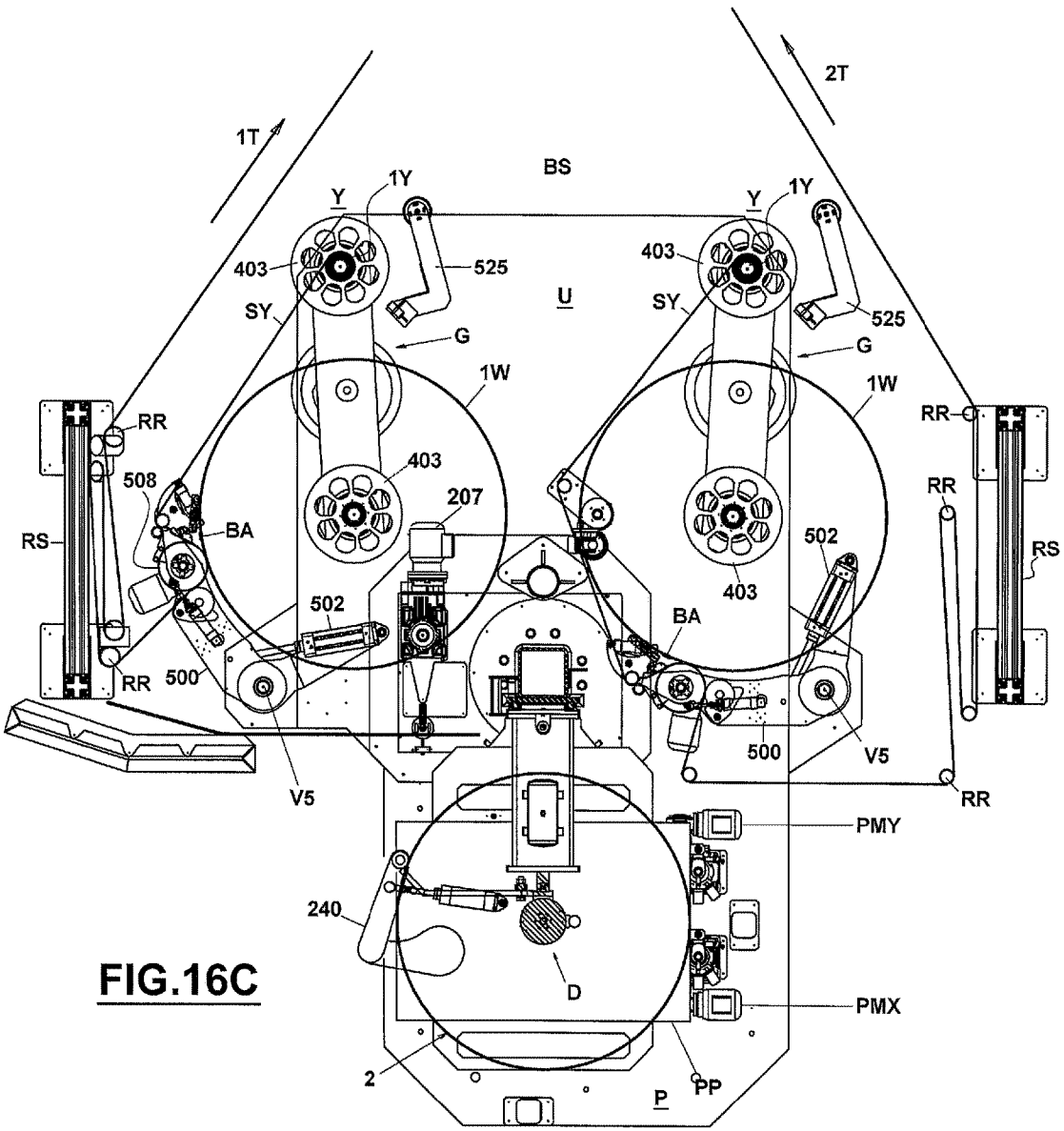
Figure 16D:
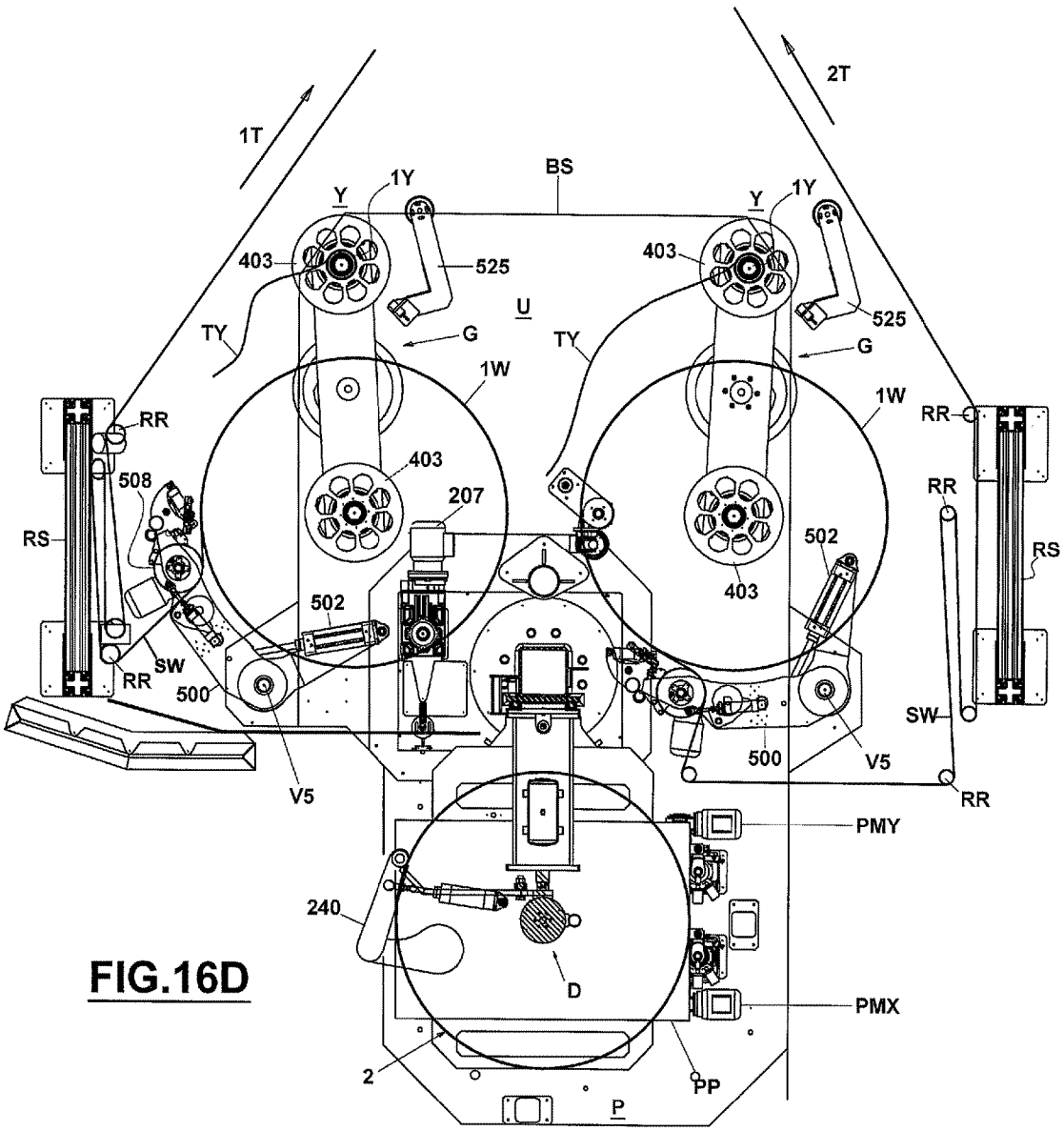
Figure 16E:
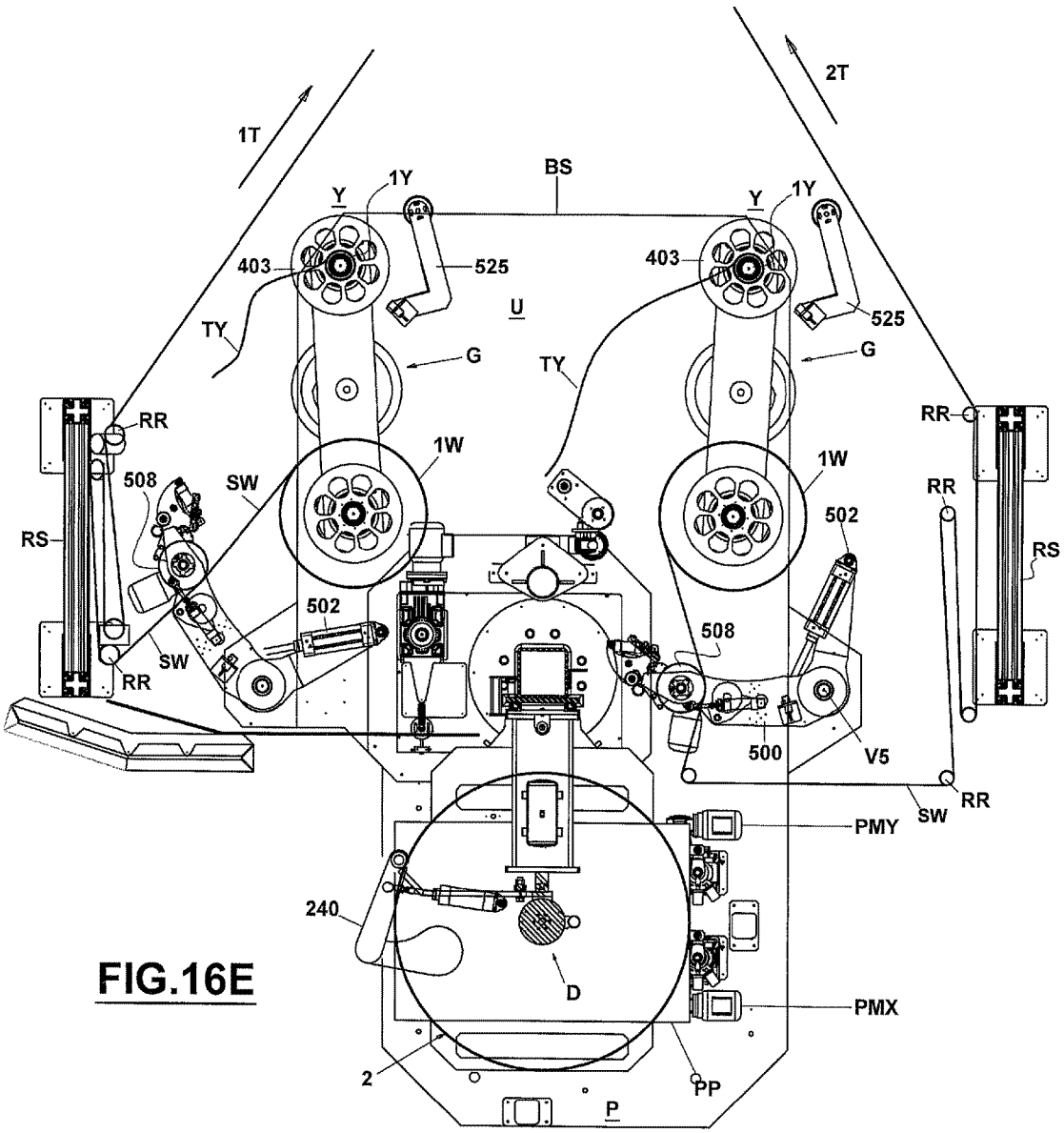
Figure 16F:
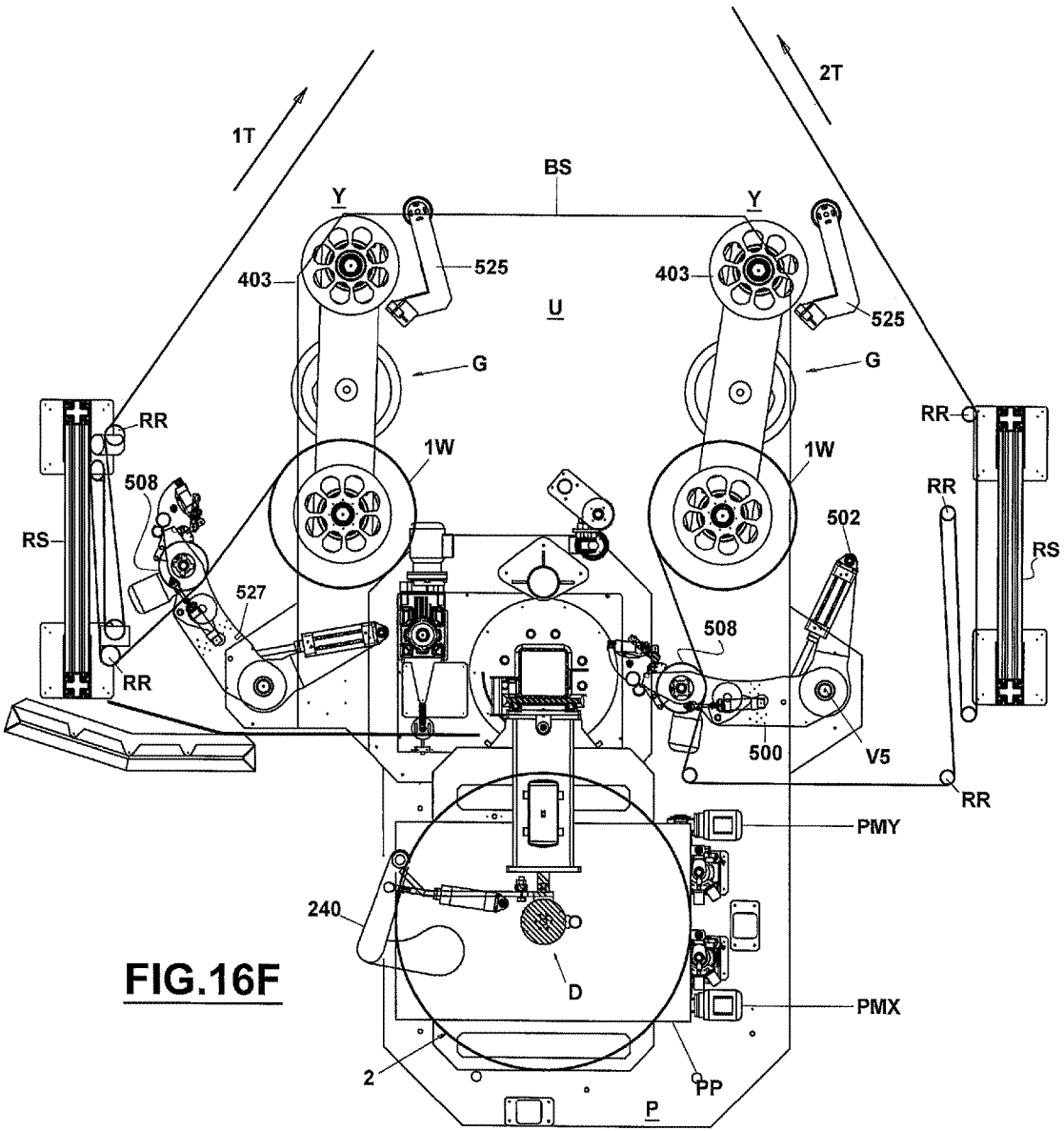
Figure 16G:
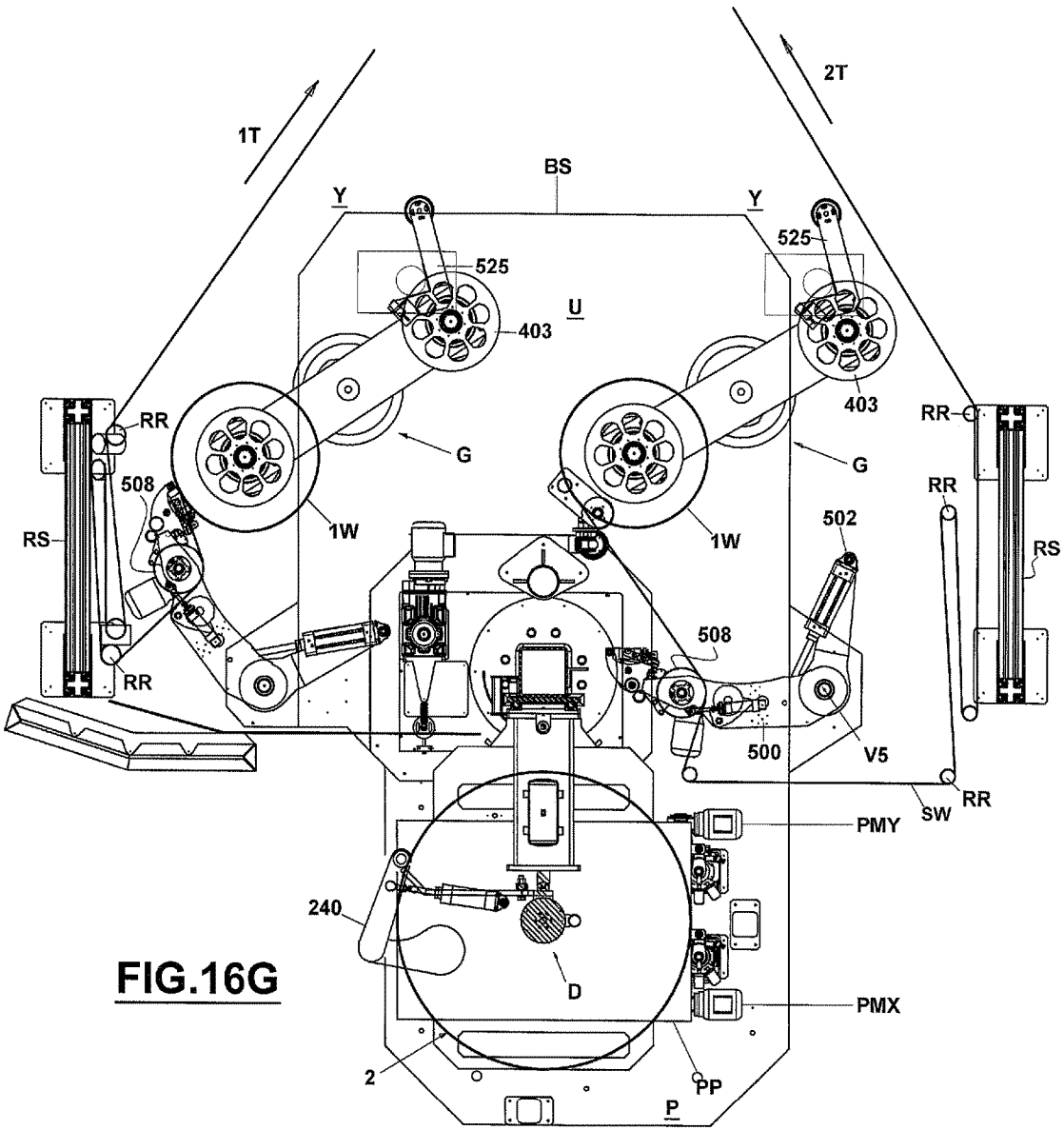
Figure 16H:
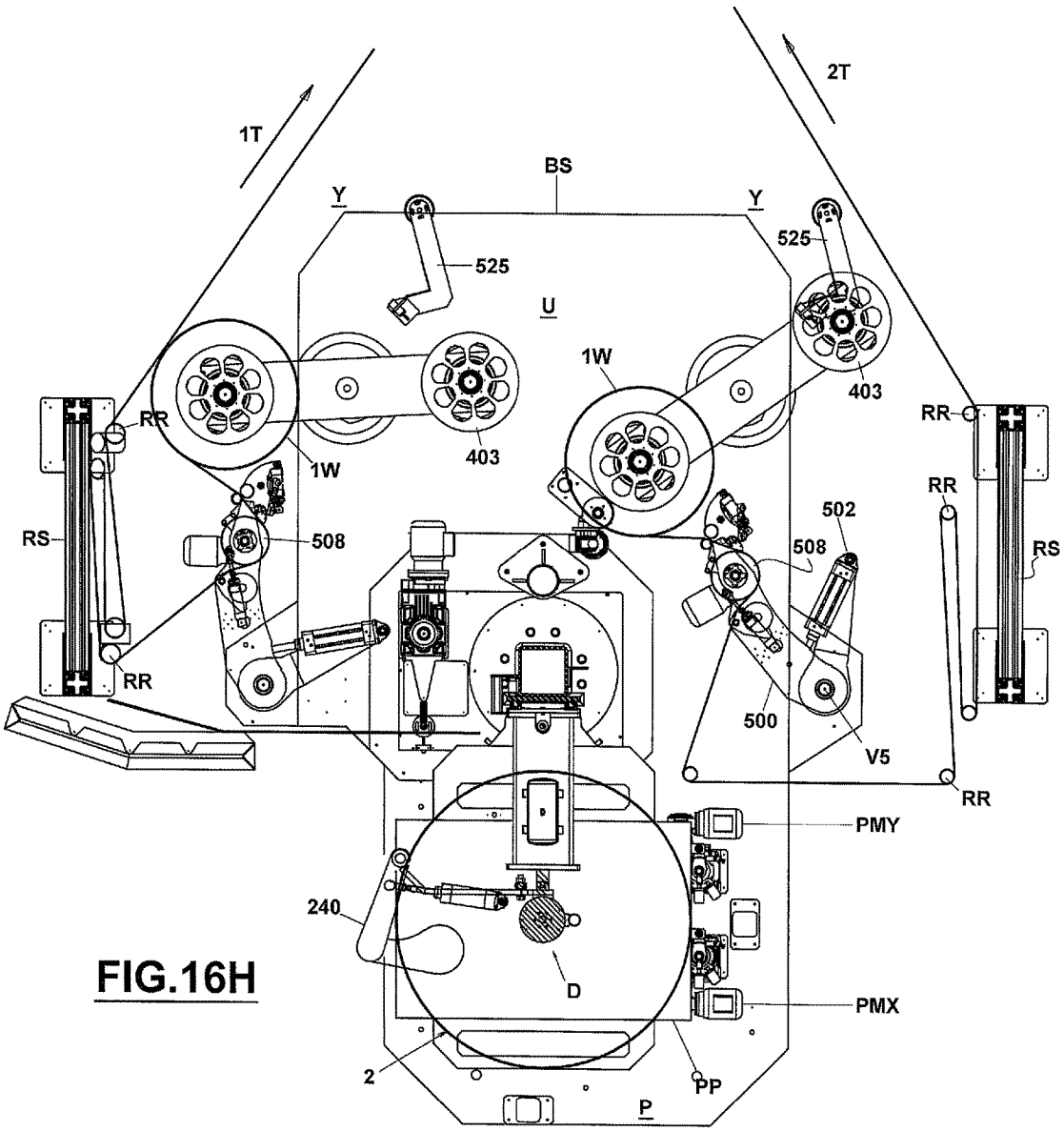
Figure 16I:
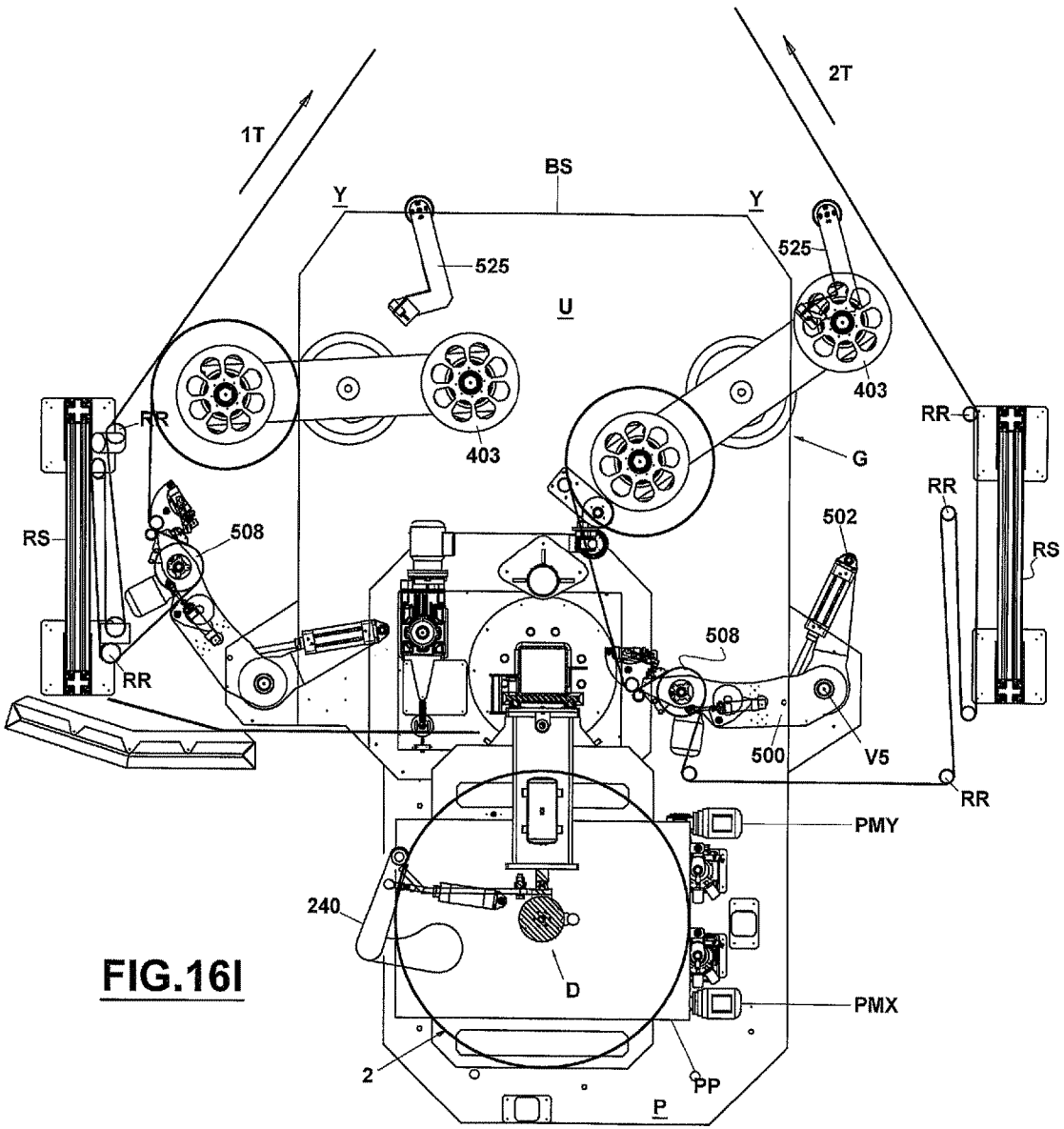
Figure 16L:
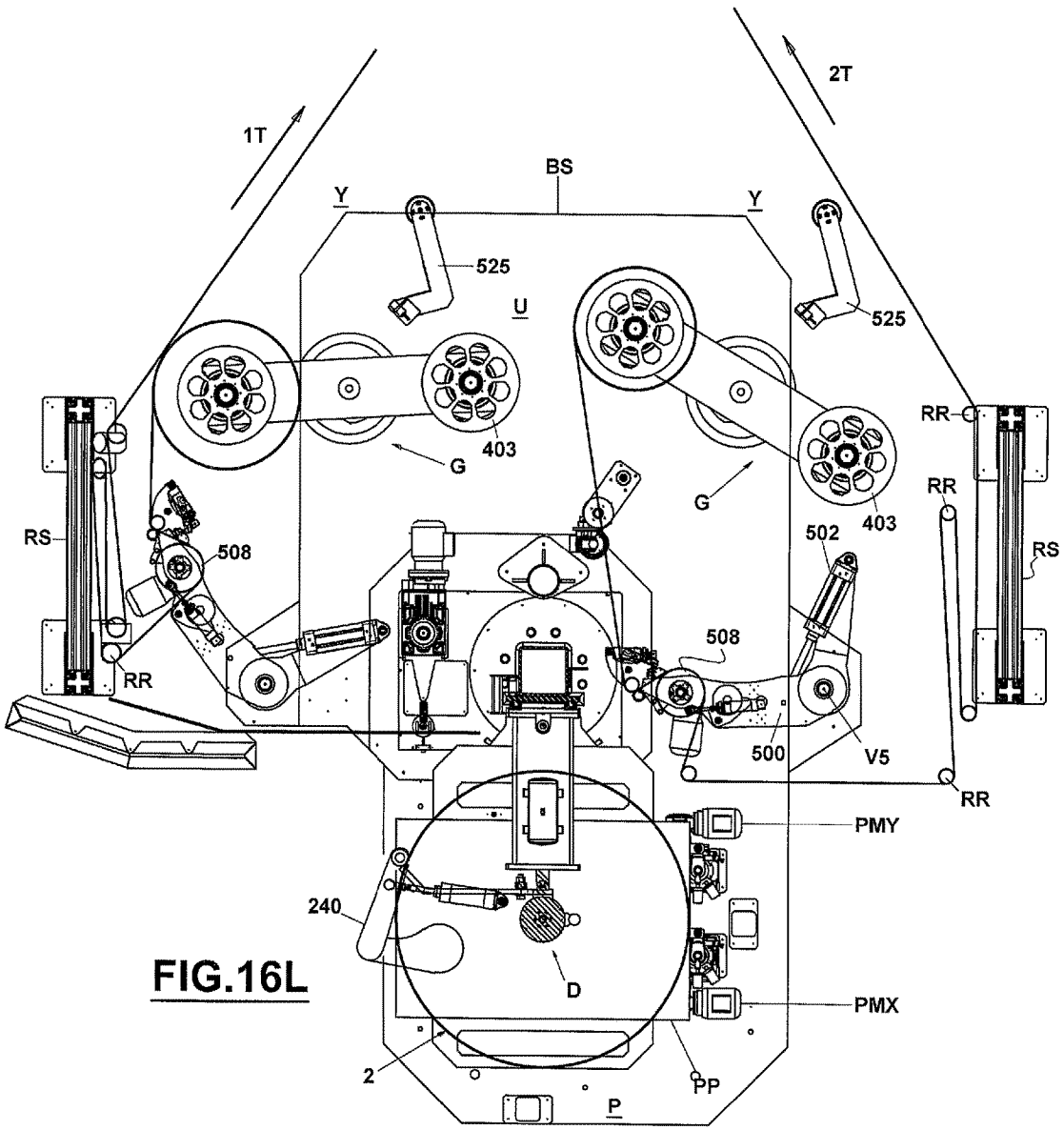
Figure 16M:
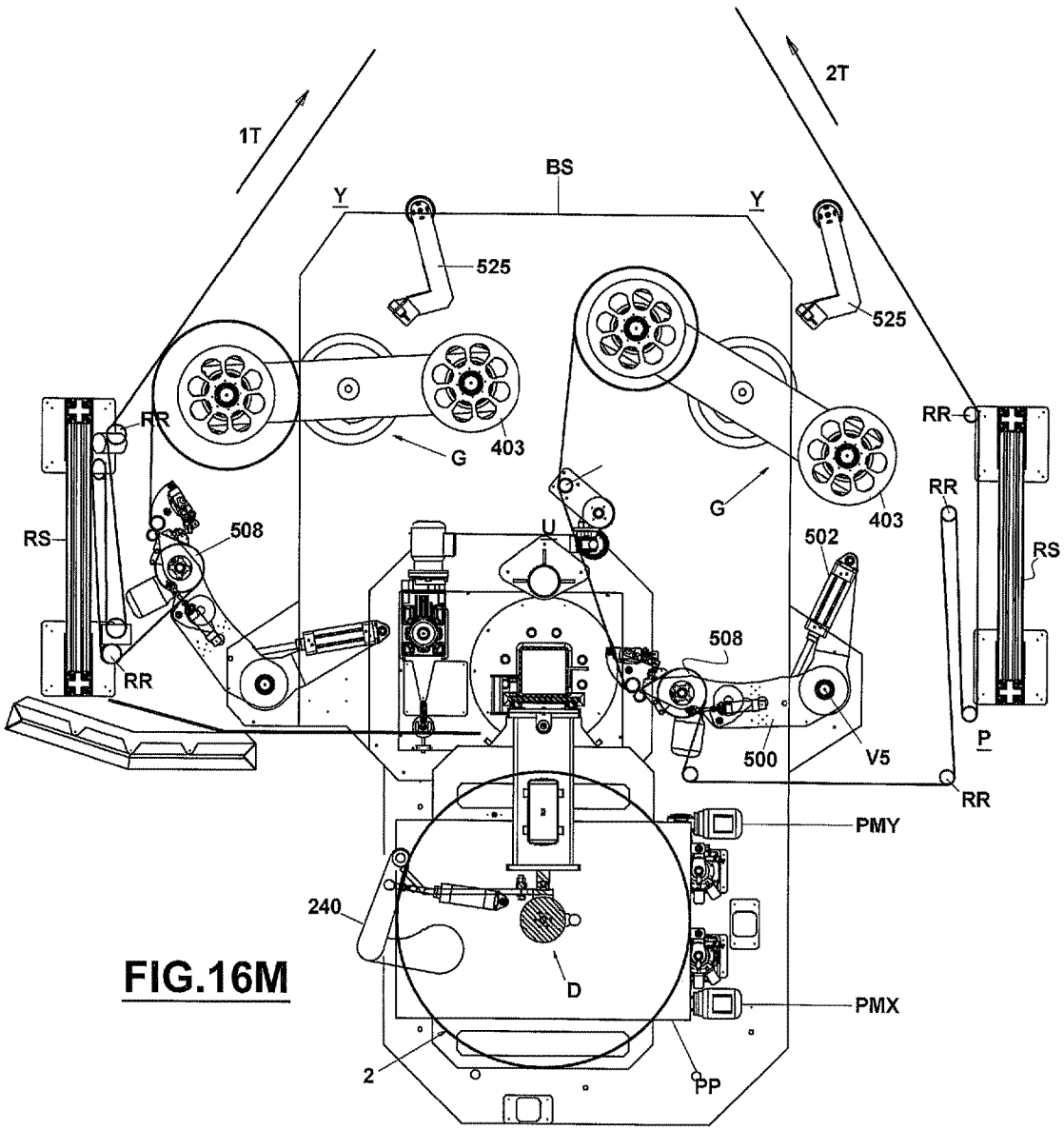
Figure 16N:
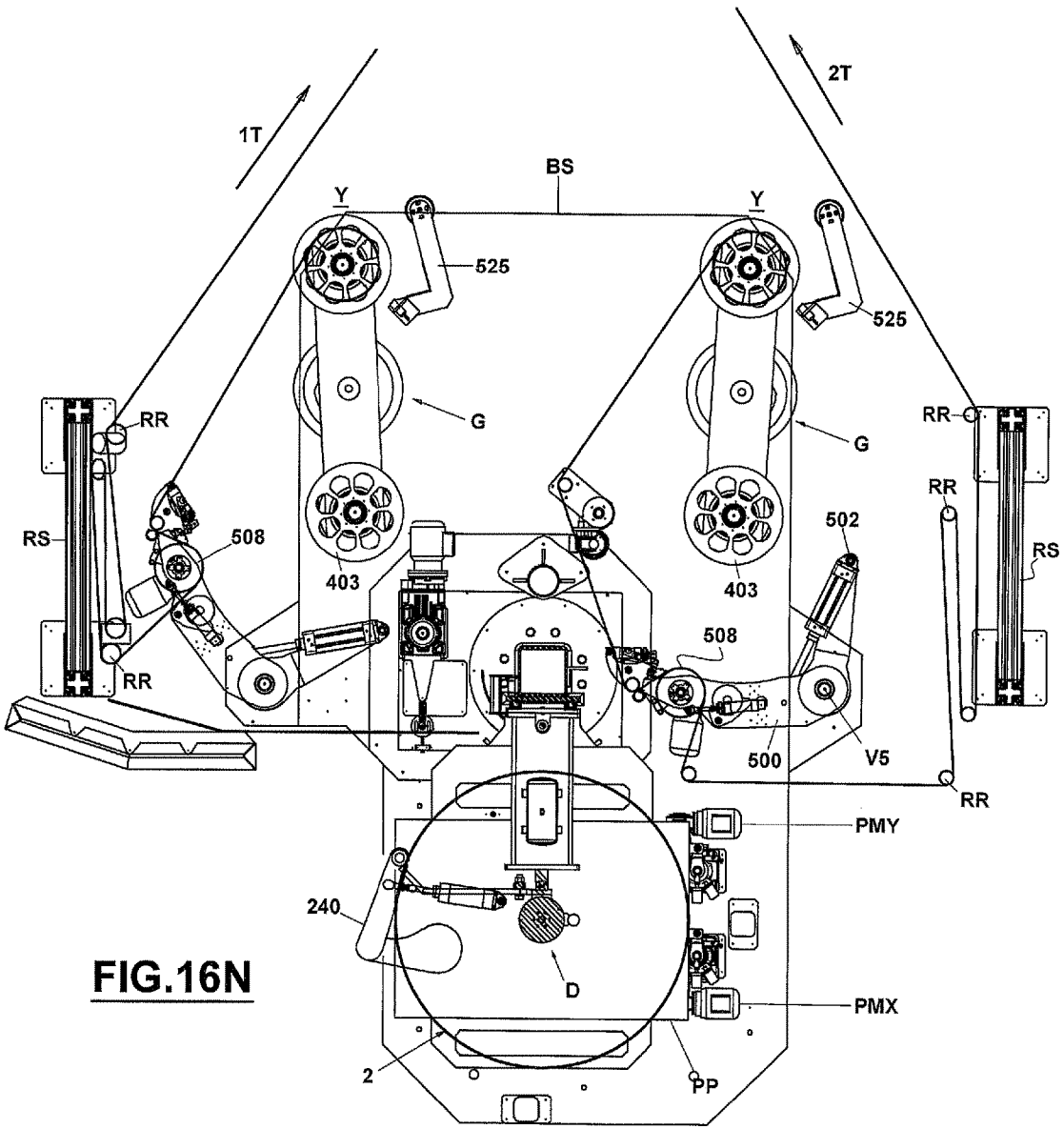
Figure 17:
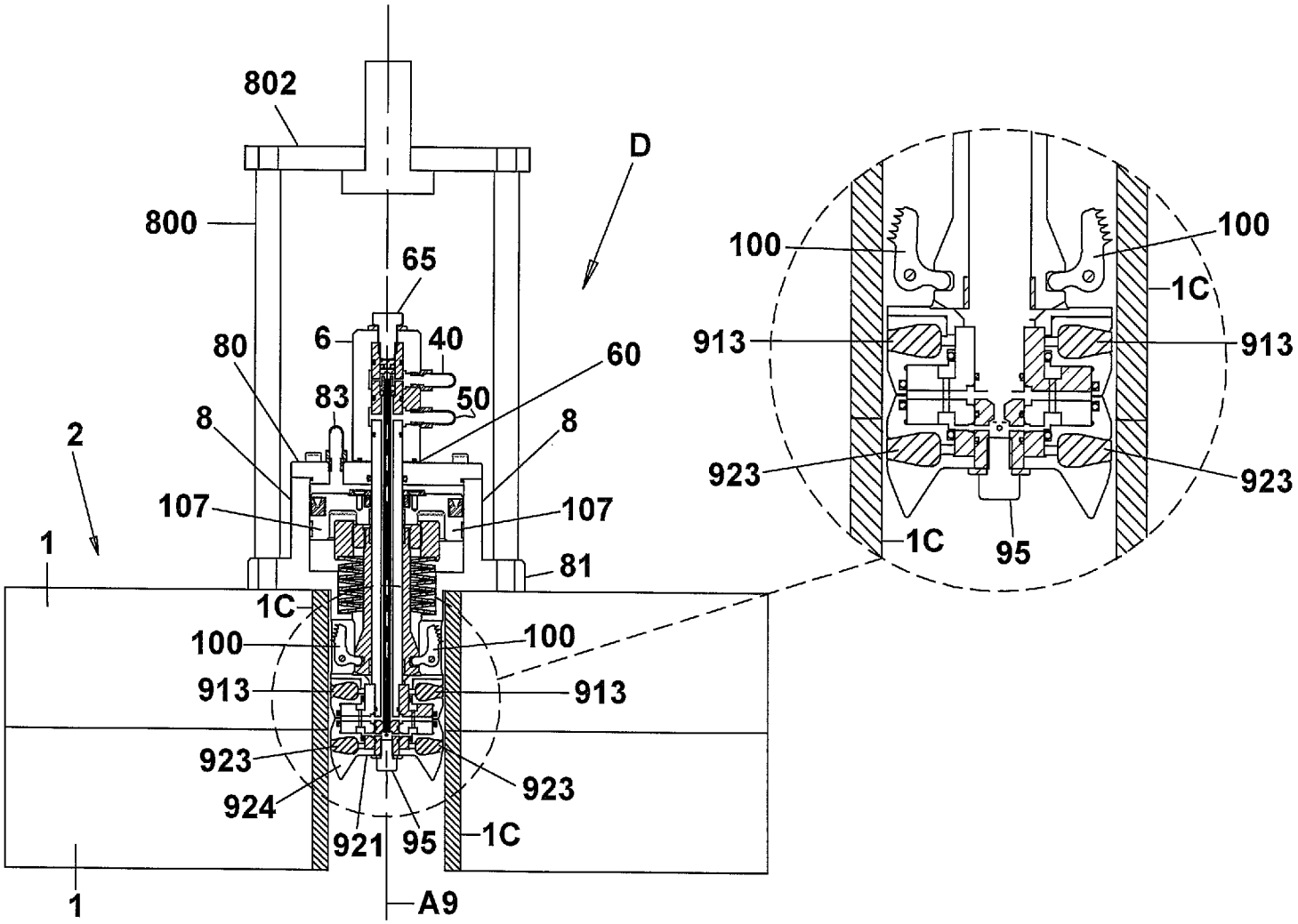
FIGS. 17-25 show construction details relating to possible embodiments of the device (D) for picking up the reels from the station (P)
Figure 18:
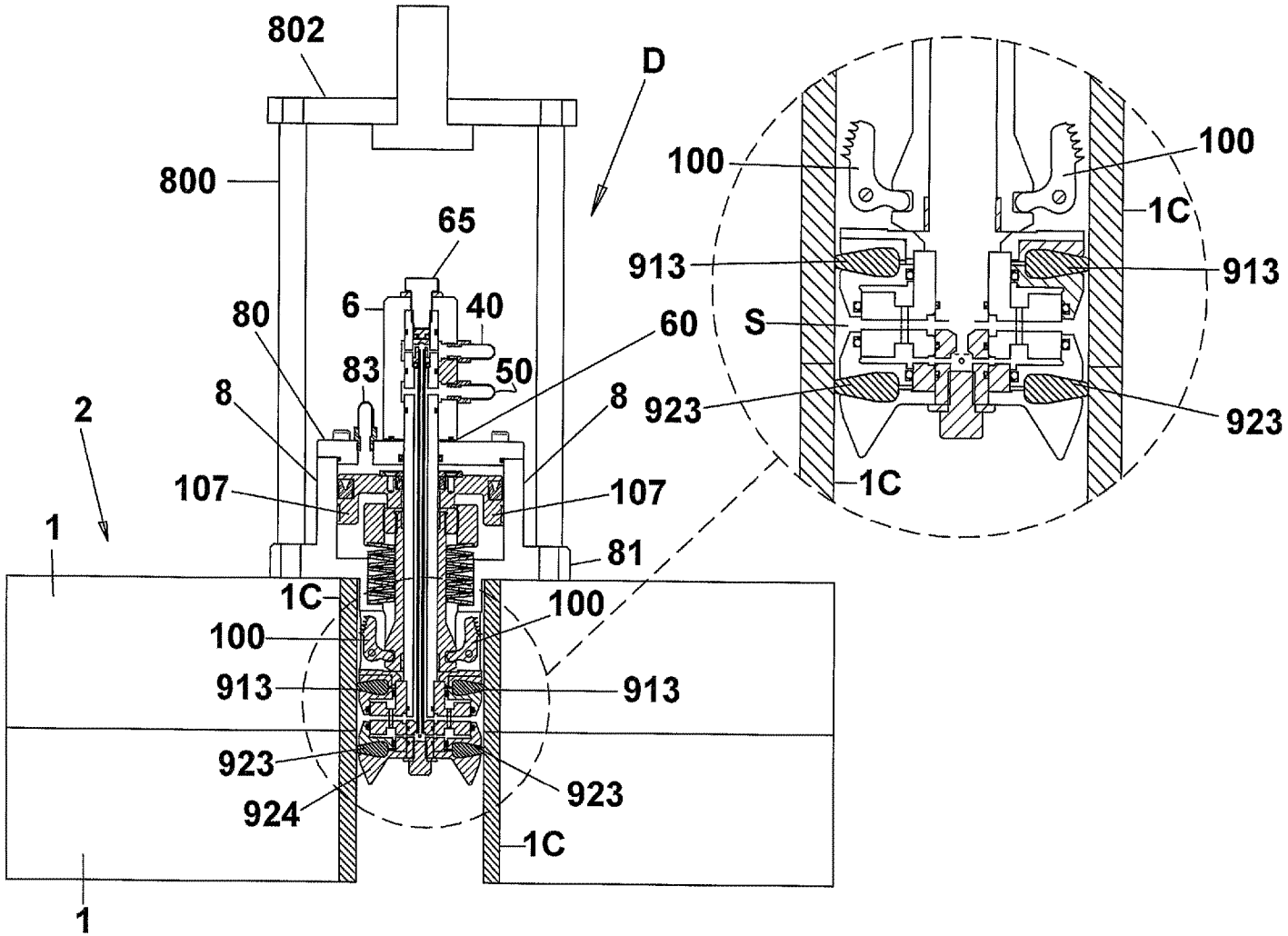
Figure 19:
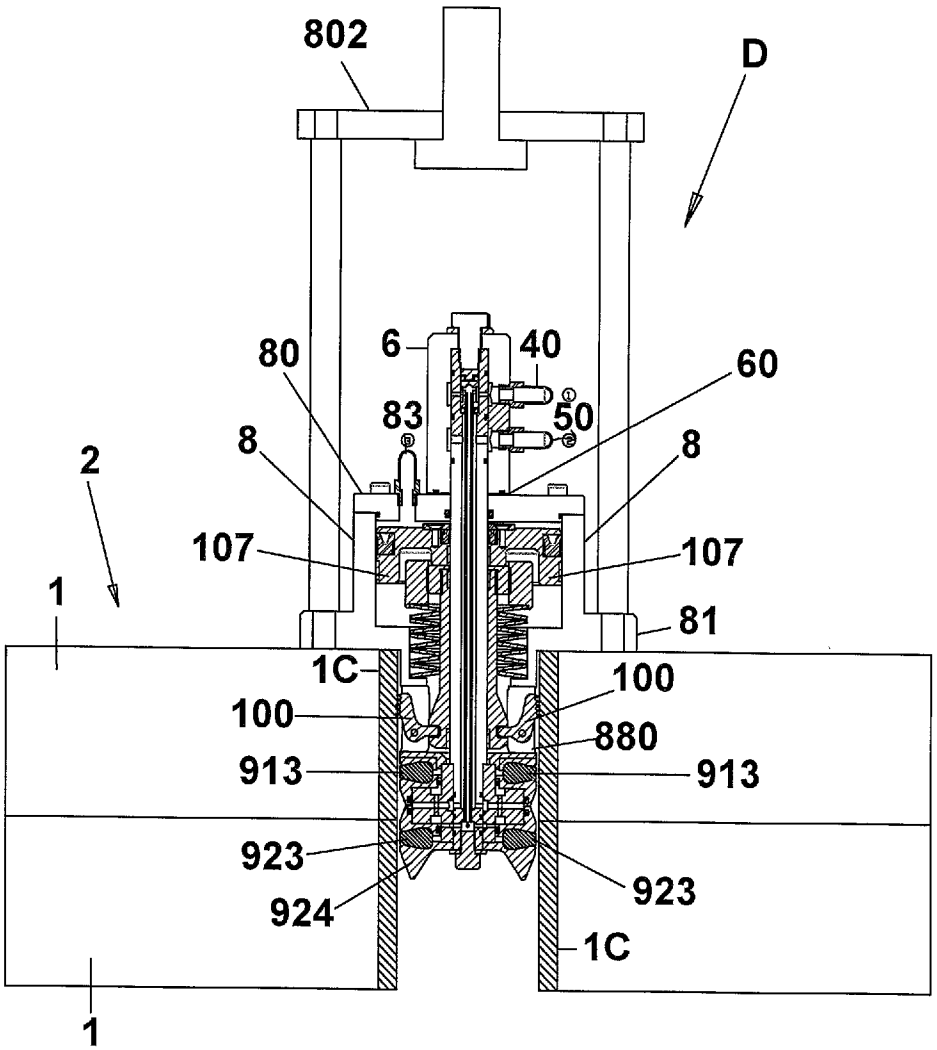
Figure 21:
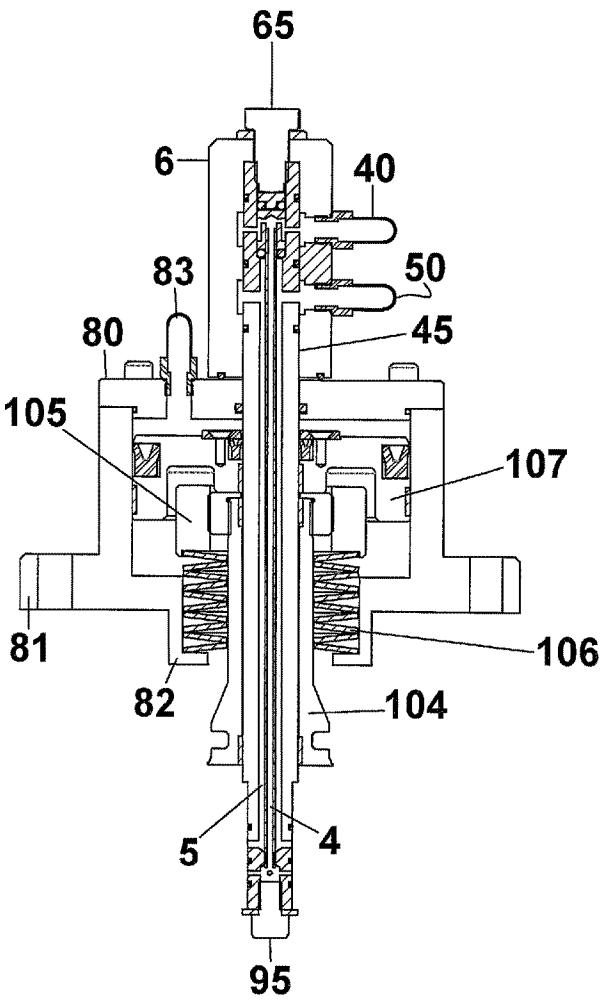
Figure 20:
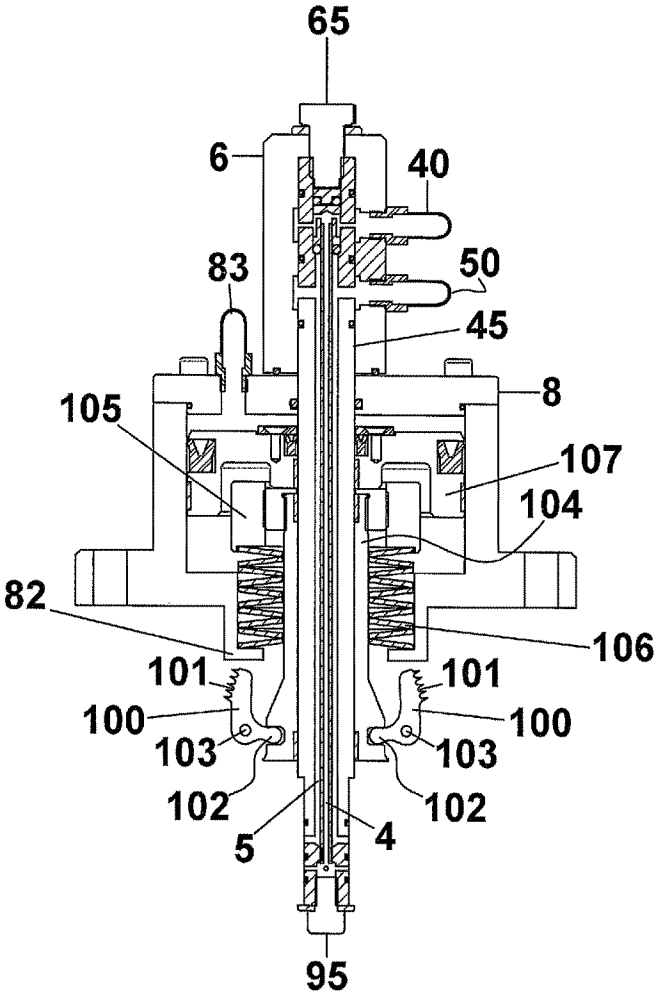
Figure 23:
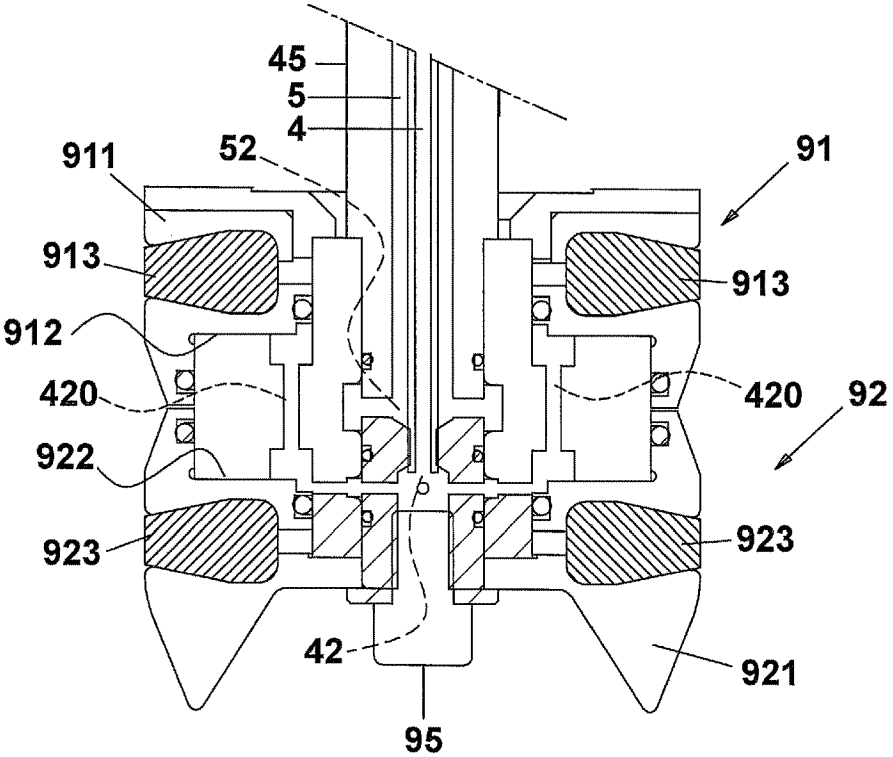
Figure 22:
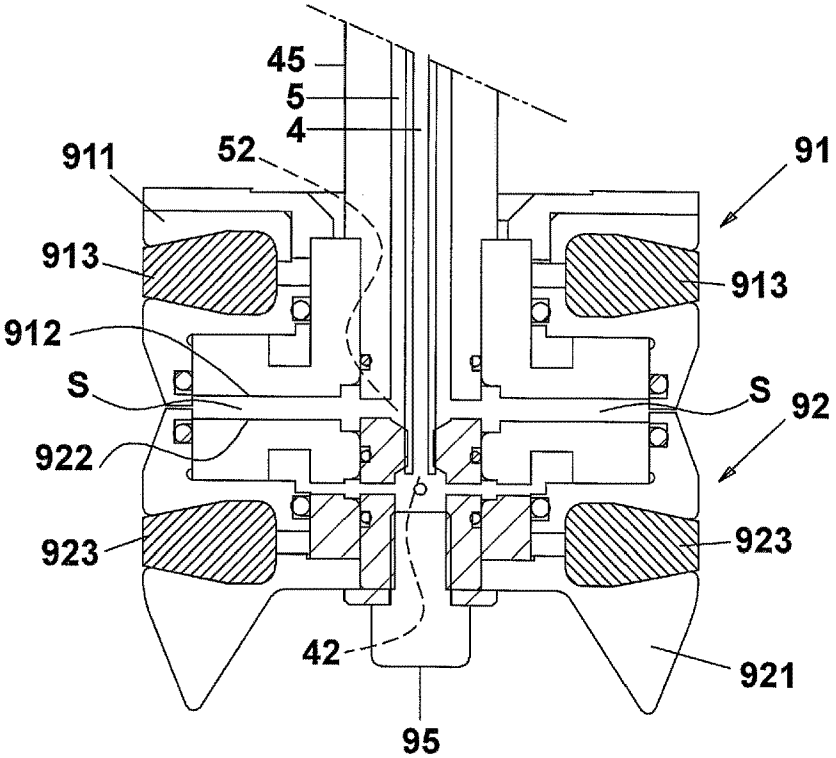
Figure 25:
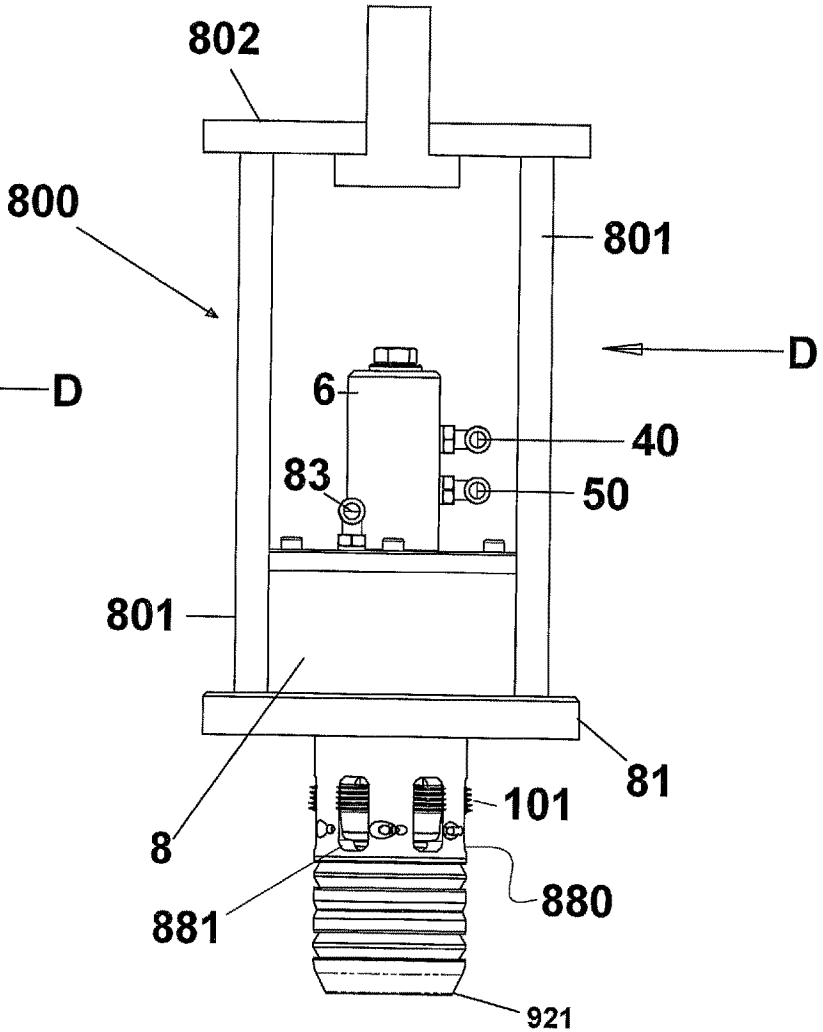
Figure 24:
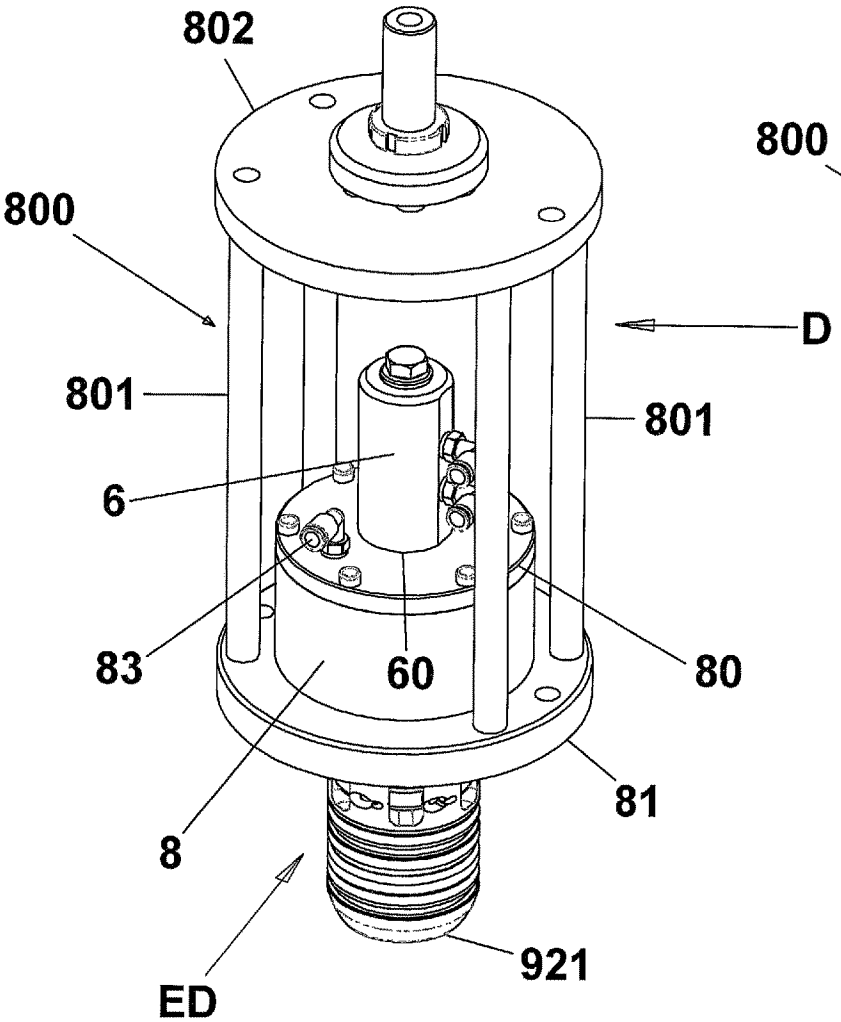
Figure 26:
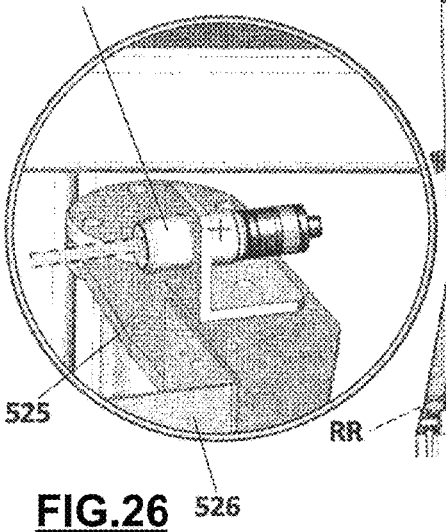
FIGS. 26-34 are perspective views of parts of a plant according to the present invention.

A vertical axis pneumatic actuator (514) is constrained to the lower face of the lower plate (504) of the arm (500) by means of a corresponding bracket (515) which has a vertical portion integral with the lower face of the plate (504) and a horizontal portion on which the actuator (514) is fixed. The stem of the latter passes through a hole formed in the horizontal part of the bracket (515) and a horizontal plate (516) is fixed on the same stem which, consequently, can be placed in a raised position (position in which it is at the same height of the lower plate 504 of the arm 500) and a lowered position (position in which it is at a lower height than the plate 504). In other words, the actuator (514) controls the lowering and lifting of the plate (515). The latter is constrained to a vertical guide (520) integral with the lower face of the lower plate (504) of the arm (500). Mounted on the upper face of the plate (515) is an idle roller with a vertical axis (517) and an arm (518) on which a photocell (519) is mounted, the function of which is described below. The arm (518) is constrained by means of a pin with a vertical axis on the upper face of the plate (515) and can rotate around this axis being enslaved to a respective actuator (522) supported by the same plate (515). In this way, also the group formed by the idle roller (517) and the arm (518) is enslaved to the actuator (514). In FIGS. 13A-13B the plate (516) is raised, while in FIGS. 13C-13D the same plate is in the lowered position. Preferably, two horizontal wheels (521) are mounted near the free end of the arm (518).

A photocell (523) is mounted to the side of the aforesaid position (Y) and is configured to optically detect the diameter of the reel mounted on the support (403) which occupies said position.

Said photocell (523) is mounted on a corresponding column (524) which supports it at a suitable height for said detection by means of a bracket (525). Mounted on the same bracket (525) is a plate (526) spaced by a predetermined value from the photocell (523). The column (524) is arranged downstream of the position (Y) with respect to the direction of rotation (RG) of the carousel (G).

The reference "CV" in the drawings indicates a hollow column through which electrical cables and compressed air ducts connected to the various actuators described above pass.

Procedures which can be carried out by means of an implant according to the present invention are described below using reels (1) on the lateral surface of which, in a per se known manner, a piece of double-sided adhesive tape (BA) is applied. Preferably, the double-sided tape (BA) is applied near the initial edge of the reel itself so as to also perform the function of keeping this edge adhering to the underlying material of the reel until the moment in which the reel must be used to feed tube-forming machine, or until the time of the joining phase described below.

Stack (2) Centering

Once the stack (2) has been positioned on the platform (PP), the photocells (CFX, CFY) detect the actual position of the stack itself by detecting the aforementioned distances (a, b, c, d) and, through the control unit (CU), command the actuators (PMX, PMY) to move the platform (PP) so that it is (a=b) and (c=d). Subsequently, when the highest reel (1) of the stack (2) is picked up, the device (D) is lowered to determine the entry of its conical part (924) into the core (1C) of this reel. If the axis (AC) of the reel (1) is not aligned with the axis (A9) of the device (D), this condition is detected by the tilt detection mechanism (D), which in this case oscillates on the joint (J1), and the platform (PP) is moved along the aforementioned directions (x, y) by means of the actuators (PMX, PMY), according to the readings of the photocells (FX, FY), until the axes are aligned (AC) and (A9), that is until an alignment condition is achieved between these axes which allows the insertion of the engagement part (PD) of the device (D) in the cores of the underlying reels.

Initial Drawing-In Phase of the Strips

In an initial phase of operational setup of the plant, the strips fed by the reels (1) present on the supports (403) that occupy the "W" positions are inserted manually between the roller (517), the surface (513) and the roller (508) and passed on a series of guide rollers (RR) arranged along a predefined path which develops between each unwinding unit and the tube fed by the unwinding unit itself. Said guide rollers (RR) are bound to fixed structures (RS) specially arranged on the sides of the unwinding station. The said initial drawing-in phase is performed with the plate (516) placed in the lowered position by the actuator (514) and with the arm (500) arranged in a position spaced from the respective carousel (G). It goes without saying that this drawing-in operation is performed in an initial setup phase of the plant.

Intervention of the Pick-Up and Handling Device (D)

When the lower part of the pick-up and handling device (D) is inserted through the cores (1C) of the highest reel of the stack and of the underlying reel, the reel detachment mechanism is activated by introducing compressed air which, by pressurizing the space (S) present between the plates (91, 92) of the device (D), favors the detachment of these reels. The removal of the upper reel of the stack (2) is determined by the intervention of the jaws (100) which engage the internal surface of the respective core (1C) or, alternatively, by the suction cup (300) which pneumatically engages the upper face of the reel from withdraw.

Subsequently, by moving the arm (200), the device (D) is raised to a predetermined height, while the arm (240) is rotated by the actuator (241) and the surfaces (243, 244) come into contact with the upper and lower faces of the reel engaged by the device (D).

Subsequently, the column (202) is rotated around the axis (A6) to bring the arm (200) into the unwinding station (U) above the unwinder which must receive the reel (1) taken from the stack (2). The subsequent lowering of the arm (200) determines the positioning of the reel (1) on an empty support (403), after this support has been placed in the aforementioned receiving position (W) and the respective pin (404) has been raised. After positioning the reel (1) on the support (403), the jaws (100)—or the suction cup (300)—release the reel and the arm (240) is made to rotate by the actuator (241) in the opposite direction to the previous one to definitively deliver the reel (1) to the support (403) for which it is intended. Then, with movements opposite to the previous ones, the device (D) is returned to the station (P).

FIGS. 4A-11B schematically illustrate the steps of picking up a reel and positioning it on a support (403) of the unwinding station (U).

As previously mentioned, preferably the lifting and lowering strokes of the arm (200), there is of the device (D), are each divided into two phases carried out by the sequential movement of the carriages (201) and (204).

The removal of the reels (1) from the stack (2) involves the vertical movement of each reel parallel to itself, in a horizontal position, that is, along a direction coinciding with the axis of the reel subjected to withdrawal. Similarly, the deposit of the reels on the supports (403) implies a vertical stroke of the arm (200).

The reels picking and handling cycle performed by the device (D) can be activated when the diameter of a reel (1) present on a support (403) of a carousel (G) in the respective position "Y" reaches a first value of preset control (1) present on a support (403) of a carousel (G) in the respective position "W".

Junction Strips Fed by Reels Present on Two Supports of a Carousel

In the following description, for greater clarity, the reel present on the support (403) which initially occupies the "Y" position will be identified with the reference "1Y" while the reel present on the support which initially occupies the "W" position will be identified with the reference "1W".

When a reel (1) taken from the stack (2) is delivered to the respective support (403) placed in the "W" position, the arm (500) is brought closer to the carousel (G) by rotating the arm itself around its axis (V5). In this phase, preferably, the operating speed of the corresponding tube-forming machine is reduced so that the step of joining the strips is performed at a reduced speed but without interrupting the feeding of the tube-forming machine. At the same time, the roller connection clutch (508) is activated and the gear motor (509) is activated so that the roller (508) is rotated about its respective axis (A8). The roller (508), coming into contact with the reel (1W) loaded on the support (403) placed in the "W" position and, rotating around its own axis (A8), determines the rotation of this reel around the pin (404). In addition, the control unit (CU) activates the actuator (522) which rotates the arm (518) so as to bring the photocell (519) closer to the reel.

The photocell (519) is used to detect the passage of the double-sided adhesive (BA) arranged on the external side of the reel delivered to the support (403) in the "W" position while the reel itself is rotated by the roller (508) around the respective pin. (404). Since the aforementioned rotation of the arm (500) determines the approach of the strip (SY) coming from the reel (1Y) to the reel (1W), to make the junction of the strip (SY) to the latter reel (junction necessary to ensure the continuity of the tube feed) it is sufficient to extract the pressure roller (505) by activating the respective actuator (507). Consequently, the strip (SY) of the reel (1Y) in the exhaustion phase sticks to the lateral surface of the reel (1W). Subsequently, the blade (510) is extracted to cut the strip (SY) of the reel (1Y) and the double-sided adhesive (BA) remains attached to the tail of the strip (SY) cut. After cutting the strip (SY) the surface (516) is lowered. At this point, the roller (508) is disconnected from the gearmotor (509) which in turn is deactivated, so that the roller (508) is again free to rotate idly around its own axis (A8) and normal speed operating of the tube-forming machine which is therefore fed with the strip (SW) coming from the reel (1W) is restored, while the arm (500) is returned to its starting position.

Carousel (G) Rotation

When the diameter of the reel (1W) reaches a predetermined value (for example 600 mm), the control unit (CU) activates the actuator (502) which determines the rotation of the carousel (G) around the axis (AU). The control unit (CU) commands the said rotation of the carousel (G) by receiving a control signal emitted by a photocell (527) placed on the arm (500) which detects the diameter of the reel (1W). During the rotation of the carousel (G) the reel (1W) continues to feed the tube-forming machine which uses the strip (SW) coming from the same reel. The rotation of the carousel (G) involves the passage of the same carousel near the motorized wheel (413) which in this phase is set in rotation: when the carousel (G) is in this position, the contact between the wheel (413) and the support (403) coming from the "Y" position determines the rotation of the support itself, in particular due to the contact between the wheel (413) and the disk (D40) of the support itself. This rotation of the support (403) implies the winding of the tail (TY) of the cut strip of the reel (1Y) on the reel itself. Then, the pin (404) of the support (403) which occupied the "Y" position is lowered so that the reel (1Y) is no longer bound to the carousel. During the rotation of the carousel (G), the reel (1Y) no longer bound to the carousel (G) is intercepted by the plate (526) and therefore falls into an underlying container (RC) from which it can then be recovered for recycling. Subsequently, while the carousel (G) continues to rotate, the arm (500) is temporarily brought towards the carousel (G), so that the strip of material unwinding from the reel (1Y) comes into contact with the surface (513), and the surface (516) is raised with the roller (517). Thereafter, the arm (500) is returned to its initial position spaced from the carousel so that. Therefore, the path of the web that takes place from the reel directed towards the "Y" position is such as not to interfere with the positioning of another reel on the other support of the carousel. The rotation of the carousel continues until the support that previously occupied the "Y" position reaches the "W" position to be ready to receive another reel. Ultimately, at the end of the rotation of the carousel (G), a rotation of 180° in the example shown in the drawings, the positions (Y, W) of the supports (403) are swapped, so that in the "W" position an empty support, ie ready to receive a new reel taken from the stack (2), while in the "Y" position there is another support with a reel that continues to feed the tube-forming machine. The described sequence is represented in FIGS. 15A-15I and 16L.

Rotation of Two Carousels (G) Arranged in the Unwinding Station

If two carousels (G) are arranged in the unwinding station, both served by the device (D), an arrangement is preferably made comprising a right carousel and a left carousel with respect to the device for picking up the reels from the stack arranged on the platform (PP) as represented in FIGS. 16A-16I and 16L-16N. In this case, the two rides are independently controlled. The carousel on the left works and is controlled as described above with reference to the example shown in FIGS. 15A-15I and 15L. The right carousel works in the same way but in a phase of the transfer of the empty support (403) towards the "W" position (FIG. 16M) a vertical axis roller (421) intervenes which widens the trajectory of the web that unwinds from the reel present on the other support. The roller (421) is a roller with a vertical axis mounted idle on a respective pin mounted on an arm (422) enslaved to an electric actuator (423) which determines its positioning in active position (FIG. 16M) and respectively in inactive position (FIGS. 16A-16I and 16L-16N). In FIGS. 16A-16I and 16L-16N the arrows "1T" and "2T" indicate the direction of the webs that take place from the reels supported by the two rides and which are each intended to feed a corresponding tube mill.

With reference to FIGS. 35-43 of the attached drawings, the supports for the reels in the unwinding station are formed on vertical carousels, that is, carousels with a horizontal rotation axis. In this case, the orientation of the arm (500) is also modified, which is configured to rotate around a horizontal axis. Furthermore, in this case the device (D) for picking up and moving the reels (1) is configured to force the reels themselves to rotate by 90° to change their orientation from horizontal to vertical after they have been withdrawn from the stack (2) and to guide the descent towards the respective vertical rides. More particularly, the aforesaid arm (200) is rotatably mounted on the carriage (201) by means of a horizontal shaft interlocked with a rotary actuator (220). In the example shown in FIGS. 35-43 the device (D) is equipped with the suction cup (300) to engage the reels (1). When taken from the stack (2), the reels (1) are in a horizontal position, as in the example described above. After its picking up from the stack (2), each reel is rotated by 90°, by means of the rotation of the arm (200) controlled by the actuator (220), whereby the orientation of the reel passes from horizontal to vertical. Said change in orientation of the reel (1) can be performed both when the reel (1) engaged by the device (D) is above the stack (2), that is, it is still in the station (P), and when the reel (1) engaged by the device (D) is located in the unwinding station (U) following the aforementioned rotation of the platform (206) controlled by the actuator (207). When the reel (1) is above the carousel (G) that is to receive it, the device (D) is lowered towards the carousel itself in order to arrange the reel at a height useful for its placement on the carousel, the latter being positioned in a suitable position to receive the reel. The beam (400) of the carousel (G) is mounted on a corresponding support (600) so that it can rotate around its central axis which is horizontal. The rotation of the beam (400) is controlled by the gearmotor (MR4). In this way, similarly to the example described above, the supports for the reels can be arranged in a position (W) for the initial loading and unwinding of the reels and a position (Y) for unwinding and exhausting the reels. In this case, however, the supports for the reels consist of pins (404), each of which can be arranged in the extracted position and respectively in the retracted position by means of an actuator (not visible in the drawings) placed on a rear face of the beam (400). Also in this case a movable support (500) is provided on which the means for junction the reels are mounted, the movable support (500) being configured and controlled to approach the reel loading position (W) and move away from this position respectively and being activated when the mobile support is approached to the position (W) for loading the reels. The mobile support (500) in this case rotates around a horizontal axis (A5) by means of a pneumatic actuator (A50) constrained on one side to a support (A51) which also supports the arm (500) and, on the opposite side, to a rear part of the same arm. The arm (500) is also equipped with a pressure roller (505) arranged in an intermediate position between the rotation axis (A5) and a free end of the arm. For example, the pressure roller (505) is mounted idle on a lever (L5) controlled by a pneumatic actuator (A52) and pivoted with a horizontal axis on the arm (500) in such a way that the pressure roller (505) can be arranged in extracted position with respect to an internal side of the arm (500) and respectively in the retracted position depending on the activation or deactivation of the actuator (A52). The rotation axis of the pressure roller (505) is parallel to the axis (A5) of rotation of the arm (500). The drive roller (508) controlled by the respective gearmotor (509) is mounted on the free end of the arm (500). The gearmotor (509) is activated to control the rotation of the drive roller (508) in the reels exchange step as further described below. The axis of rotation of the drive roller (508) is parallel to the axis (A5) of rotation of the arm (500). The blade (510) is also mounted on the free end of the arm (500). The latter is arranged on a lever (L10) pivoted with a horizontal axis on the arm (500) and controlled by a corresponding pneumatic actuator (A10) on the opposite side of the blade (10) with respect to the rotation axis of the lever (L10). The rotation axis of the lever (L10) is parallel to the axis (A5) of rotation of the arm (500).

Figure 35:
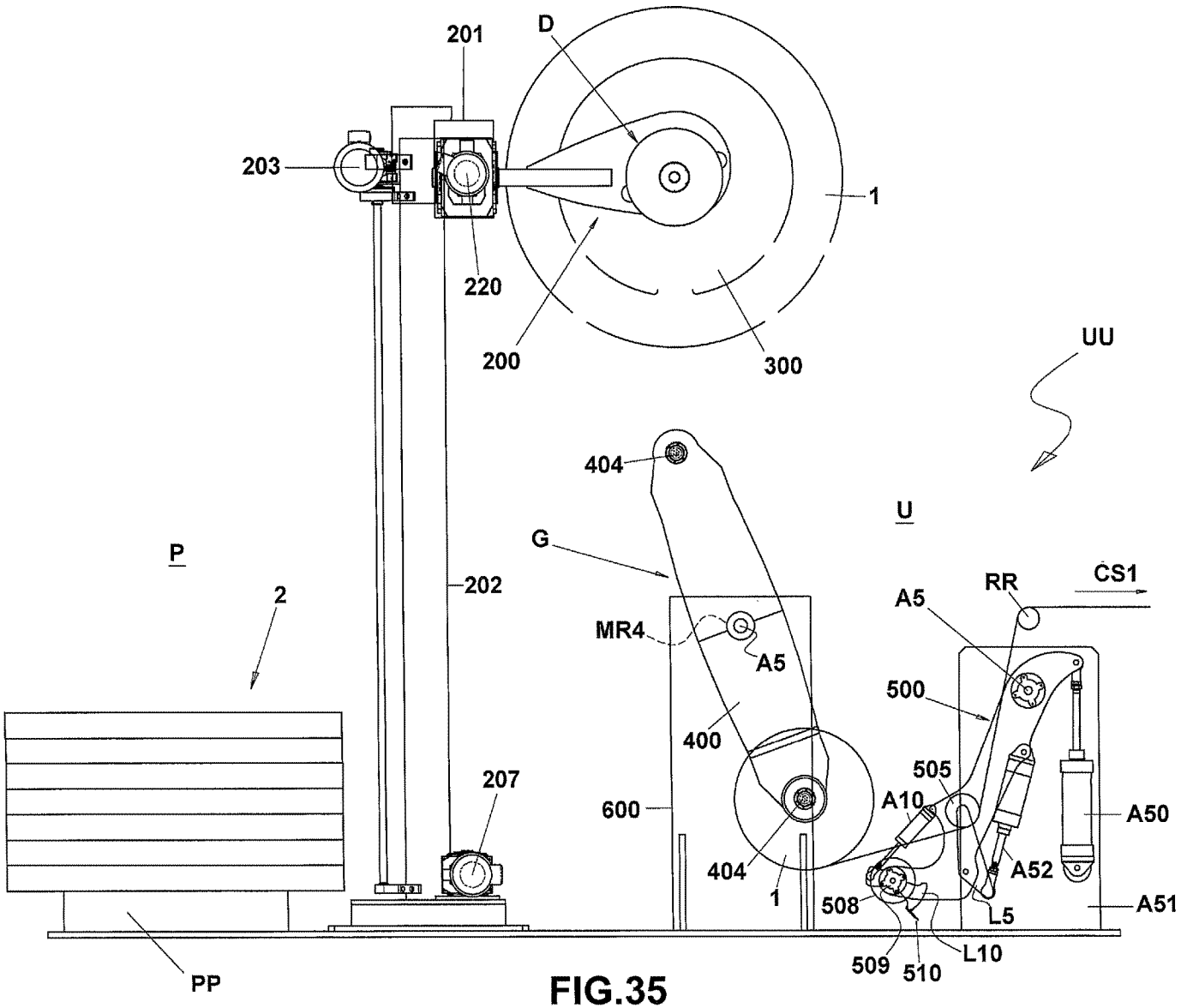
FIGS. 35-41 represent a further example of embodiment of a plant in accordance with the present invention.
Figure 36:
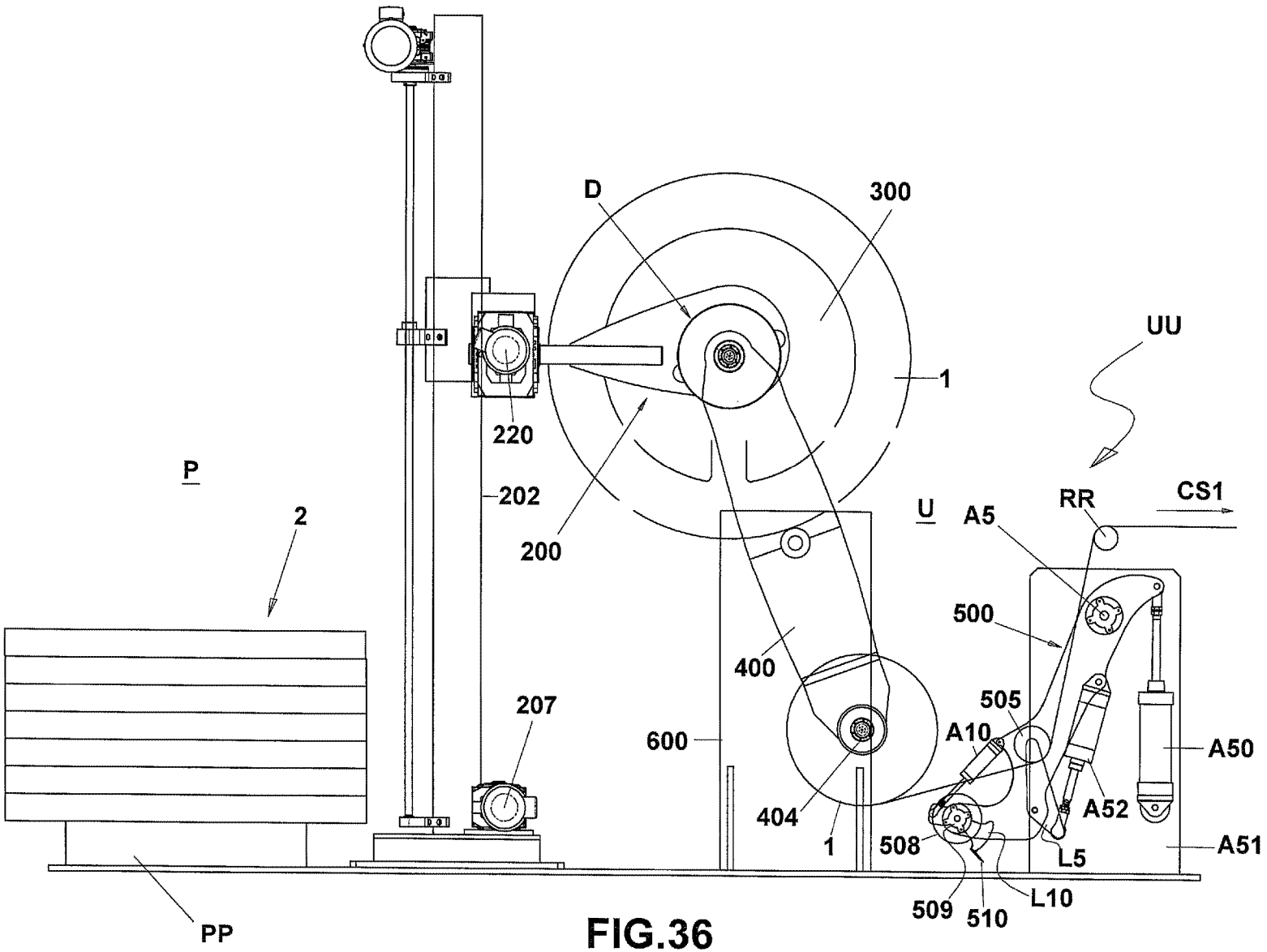
Figure 37:
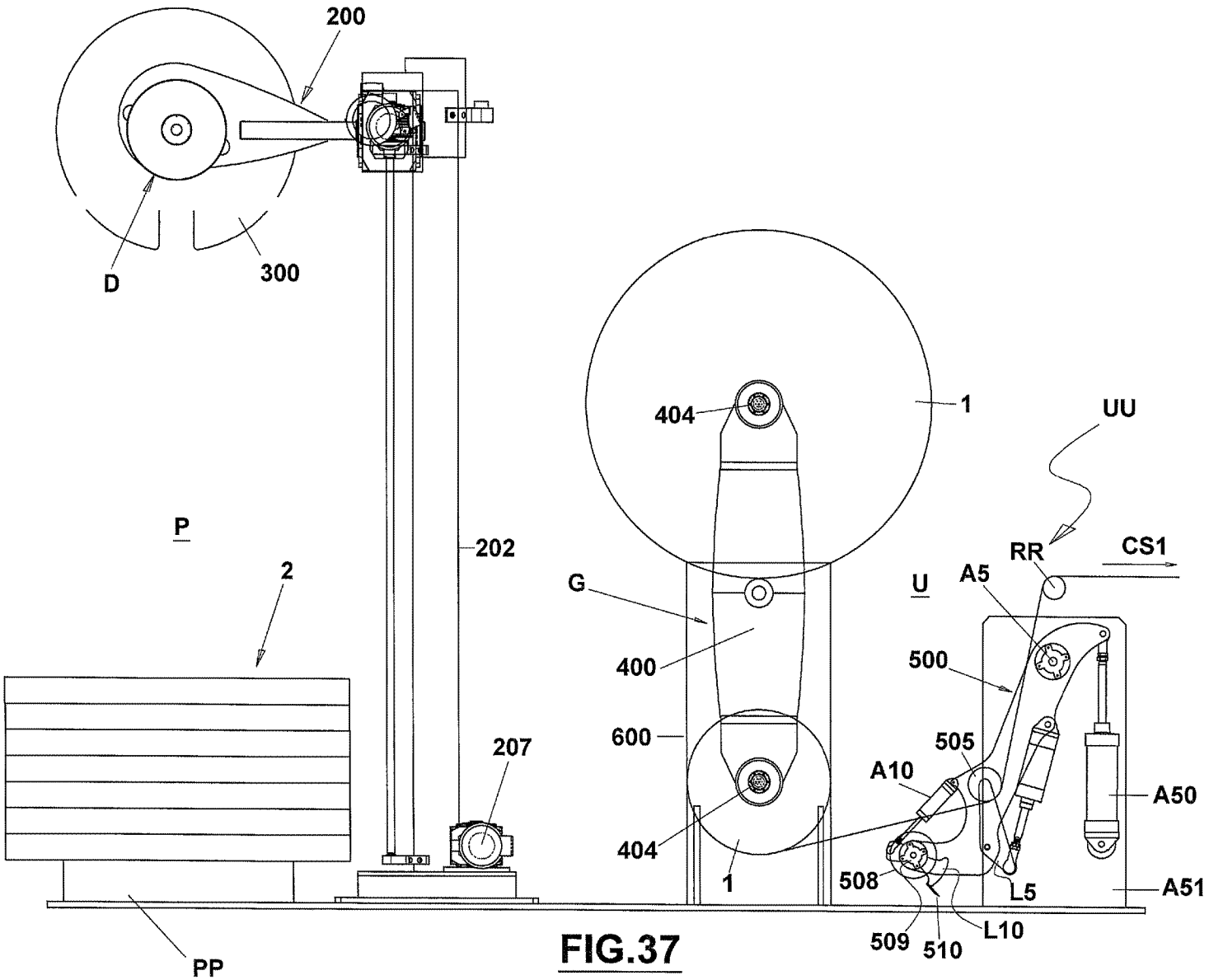
Figure 38:
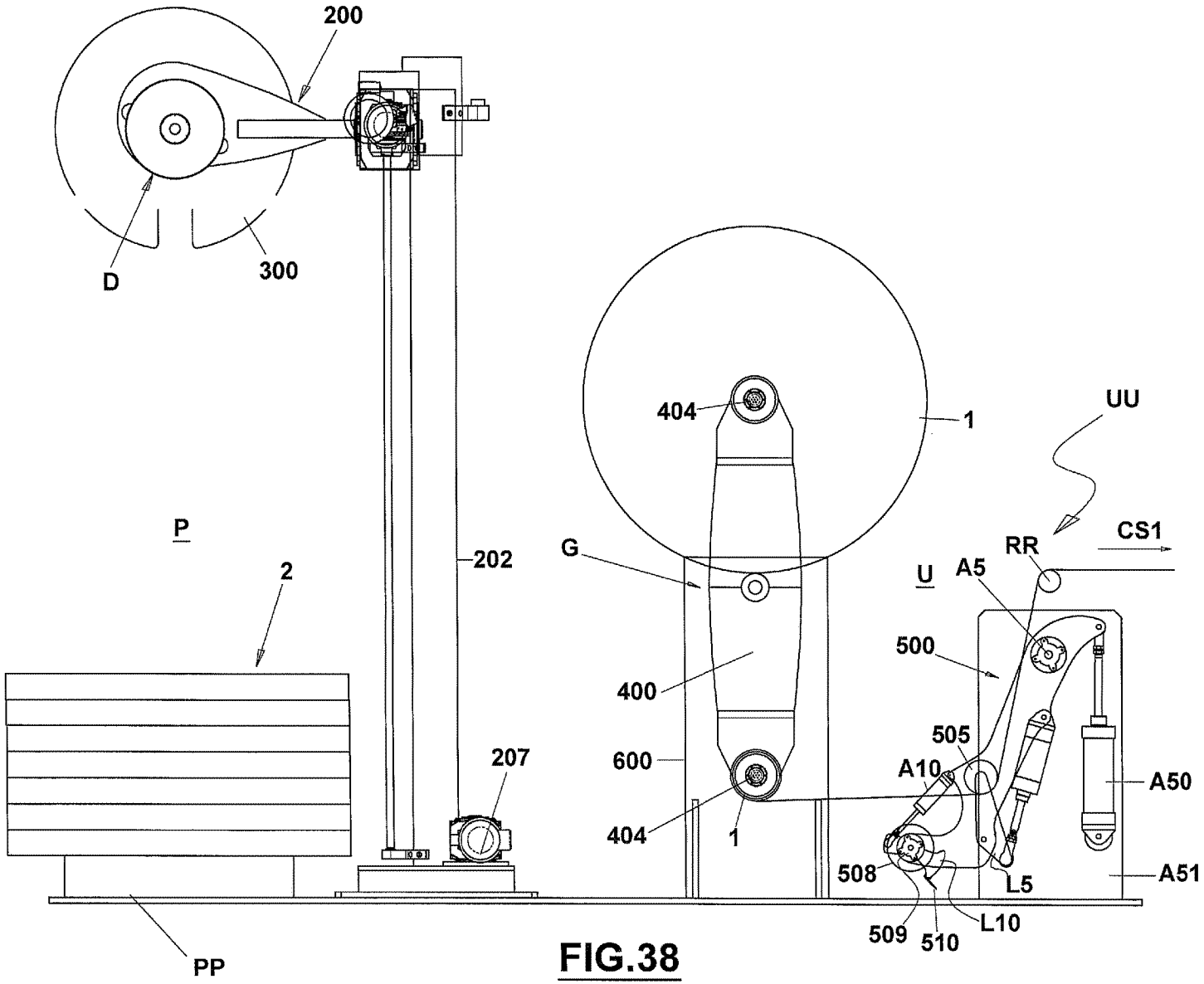
Figure 39:
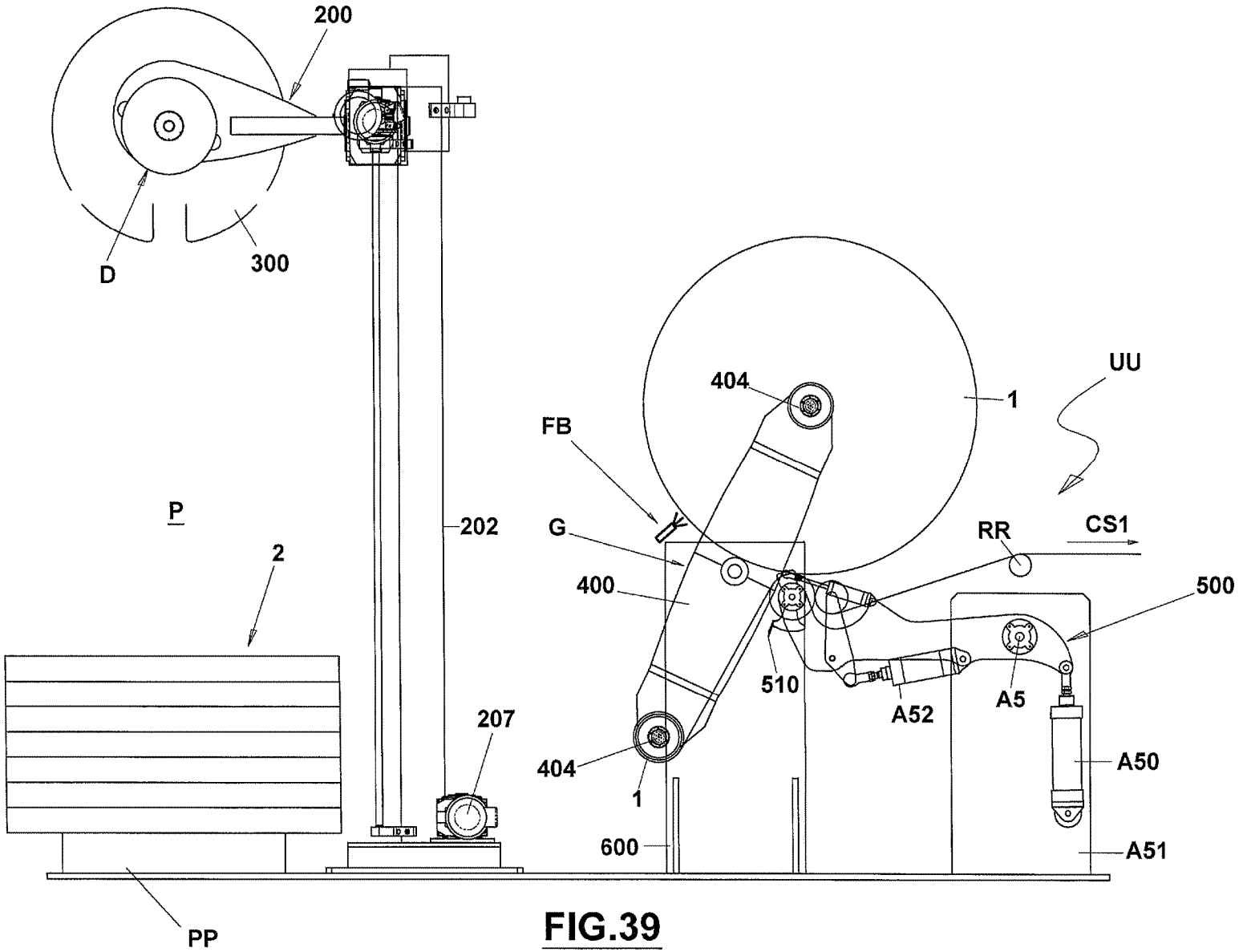
Figure 40:
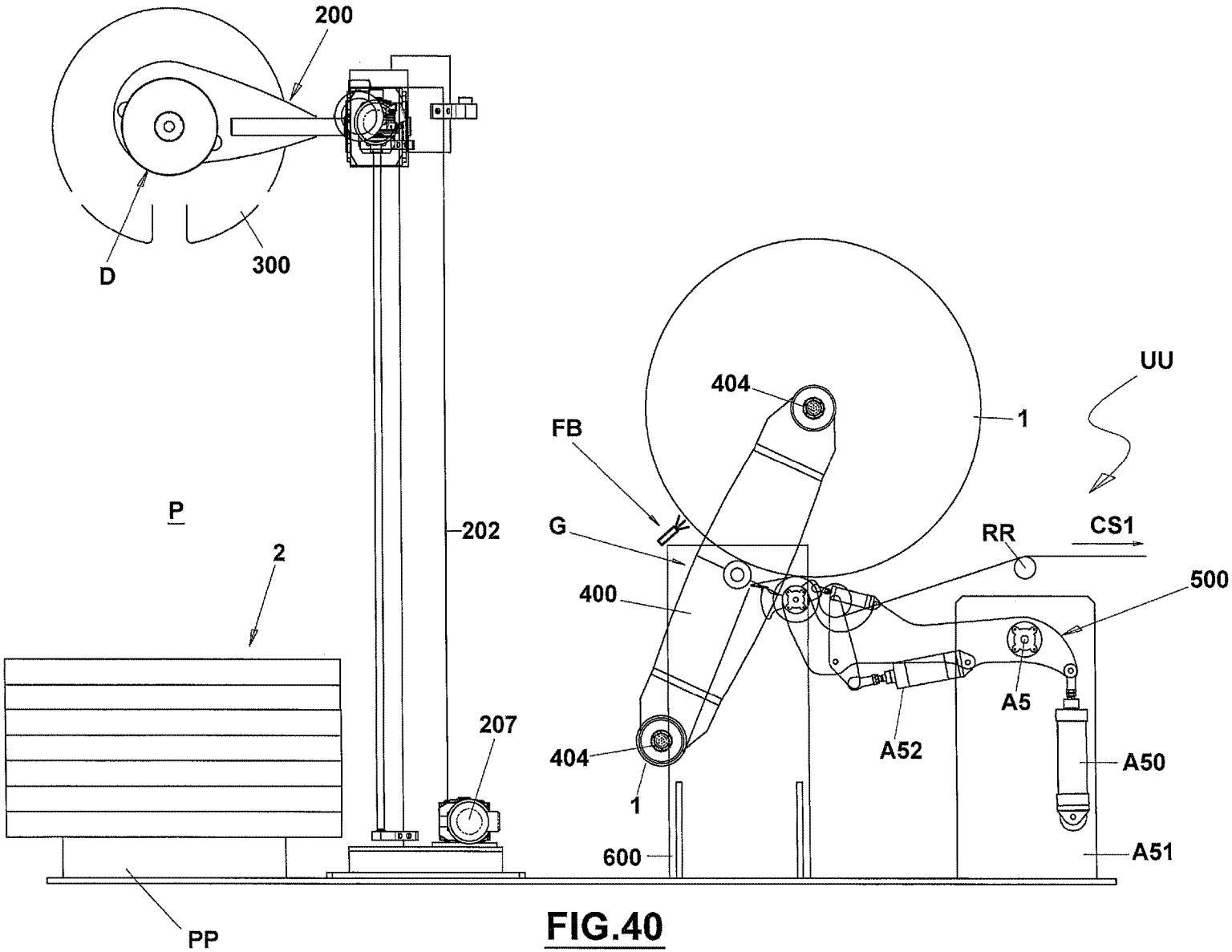
Figure 41:
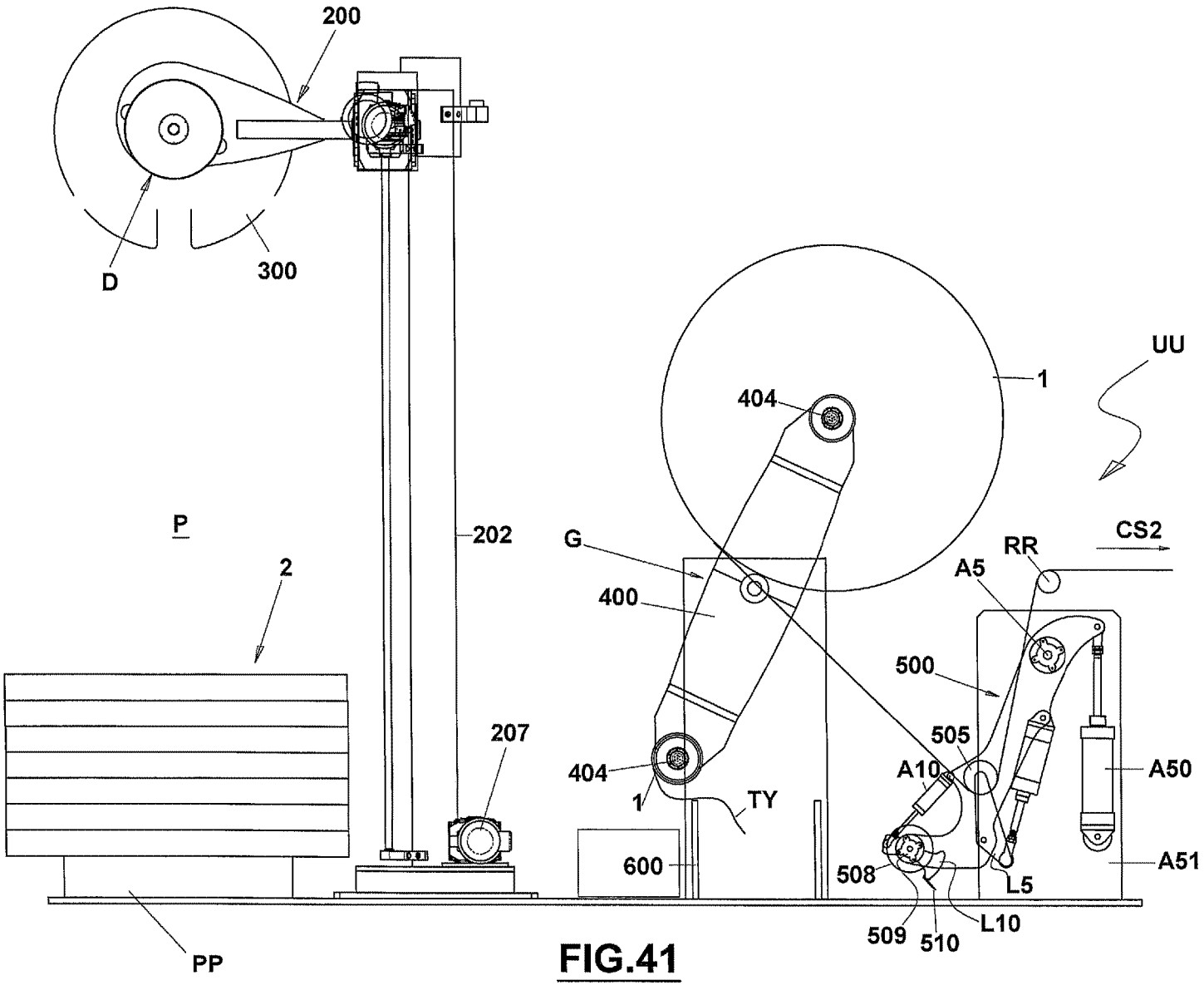
Figure 43:
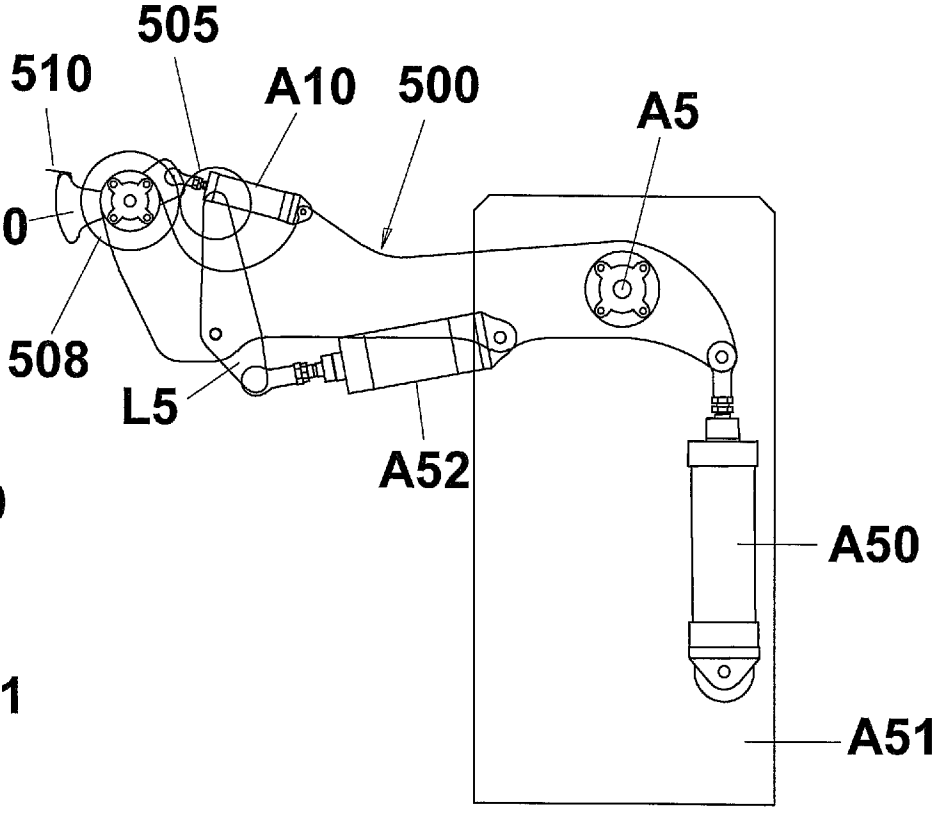
FIG. 43 represents a detail of FIG. 39.
Figure 42:
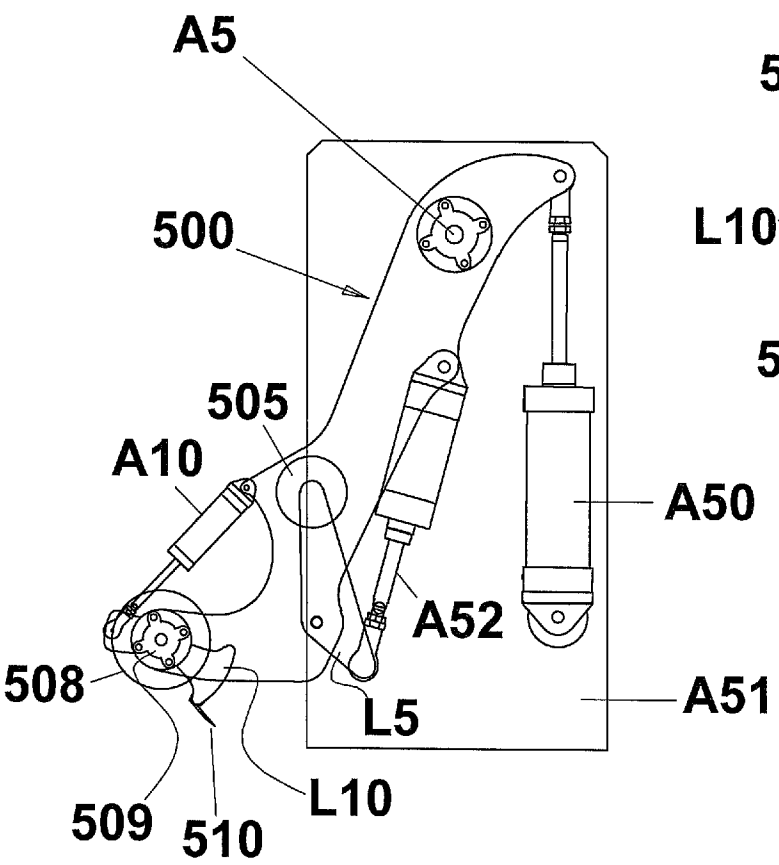
FIG. 42 represents a detail of FIG. 35.
Figure 45:
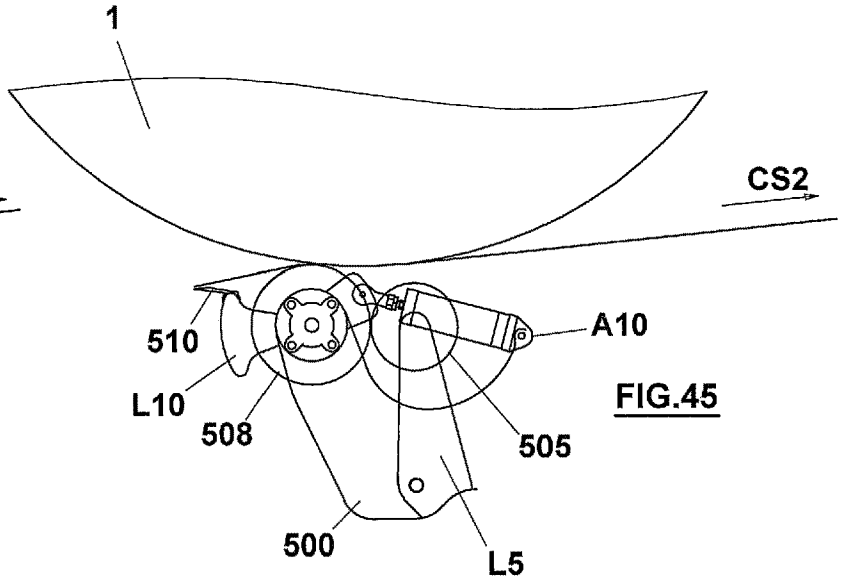
FIG. 45 represents a detail of FIG. 40.
Figure 44:
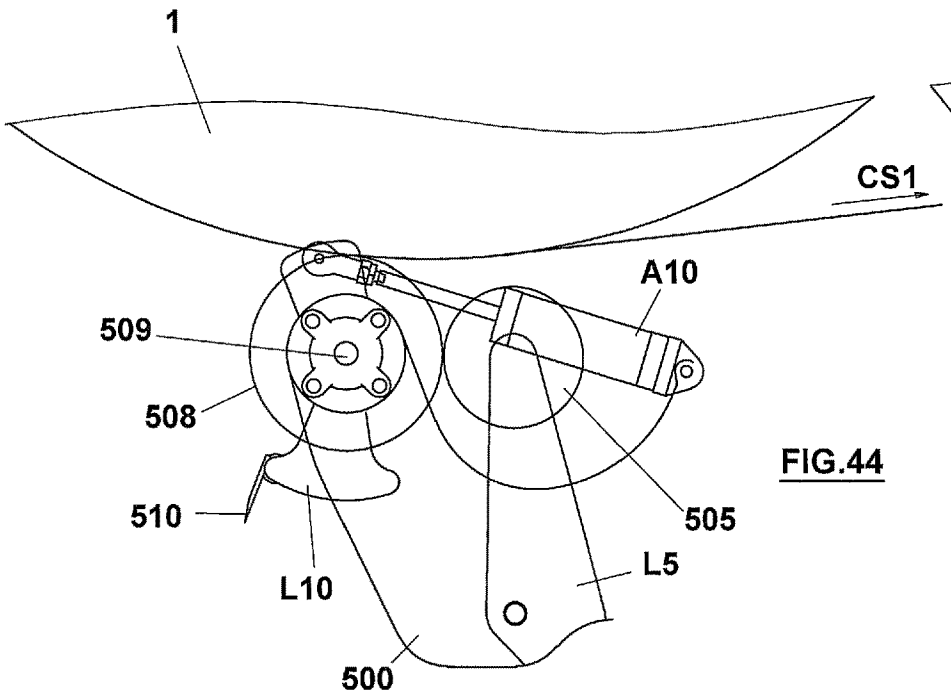
FIG. 44 represents another detail of FIG. 39.

FIGS. 35-41 illustrate a sequence of operating steps that can be carried out by means of a system configured in this way. In FIG. 35 a reel (1) present in an unwinding position supplies a respective tube mill with the cardboard strip (CS1) while it is supported by the beam (400) through the corresponding pin (404), the arm (500) is spaced from the carousel (G) and the device for picking up and moving the reels has already picked up a reel (1) from the stack (2) placing it in the station (U) rotated by 90°. In FIG. 36 the device for picking up and moving the reels has placed the reel (1) in correspondence with the other pin (404) of the carousel (G) which is subsequently extracted for the final delivery of the reel to the carousel. In FIG. 37 the device for picking up and moving the reels has been brought back above the stack (2) and the beam (400) has been placed in a vertical position, while the reel from which the web is unwound (CS1) continues to feed the web itself. In FIG. 38 the reel from which the web is unwound (1T) is almost exhausted. In FIG. 39 the beam (400) has been rotated by a predetermined angle clockwise and the arm (500) has been raised, that is, brought closer to the carousel (G). In this position, the drive roller (508) contacts the new reel. The rotation of the drive roller consequently determines the rotation of the new reel on the respective pin (404). In this phase, the depleting reel continues to feed the strip (CS1). The drive roller (508) also acts as a presser to determine the junction of the cardboard strips of the two reels by means of double-sided adhesive similarly to what is described in reference to the previous example. The passage of the double-sided adhesive applied to the external side of the new reel is detected by a photocell (FB) placed on a relative mobile support (not visible in the drawings) which allows the same photocell to be placed in a position in which it, when not used, does not interfere with the handling of the elements described. In FIG. 40 the blade (410) has been placed in the cutting position of the cardboard strip supplied by the reel in the exhaustion phase. In FIG. 41 the new reel supplies the cardboard strip (CS2) to the respective tube mill while the exhausted reel is on the respective pin (404). These phases are repeated cyclically. Also in accordance with this further embodiment, the unwinding unit (UU) comprises several supports (in this example the pins 404) mounted on a structure (G) controlled and moved to arrange cyclically said supports in correspondence with several positions which include a predetermined position (W) for loading the reels and a different predetermined position (Y) for exhaustion of the reels. Furthermore, also according to this embodiment example, the position (Y) of exhaustion of the reels is also an intermediate unwinding position, ie a position in which the reels are unwound until they are exhausted. In this example, unlike the example previously described, the reels loading position is not also an initial unwinding position.

In practice, in accordance with the present invention it is possible to carry out a process comprising a continuous cycle controlled by automatic control means in which, while a reel takes place on a relative support, another reel can be positioned on another support and the supports for the reels they are moved cyclically by respective mechanical handling means to occupy at least a predetermined loading position and at least a different predetermined exhaustion position, in which the loading position can also be an initial unwinding position and the exhaustion position is also an intermediate unwinding position in which the reels unwind until they run out, and in which means configured to junction an end portion of a reel in the phase of exhaustion with an initial portion of a new reel arranged in the position loading. This combination ensures, at the same time, the continuity of the power supply of a tube mill with the webs carried out by the said reels and the possibility of using automatic loading means to load the reels in the said predetermined loading position.

Preferably, a position (Z) for automatic unloading of the exhausted reels is formed between the exhaustion position and the loading position.

Preferably, the continuous cycle achievable by means of a system in accordance with the present invention contemplates the use of automatic loading means to create a fully automatic cycle of loading the unwinding station and continuous feeding of the tube mills.

Furthermore, preferably and in accordance with what has been described above, the junction of the webs coming respectively from the reels in the depletion phase with the webs coming from the new reels arranged in the loading position are means configured to perform the aforementioned junction without interrupting the power supply of the tube mills, that is, means configured to perform the "on the fly" junction of the webs while the le reels involved rotate around their respective axes.

Preferably, said junction means are mounted on a mobile support (in the example described above, the arm 500) configured and controlled to approach said support structure of the reels in the unwinding station and respectively move away from said structure. Preferably, the junction means are activated when the said mobile support is approached to the said support structure of the reels in the unwinding station, so that the junction of the said webs takes place in correspondence with the loading position of the new reels, or in correspondence with a different position from the position of exhaustion of the reels.

Preferably, the said junction means comprise a pressure roller adapted to exert a pressure on the parts to be joined when the passage of a portion of adhesive material arranged on the new reel is detected, this detection being performed by detection means mounted on the said movable support. Preferably, the adhesive material is a double-sided web strip.

In accordance with what has been described, preferably the step of loading the reels by the automatic loading means is preceded by a step of preparing a stack of reels on a mobile platform whose position with respect to the automatic loading means is controlled and possibly modified in a horizontal plane (x, y) by means for detecting an initial position of the platform and, preferably, also by means for detecting the instantaneous position of the automatic loading means with respect to the position of the stack arranged on said platform. Preferably, the position of the platform in the said plane (x, y) is controlled by detecting the position of a central axis (AC) of the said stack of reels with respect to an axis (A9) of the automatic loading means.

Preferably, said platform is connected to two electric actuators (PMX, PMY) configured and controlled to move the platform along two mutually orthogonal directions of said plane (x, y).

In accordance with what has been described above, the automatic means for loading the reels are preferably configured to provide an integrated unit comprising pneumatic means intended to pressurize a space (S) inside the stack of reels, in which said space includes the interface between a reel higher than the stack and the reel below, and mechanical or pneumatic gripping means configured and controlled to respectively grip and release the highest reel in the stack.

Preferably, said integrated unit is a unit attached to an arm (200) movable along a predetermined path comprised between the station for depositing the stack of reels on said platform and the station for unwinding the reels.

In accordance with what has been described above, the automatic means for loading the reels can be configured and controlled to perform the withdrawal of the reels from the stack arranged on the platform, their movement along the said path, and the positioning of the reels in the unwinding station, always keeping the reels in horizontal order, that is with the central axis of the reels always oriented vertically. Alternatively, the automatic means for loading the reels can be configured and controlled to perform the withdrawal of the reels from the stack arranged on the platform, their movement along the said path, and the positioning of the reels in the unwinding station, keeping the reels in a horizontal position, that is, with the central axis of the reels oriented vertically along an initial part of said path and to rotate the orientation of the reels by 90° at the end of said initial part of the path. More generally and in accordance with the examples described, in the initial phase of withdrawing the reels (1) from the stack (2) the orientation of the reels themselves is maintained. In practice, in the initial phase of picking up the reels from the stack, the orientation of the reels presented at the time of positioning the stack in the reel picking station (P) is preferably maintained.

In accordance with what has been described above, the automatic means for loading the reels can be provided with an additional device for reversible coupling of the reels to the same automatic loading means to prevent any detachment of the reels in the event of malfunctioning of the mechanical or pneumatic gripping means. Said additional gripping device is reversible since it also allows the previously hooked reels to be released. In the example described above, the said additional reversible coupling device includes the arm (240) controlled by the pneumatic actuator (241) and the fork (243).

In accordance with what has been described above, said path can be configured to comprise a first vertical stroke for lifting the reels, a second horizontal stroke along a circular arc and a third vertical stroke for descending the reels.

Again, in accordance with what has been described above, at least one carousel structure (G) is arranged in the reel unwinding station on which several supports (403) are mounted, each suitable for supporting a corresponding reel and which is controlled and moved to cyclically arranging said supports in correspondence with several operating positions which include at least one predetermined loading position and at least one different predetermined exhaustion position, and in which preferably the loading position is also an initial unwinding position and the exhaustion position is also an intermediate unwinding position. For example, the carousels (G) can be two in number, intended to feed two distinct tube mills. In the event that the system is intended to power only one tube mill, only one carousel can be provided (G). More generally, the number of carousels (G), or the number of unwinding units (UU), is equal to the number of cardboard strips used by the tube-forming machines served by the plant.

Preferably, in order to reduce the overall dimensions of the unwinding station, each carousel (G) comprises two supports (403) in diametrically opposite positions with respect to a central axis of rotation of the carousel.

The carousel (G) can be a carousel with a vertical axis or also a carousel with a horizontal axis.

In practice, the details of execution may in any case vary in an equivalent way as regards the individual elements described and illustrated without thereby departing from the idea of the solution adopted and therefore remaining within the limits of the protection granted by this patent in accordance with the following claims.

The invention claimed is:

1. A plant for handling cardboard reels for feeding tube-forming machines, comprising a reel pick-up station (P) configured to receive a stack (2) of cardboard reels (1) superimposed according to a predetermined orientation, an unwinding station (U) for unwinding the reels (1) comprising at least an unwinding unit (UU) adapted to support the reels to be unwound in an unwinding position, in the unwinding station (U) being also provided splice means configured to splice a tail portion (TY) of a running out reel (1Y) with a new reel (1W) to continuously unwind the reels progressively arranged in the unwinding station (U), and handling means (D) for moving the reels (1) along a predetermined path comprised between the reel pick-up station (P) and the unwinding station (U), characterized in that said reel handling means are configured and controlled for picking up the reels from the stack in the reel pick up station (P), moving the reels along said path, and positioning the reels in the unwinding station, by keeping the initial orientation of the reels constant with respect to the stack (2) at least in the step of picking up the reels from the stack (2) and in that said handling means of the reels are provided with an additional reel engaging/disengaging device associated with the reel handling means and adapted for reversible hooking of the reels to the same handling means.

2. The plant according to claim 1 characterized in that said path comprises a first vertical run for lifting the reels, a second horizontal run developed along a circular arc and a third vertical descent run for the reels.

3. The plant according to claim 1 characterized in that the means for handling the reels comprise pneumatic means adapted to pressurize a space(S) inside the stack of reels, in which said space includes the interface between an uppermost reel of the stack and the underlying reel, and mechanical or pneumatic gripping means configured and controlled for gripping and respectively releasing the uppermost reel of the stack.

4. The plant according to claim 1 characterized in that said handling means of the reels are connected to an arm (200) which can be moved along said path.

5. The plant according to claim 1 characterized in that said at least one unwinding unit (UU) comprises a plurality of supports (403; 404) mounted on a structure (G) that is controlled and moved for cyclically arranging said supports in correspondence with a plurality of operating positions that include a predetermined position (W) for loading the reels and a different predetermined position (Y) of exhaustion of the reels and in that said reel pick-up station (P) is configured to receive a stack (2) of superimposed cardboard reels (1), and in that said handling means (D) of the reels are configured and controlled to pick up one reel at a time from the stack (2) and move this reel from the pick-up station (P) to a support (403; 404) of said at least one unwinding unit (UU) arranged in the loading position (W).

6. The plant according to claim 1 characterized in that said at least one unwinding unit (UU) comprises a plurality of supports (403; 404) mounted on a structure (G) that is controlled and moved for cyclically arranging said supports in correspondence with a plurality of operating positions that include a predetermined position (W) for loading the reels and a different predetermined position (Y) of exhaustion of the reels and in that said reel pick-up station (P) is configured to receive a stack (2) of superimposed cardboard reels (1), and in that said handling means (D) of the reels are configured and controlled to pick up one reel at a time from the stack (2) and move this reel from the pick-up station (P) to a support (403; 404) of said at least one unwinding unit (UU) arranged in the loading position (W) and the reel loading position (W) is also an initial unwinding position in which unwinding of the reels starts and/or the reel exhaustion position (Y) is also an intermediate unwinding position in which the reels unwind until they run out.

7. The plant according to claim 1 characterized in that said at least one unwinding unit (UU) comprises a plurality of supports (403; 404) mounted on a structure (G) that is controlled and moved for cyclically arranging said supports in correspondence with a plurality of operating positions that include a predetermined position (W) for loading the reels and a different predetermined position (Y) of exhaustion of the reels and in that said reel pick-up station (P) is configured to receive a stack (2) of superimposed cardboard reels (1), and in that said handling means (D) of the reels are configured and controlled to pick up one reel at a time from the stack (2) and move this reel from the pick-up station (P) to a support (403; 404) of said at least one unwinding unit (UU) arranged in the loading position (W) and a different position (Z) for unloading the exhausted reels is provided between said exhaustion (Y) and loading (W) positions.

8. The plant according to claim 1 characterized in that said at least one unwinding unit (UU) comprises a plurality of supports (403; 404) mounted on a structure (G) that is controlled and moved for cyclically arranging said supports in correspondence with a plurality of operating positions that include a predetermined position (W) for loading the reels and a different predetermined position (Y) of exhaustion of the reels and in that said reel pick-up station (P) is configured to receive a stack (2) of superimposed cardboard reels (1), and in that said handling means (D) of the reels are configured and controlled to pick up one reel at a time from the stack (2) and move this reel from the pick-up station (P) to a support (403; 404) of said at least one unwinding unit (UU) arranged in the loading position (W) and said structure (G) is a carousel structure having a vertical axis or a horizontal axis.

9. The plant according to claim 1 characterized in that said at least one unwinding unit (UU) comprises a plurality of supports (403; 404) mounted on a structure (G) that is controlled and moved for cyclically arranging said supports in correspondence with a plurality of operating positions that include a predetermined position (W) for loading the reels and a different predetermined position (Y) of exhaustion of the reels and in that said reel pick-up station (P) is configured to receive a stack (2) of superimposed cardboard reels (1), and in that said handling means (D) of the reels are configured and controlled to pick up one reel at a time from the stack (2) and move this reel from the pick-up station (P) to a support (403; 404) of said at least one unwinding unit (UU) arranged in the loading position (W) and the structure (G) is a carousel that comprises two said supports (403; 404) in diametrically opposite positions with respect to a central axis (AU) of rotation of the carousel.

10. The plant according to claim 1 characterized in that said at least one unwinding unit (UU) comprises a plurality of supports (403; 404) mounted on a structure (G) that is controlled and moved for cyclically arranging said supports in correspondence with a plurality of operating positions that include a predetermined position (W) for loading the reels and a different predetermined position (Y) of exhaustion of the reels and in that said reel pick-up station (P) is configured to receive a stack (2) of superimposed cardboard reels (1), and in that said handling means (D) of the reels are configured and controlled to pick up one reel at a time from the stack (2) and move this reel from the pick-up station (P) to a support (403; 404) of said at least one unwinding unit (UU) arranged in the loading position (W) and said splice means are mounted on a mobile support (500) configured and controlled to approach said structure (G) and respectively move away from said structure and are activated when the mobile support is approached the structure (G).

11. The plant according to claim 1 characterized in that said at least one unwinding unit (UU) comprises a plurality of supports (403; 404) mounted on a structure (G) that is controlled and moved for cyclically arranging said supports in correspondence with a plurality of operating positions that include a predetermined position (W) for loading the reels and a different predetermined position (Y) of exhaustion of the reels and in that said reel pick-up station (P) is configured to receive a stack (2) of superimposed cardboard reels (1), and in that said handling means (D) of the reels are configured and controlled to pick up one reel at a time from the stack (2) and move this reel from the pick-up station (P) to a support (403; 404) of said at least one unwinding unit (UU) arranged in the loading position (W) and said splice means are mounted on a mobile support (500) configured and controlled to approach said structure (G) and respectively move away from said structure and are activated when the mobile support is approached the structure (G) and said movable support (500) is a support rotatably mounted on a corresponding axis of rotation (V5; A5).

12. The plant according to claim 1 characterized in that said at least one unwinding unit (UU) comprises a plurality of supports (403; 404) mounted on a structure (G) that is controlled and moved for cyclically arranging said supports in correspondence with a plurality of operating positions that include a predetermined position (W) for loading the reels and a different predetermined position (Y) of exhaustion of the reels and in that said reel pick-up station (P) is configured to receive a stack (2) of superimposed cardboard reels (1), and in that said handling means (D) of the reels are configured and controlled to pick up one reel at a time from the stack (2) and move this reel from the pick-up station (P) to a support (403; 404) of said at least one unwinding unit (UU) arranged in the loading position (W) and said splice means are mounted on a mobile support (500) configured and controlled to approach said structure (G) and respectively move away from said structure and are activated when the mobile support is approached the structure (G) and said splice means comprise a pressure roller (505) mounted on the mobile support (500) and adapted to exert a pressure on the parts to be spliced when is detected the passage of a portion of adhesive material (BA) arranged on the new reel, said detection being performed by detection means (519) configured to detect the passage of said portion of adhesive material (BA).

13. The plant according to claim 1 characterized in that said at least one unwinding unit (UU) comprises a plurality of supports (403; 404) mounted on a structure (G) that is controlled and moved for cyclically arranging said supports in correspondence with a plurality of operating positions that include a predetermined position (W) for loading the reels and a different predetermined position (Y) of exhaustion of the reels and in that said reel pick-up station (P) is configured to receive a stack (2) of superimposed cardboard reels (1), and in that said handling means (D) of the reels are configured and controlled to pick up one reel at a time from the stack (2) and move this reel from the pick-up station (P) to a support (403; 404) of said at least one unwinding unit (UU) arranged in the loading position (W) and said splice means are mounted on a mobile support (500) configured and controlled to approach said structure (G) and respectively move away from said structure and are activated when the mobile support is approached the structure (G) and further characterized in that it comprises a blade (510), mounted on said mobile support (500), configured and controlled to cut the strip of cardboard (SY) that unwinds from the reels in the exhaustion phase, said blade being activated according to a detection performed by detection means (519) configured to detect the passage of a portion of adhesive material (BA) arranged on the new reel.

14. The plant according to claim 1 characterized in that in said reel pick-up station (P) there is a mobile platform (PP) whose position with respect to the loading means (D) is controlled in a horizontal plane (x, y) by detecting the position of a central axis (AC) of said stack of reels with respect to an axis (A9) of the loading means, said platform (PP) being configured to receive the stack (2) of superimposed cardboard reels (1) during the positioning of the stack (2) in the reel pick-up station (P).

15. The plant according to claim 1 characterized in that in said reel pick-up station (P) there is a mobile platform (PP) whose position with respect to the loading means (D) is controlled in a horizontal plane (x, y) by detecting the position of a central axis (AC) of said stack of reels with respect to an axis (A9) of the loading means, said platform (PP) being configured to receive the stack (2) of superimposed cardboard reels (1) during the positioning of the stack (2) in the reel pick-up station (P) and said platform (PP) is connected with two electric actuators (PMX, PMY) configured and controlled to move the platform along two mutually orthogonal directions of said plane (x, y).

16. A process for handling cardboard reels for feeding tube-forming machines, comprising the arrangement of a reel pick-up station (P) configured to receive a stack of cardboard reels (1) superimposed according to a predetermined orientation, an unwinding station (U) for unwinding the reels (1) comprising at least one unwinding unit (UU) adapted for supporting the reels to be unwound in an unwinding position, splice means being also provided in the unwinding station (U) configured to splice a tail portion (TY) of a reel (1Y) in the run-out phase with a new reel (1W) to continuously unwind the reels progressively arranged in the unwinding station (U), and handling means (D) for moving the reels (1) along a predetermined path between the reel pick-up station (P) and the unwinding station (U), characterized in that the pick-up of the reels from the stack arranged in the pick-up station (P), the movement of the reels along said path, and the positioning of the reels in the unwinding station are executed by keeping constant the initial orientation of the reels in relation to the stack (2) at least during the step of pick- up the reels from the stack (2) and in that the handling means of the reels are provided with an additional reel engaging/disengaging device associated with the reel handling means and adapted for reversible hooking the reels to the same handling means.

17. The process according to claim 16 characterized in that said path comprises a first vertical run for lifting the reels, a second horizontal run developed along a circular arc and a third vertical descent run for the reels.

18. The process according to claim 16 characterized in that during the step of pick-up the reels (1) from the stack (2) a space(S) inside the stack of reels is pressurized, said space including the interface between an uppermost reel of the stack and the underlying reel.

* * * * *